US009869450B2

(12) United States Patent
Pickard et al.

(10) Patent No.: US 9,869,450 B2
(45) Date of Patent: Jan. 16, 2018

(54) LIGHTING SYSTEMS HAVING A TRUNCATED PARABOLIC- OR HYPERBOLIC-CONICAL LIGHT REFLECTOR, OR A TOTAL INTERNAL REFLECTION LENS; AND HAVING ANOTHER LIGHT REFLECTOR

(71) Applicant: EcoSense Lighting Inc., Los Angeles, CA (US)

(72) Inventors: Paul Pickard, Acton, CA (US); Raghuram L. V. Petluri, Cerritos, CA (US)

(73) Assignee: ECOSENSE LIGHTING INC., Los Angeles, CA (US)

( * ) Notice: Subject to any disclaimer, the term of this patent is extended or adjusted under 35 U.S.C. 154(b) by 0 days.

(21) Appl. No.: 14/617,849

(22) Filed: Feb. 9, 2015

(65) Prior Publication Data

US 2016/0230958 A1 Aug. 11, 2016

(51) Int. Cl.
*F21V 7/04* (2006.01)
*F21V 13/12* (2006.01)
(Continued)

(52) U.S. Cl.
CPC ..... *F21V 7/04* (2013.01); *F21V 13/12* (2013.01); *F21V 7/0091* (2013.01); *F21V 9/16* (2013.01); *F21Y 2115/10* (2016.08)

(58) Field of Classification Search
CPC ..... F21V 13/08; F21V 13/12; F21V 13/14; F21V 13/10; F21V 19/042; F21V 19/045;
(Continued)

(56) References Cited

U.S. PATENT DOCUMENTS 2,430,472 A 11/1947 Levy
D149,124 S 3/1948 Hewitt
(Continued)

FOREIGN PATENT DOCUMENTS

CA 2623604 A1 8/2009
CN 1536686 A 10/2004
(Continued)

OTHER PUBLICATIONS

Knight, Colette, "Xicato—Investigations on the use of LED modules for optimized color appearance in retail applications," downloaded on May 28, 2014 from http://www.xicato.com/sites/default/files/documents/Summary_investigations_on_the_use_of_LED_modules_for_optimized_color_appearance_in_retail_applications.pdf, 6pp.
(Continued)

*Primary Examiner* — Robert May
(74) *Attorney, Agent, or Firm* — Jay M. Brown

(57) ABSTRACT

Lighting system including light source having semiconductor light-emitting device configured for emitting light having first spectral power distribution along central axis. System includes volumetric lumiphor located along central axis configured for converting some light emissions having first spectral power distribution into light emissions having second spectral power distribution. System may include visible light reflector having reflective surface and being spaced apart along central axis with volumetric lumiphor between semiconductor light-emitting device and visible light reflector. Reflective surface may be configured for causing portion of light emissions to be reflected by visible light reflector. Exterior surface of volumetric lumiphor may include concave exterior surface configured for receiving a mound-shaped reflective surface of visible light reflector. Volumetric lumiphor may have exterior surface that includes:
(Continued)

concave exterior surface forming gap between semiconductor light-emitting device and volumetric lumiphor; or convex or concave exterior surface located away from and surrounding central axis. Related lighting processes.

89 Claims, 7 Drawing Sheets

(51) Int. Cl.
*F21V 7/00* (2006.01)
*F21V 9/16* (2006.01)
*F21Y 115/10* (2016.01)

(58) Field of Classification Search
CPC .... F21K 9/64; F21K 9/00; F21K 99/00; F21S 2/00; F21Y 2115/10; F21Y 2115/20; F21Y 2101/02
See application file for complete search history.

(56) References Cited

U.S. PATENT DOCUMENTS

D152,113 S 12/1948 Mehr
2,458,967 A 1/1949 Wiedenhoeft
2,678,380 A 5/1954 Westby
2,702,378 A 2/1955 Talty
D191,734 S 11/1961 Daher
3,040,170 A 6/1962 Chwan
3,078,366 A 2/1963 Winkler
3,120,929 A 2/1964 Henning
3,220,471 A 11/1965 Coe
3,247,368 A 4/1966 McHugh
3,435,891 A 4/1969 Parrish
D214,582 S 7/1969 Routh
D217,096 S 4/1970 Birns
3,538,321 A 11/1970 Longenecker
3,639,751 A 2/1972 Pichel
3,643,038 A 2/1972 Sato
D231,559 S 4/1974 Darling et al.
D234,712 S 4/1975 Kennedy et al.
3,989,976 A 11/1976 Tabor
4,090,210 A 5/1978 Wehling et al.
4,091,444 A 5/1978 Mori
4,138,716 A 2/1979 Muhlethaler et al.
D251,500 S 4/1979 Aigner
4,258,413 A 3/1981 Mausser
4,345,306 A 8/1982 Summey
4,414,489 A 11/1983 Young
4,420,207 A 12/1983 Nishikawa
4,423,471 A 12/1983 Gordin et al.
4,445,164 A 4/1984 Giles, III
4,453,203 A 6/1984 Pate
4,467,403 A 8/1984 May
4,473,873 A 9/1984 Quiogue
4,564,888 A 1/1986 Lewin
4,578,742 A 3/1986 Klein
4,580,859 A 4/1986 Frano
4,609,979 A 9/1986 Kristofek
4,674,015 A 6/1987 Smith
4,727,648 A 3/1988 Savage
4,733,335 A 3/1988 Serizawa
D296,717 S 7/1988 Kane et al.
4,755,918 A 7/1988 Pristash
4,757,431 A 7/1988 Cross
4,761,721 A 8/1988 Willing
D300,876 S 4/1989 Sakai
4,833,579 A 5/1989 Skegin
4,837,927 A 6/1989 Savage
4,870,327 A 9/1989 Jorgensen
4,872,097 A 10/1989 Miller
4,882,667 A 11/1989 Skegin
4,918,497 A 4/1990 Edmond
D308,114 S 5/1990 Shemitz
D308,260 S 5/1990 Shemitz
4,966,862 A 10/1990 Edmond
D315,030 S 2/1991 Jacobs et al.
D316,303 S 4/1991 Layne
D316,306 S 4/1991 Shemitz
5,027,168 A 6/1991 Edmond
D319,512 S 8/1991 Lettenmayer
D322,862 S 12/1991 Miller
5,087,212 A 2/1992 Hanami
D325,645 S 4/1992 Grange
5,140,507 A 8/1992 Harwood
D330,944 S 11/1992 Wereley
5,174,649 A 12/1992 Alston
5,177,404 A 1/1993 Cohen
5,210,051 A 5/1993 Carter, Jr.
D336,536 S 6/1993 Shaanan et al.
5,235,470 A 8/1993 Cheng
D340,514 S 10/1993 Liao
5,253,152 A 10/1993 Yang
5,282,364 A 2/1994 Cech
5,303,124 A 4/1994 Wrobel
5,324,213 A 6/1994 Frantz
5,325,281 A 6/1994 Harwood
D348,744 S 7/1994 Johnson et al.
5,335,159 A 8/1994 Chen et al.
5,337,225 A 8/1994 Brookman
5,338,944 A 8/1994 Edmond et al.
5,359,345 A 10/1994 Hunter
5,367,229 A 11/1994 Yang
5,381,323 A 1/1995 Osteen et al.
5,387,901 A 2/1995 Hardt
5,393,993 A 2/1995 Edmond et al.
5,410,462 A 4/1995 Wolfe
5,416,342 A 5/1995 Edmond et al.
5,436,809 A 7/1995 Brassier
5,440,466 A 8/1995 Belisle
5,450,303 A 9/1995 Markiewicz et al.
5,490,048 A 2/1996 Brassier
5,504,665 A 4/1996 Osteen et al.
5,515,253 A 5/1996 Sjobom
5,516,390 A 5/1996 Tomita et al.
5,523,589 A 6/1996 Edmond et al.
D373,437 S 9/1996 Kira
5,584,574 A 12/1996 Haddad
5,599,091 A 2/1997 Kira
5,604,135 A 2/1997 Edmond et al.
5,628,557 A 5/1997 Huang
5,631,190 A 5/1997 Negley
5,632,551 A 5/1997 Roney
5,634,822 A 6/1997 Gunell
5,655,832 A 8/1997 Pelka
5,658,066 A 8/1997 Hirsch
D383,236 S 9/1997 Krogman
D384,336 S 9/1997 Gerber
5,676,453 A 10/1997 Parkyn, Jr.
D390,992 S 2/1998 Shemitz
5,713,662 A 2/1998 Kira
5,739,554 A 4/1998 Edmond et al.
5,757,144 A 5/1998 Nilssen
5,788,533 A 8/1998 Alvarado-Rodriguez
5,794,685 A 8/1998 Dean
5,800,050 A 9/1998 Leadford
5,806,955 A 9/1998 Parkyn, Jr.
D408,823 S 4/1999 Kirby
5,890,793 A 4/1999 Stephens
5,894,196 A 4/1999 McDermott
5,898,267 A 4/1999 McDermott
5,909,955 A 6/1999 Roorda
5,912,477 A 6/1999 Negley
5,938,316 A 8/1999 Yan
5,971,571 A 10/1999 Rose
6,022,130 A 2/2000 Donato
6,051,940 A 4/2000 Arun
6,072,160 A 6/2000 Bahl
6,079,851 A 6/2000 Altman
6,083,021 A 7/2000 Lau
6,104,536 A 8/2000 Eckhardt
6,120,600 A 9/2000 Edmond et al.
6,124,673 A 9/2000 Bishop
6,149,112 A 11/2000 Thieltges

(56) References Cited

U.S. PATENT DOCUMENTS

| | | | |
|---|---|---|---|
| 6,149,288 | A | 11/2000 | Huang |
| 6,176,594 | B1 | 1/2001 | Yarconi |
| D437,449 | S | 2/2001 | Soller |
| D437,652 | S | 2/2001 | Uhler |
| 6,187,606 | B1 | 2/2001 | Edmond et al. |
| 6,198,233 | B1 | 3/2001 | McConaughy |
| 6,201,262 | B1 | 3/2001 | Edmond et al. |
| D443,710 | S | 6/2001 | Chiu |
| 6,244,877 | B1 | 6/2001 | Asao |
| 6,249,375 | B1 | 6/2001 | Silhengst |
| D445,936 | S | 7/2001 | Mier-Langner et al. |
| 6,260,981 | B1 | 7/2001 | Fiene |
| D446,592 | S | 8/2001 | Leen |
| 6,273,588 | B1 | 8/2001 | Arakelian |
| D448,508 | S | 9/2001 | Benghozi |
| 6,312,787 | B1 | 11/2001 | Hayashi et al. |
| 6,318,883 | B1 | 11/2001 | Sugiyama et al. |
| D452,843 | S | 1/2002 | Henrici |
| 6,341,523 | B2 | 1/2002 | Lynam |
| D457,673 | S | 5/2002 | Martinson |
| 6,386,723 | B1 | 5/2002 | Eberlein et al. |
| 6,390,646 | B1 | 5/2002 | Yan |
| 6,392,360 | B2 | 5/2002 | McConaughy |
| 6,426,704 | B1 | 7/2002 | Hutchison |
| 6,435,693 | B1 | 8/2002 | Fiene |
| 6,439,736 | B1 | 8/2002 | Fiene |
| 6,439,743 | B1 | 8/2002 | Hutchison |
| 6,439,749 | B1 | 8/2002 | Miller et al. |
| 6,441,943 | B1 | 8/2002 | Roberts |
| D462,801 | S | 9/2002 | Huang |
| 6,450,662 | B1 | 9/2002 | Hutchison |
| 6,450,664 | B1 | 9/2002 | Kelly |
| D464,455 | S | 10/2002 | Fong |
| D464,939 | S | 10/2002 | Chuang |
| D465,046 | S | 10/2002 | Layne |
| 6,473,002 | B1 | 10/2002 | Hutchison |
| 6,474,839 | B1 | 11/2002 | Hutchison |
| 6,478,453 | B2 | 11/2002 | Lammers |
| 6,488,386 | B1 | 12/2002 | Yan |
| 6,508,567 | B1 | 1/2003 | Fiene |
| D470,962 | S | 2/2003 | Chen |
| 6,525,939 | B2 | 2/2003 | Liang |
| D472,339 | S | 3/2003 | Russello et al. |
| 6,527,422 | B1 | 3/2003 | Hutchison |
| 6,530,674 | B2 | 3/2003 | Grierson et al. |
| D473,529 | S | 4/2003 | Feinbloom |
| 6,540,382 | B1 | 4/2003 | Simon |
| 6,561,690 | B2 | 5/2003 | Balestriero et al. |
| D476,439 | S | 6/2003 | O'Rourke |
| 6,598,998 | B2 | 7/2003 | West et al. |
| 6,600,175 | B1 | 7/2003 | Baretz et al. |
| 6,601,970 | B2 | 8/2003 | Ueda |
| 6,618,231 | B2 | 9/2003 | McConaughy |
| 6,632,006 | B1 | 10/2003 | Rippel |
| 6,636,003 | B2 | 10/2003 | Rahm et al. |
| D482,476 | S | 11/2003 | Kwong |
| 6,641,284 | B2 | 11/2003 | Stopa et al. |
| 6,662,211 | B1 | 12/2003 | Weller |
| 6,679,621 | B2 | 1/2004 | West et al. |
| 6,682,211 | B2 | 1/2004 | English |
| 6,683,419 | B2 | 1/2004 | Kriparos |
| 6,691,768 | B2 | 2/2004 | Hsieh |
| 6,703,640 | B1 | 3/2004 | Hembree |
| 6,733,164 | B1 | 5/2004 | Smith, Jr. |
| D491,306 | S | 6/2004 | Zucker |
| 6,744,693 | B2 | 6/2004 | Brockmann |
| 6,752,645 | B2 | 6/2004 | Nakamura |
| 6,773,138 | B2 | 8/2004 | Coushaine |
| 6,787,999 | B2 | 9/2004 | Stimac |
| 6,788,510 | B2 | 9/2004 | McConaughy |
| 6,791,119 | B2 | 9/2004 | Slater, Jr. et al. |
| 6,814,462 | B1 | 11/2004 | Fiene |
| 6,824,296 | B2 | 11/2004 | Souza |
| 6,824,390 | B2 | 11/2004 | Brown |
| 6,827,469 | B2 | 12/2004 | Coushaine |
| 6,853,010 | B2 | 2/2005 | Slater, Jr. et al. |
| 6,860,617 | B2 | 3/2005 | Fiene |
| 6,863,424 | B2 | 3/2005 | Smith |
| 6,864,513 | B2 | 3/2005 | Lin |
| 6,869,206 | B2 | 3/2005 | Zimmerman |
| 6,871,993 | B2 | 3/2005 | Hecht |
| D504,967 | S | 5/2005 | Kung |
| 6,893,144 | B2 | 5/2005 | Fan |
| D506,065 | S | 6/2005 | Sugino |
| 6,902,200 | B1 | 6/2005 | Beadle |
| 6,902,291 | B2 | 6/2005 | Rizkin |
| 6,903,380 | B2 | 6/2005 | Barnett |
| 6,905,232 | B2 | 6/2005 | Lin |
| 6,946,806 | B1 | 9/2005 | Choi |
| 6,958,497 | B2 | 10/2005 | Emerson et al. |
| 6,960,872 | B2 | 11/2005 | Beeson et al. |
| 6,966,677 | B2 | 11/2005 | Galli |
| 6,979,097 | B2 | 12/2005 | Elam |
| D516,020 | S | 2/2006 | Wong |
| D516,229 | S | 2/2006 | Tang |
| 6,998,650 | B1 | 2/2006 | Wu |
| 7,025,464 | B2 | 4/2006 | Beeson et al. |
| 7,040,774 | B2 | 5/2006 | Beeson |
| 7,048,385 | B2 | 5/2006 | Beeson et al. |
| 7,063,130 | B2 | 6/2006 | Huang |
| 7,063,440 | B2 | 6/2006 | Mohacsi et al. |
| 7,066,617 | B2 | 6/2006 | Mandy |
| D524,975 | S | 7/2006 | Oas |
| 7,070,301 | B2 | 7/2006 | Magarill |
| 7,077,546 | B2 | 7/2006 | Yamauchi |
| D527,119 | S | 8/2006 | Maxik |
| D527,131 | S | 8/2006 | McCarthy, III |
| 7,093,958 | B2 | 8/2006 | Coushaine |
| 7,095,056 | B2 | 8/2006 | Vitta et al. |
| 7,097,332 | B2 | 8/2006 | Vamberi |
| 7,098,397 | B2 | 8/2006 | Lange |
| 7,111,963 | B2 | 9/2006 | Zhang |
| 7,111,971 | B2 | 9/2006 | Coushaine |
| 7,112,916 | B2 | 9/2006 | Goh |
| D530,683 | S | 10/2006 | Rivas |
| 7,131,749 | B2 | 11/2006 | Wimberly |
| 7,132,804 | B2 | 11/2006 | Lys |
| 7,138,667 | B2 | 11/2006 | Barnett |
| 7,149,089 | B2 | 12/2006 | Blasko |
| 7,150,553 | B2 | 12/2006 | English |
| D535,774 | S | 1/2007 | Weston et al. |
| 7,159,997 | B2 | 1/2007 | Reo et al. |
| 7,160,004 | B2 | 1/2007 | Peck |
| 7,172,319 | B2 | 2/2007 | Holder et al. |
| 7,182,480 | B2 | 2/2007 | Kan |
| D538,951 | S | 3/2007 | Maxik |
| D539,459 | S | 3/2007 | Benghozi |
| 7,198,386 | B2 | 4/2007 | Zampini |
| 7,207,696 | B1 | 4/2007 | Lin |
| D541,957 | S | 5/2007 | Wang |
| 7,210,957 | B2 | 5/2007 | Mrakovich et al. |
| 7,213,940 | B1 | 5/2007 | Van De Ven et al. |
| 7,221,374 | B2 | 5/2007 | Dixon |
| D544,110 | S | 6/2007 | Hooker |
| D545,457 | S | 6/2007 | Chen |
| 7,234,950 | B1 | 6/2007 | Wickett |
| 7,237,930 | B2 | 7/2007 | Onishi et al. |
| D548,691 | S | 8/2007 | Krieger |
| 7,267,461 | B2 | 9/2007 | Kan et al. |
| 7,273,299 | B2 | 9/2007 | Parkyn et al. |
| D552,779 | S | 10/2007 | Starck |
| 7,282,840 | B2 | 10/2007 | Chih |
| 7,285,791 | B2 | 10/2007 | Beeson et al. |
| 7,286,296 | B2 | 10/2007 | Chaves |
| 7,288,902 | B1 | 10/2007 | Melanson |
| 7,293,908 | B2 | 11/2007 | Beeson |
| 7,303,301 | B2 | 12/2007 | Koren |
| D561,924 | S | 2/2008 | Yiu |
| D563,013 | S | 2/2008 | Levine |
| 7,329,907 | B2 | 2/2008 | Pang et al. |
| D564,119 | S | 3/2008 | Metlen |
| 7,344,279 | B2 | 3/2008 | Mueller |
| 7,344,296 | B2 | 3/2008 | Matsui |
| 7,352,006 | B2 | 4/2008 | Beeson et al. |

(56) References Cited

U.S. PATENT DOCUMENTS

| | | | |
|---|---|---|---|
| 7,352,124 | B2 | 4/2008 | Beeson et al. |
| 7,357,534 | B2 | 4/2008 | Snyder |
| 7,358,657 | B2 | 4/2008 | Koelger |
| 7,358,679 | B2 | 4/2008 | Lys et al. |
| 7,360,925 | B2 | 4/2008 | Coushaine |
| D568,829 | S | 5/2008 | Yamashita |
| 7,369,386 | B2 | 5/2008 | Rasmussen |
| 7,370,993 | B2 | 5/2008 | Beeson et al. |
| 7,378,686 | B2 | 5/2008 | Beeson et al. |
| D570,505 | S | 6/2008 | Maxik |
| 7,381,942 | B2 | 6/2008 | Chin et al. |
| D574,095 | S | 7/2008 | Hill |
| 7,396,139 | B2 | 7/2008 | Savage |
| 7,396,146 | B2 | 7/2008 | Wang |
| 7,413,326 | B2 | 8/2008 | Tain |
| D576,545 | S | 9/2008 | Mandel |
| D576,964 | S | 9/2008 | Shaner |
| D577,453 | S | 9/2008 | Metlen |
| D577,836 | S | 9/2008 | Engebrigtsen |
| 7,422,347 | B2 | 9/2008 | Miyairi et al. |
| D579,421 | S | 10/2008 | Chu |
| 7,431,463 | B2 | 10/2008 | Beeson et al. |
| D581,080 | S | 11/2008 | Mier-Langner |
| D581,554 | S | 11/2008 | To |
| D581,583 | S | 11/2008 | Peng |
| 7,452,115 | B2 | 11/2008 | Alcelik |
| 7,456,499 | B2 | 11/2008 | Loh et al. |
| D583,975 | S | 12/2008 | Kushinskaya et al. |
| 7,458,820 | B2 | 12/2008 | Ohta |
| 7,467,888 | B2 | 12/2008 | Fiene |
| D585,588 | S | 1/2009 | Alexander |
| D585,589 | S | 1/2009 | Alexander |
| 7,481,552 | B2 | 1/2009 | Mayfield, III et al. |
| 7,482,567 | B2 | 1/2009 | Hoelen et al. |
| D586,498 | S | 2/2009 | Wu |
| D587,389 | S | 2/2009 | Benensohn |
| 7,494,248 | B2 | 2/2009 | Li |
| 7,497,581 | B2 | 3/2009 | Beeson |
| 7,513,675 | B2 | 4/2009 | Mier-Langner |
| D591,894 | S | 5/2009 | Flank |
| D592,799 | S | 5/2009 | Scott |
| 7,532,324 | B2 | 5/2009 | Liu et al. |
| 7,537,464 | B2 | 5/2009 | Brandenburg |
| 7,539,028 | B2 | 5/2009 | Baurle et al. |
| D593,512 | S | 6/2009 | Lin |
| 7,540,761 | B2 | 6/2009 | Weber |
| 7,549,786 | B2 | 6/2009 | Higley |
| D597,246 | S | 7/2009 | Meyer, IV |
| D597,247 | S | 7/2009 | Meyer, IV |
| 7,559,784 | B2 | 7/2009 | Hsiao |
| 7,564,180 | B2 | 7/2009 | Brandes |
| D597,704 | S | 8/2009 | Peng |
| D599,040 | S | 8/2009 | Alexander |
| 7,575,332 | B2 | 8/2009 | Cok |
| 7,575,338 | B1 | 8/2009 | Verfuerth |
| 7,580,192 | B1 | 8/2009 | Chu |
| D601,276 | S | 9/2009 | Grajcar |
| 7,582,915 | B2 | 9/2009 | Hsing Chen et al. |
| 7,591,572 | B1 | 9/2009 | Levine |
| 7,592,637 | B2 | 9/2009 | Zimmerman et al. |
| 7,594,738 | B1 | 9/2009 | Lin |
| D602,868 | S | 10/2009 | Vogt |
| 7,604,365 | B2 | 10/2009 | Chang |
| 7,607,802 | B2 | 10/2009 | Kang |
| 7,621,770 | B1 | 11/2009 | Finizio |
| 7,626,345 | B2 | 12/2009 | Young |
| 7,628,506 | B2 | 12/2009 | Verfuerth |
| 7,637,635 | B2 | 12/2009 | Xiao |
| D608,043 | S | 1/2010 | Ko |
| D610,543 | S | 2/2010 | Coushaine |
| D610,723 | S | 2/2010 | Grajcar |
| D610,729 | S | 2/2010 | Kushinskaya et al. |
| 7,665,862 | B2 | 2/2010 | Villard |
| 7,674,018 | B2 | 3/2010 | Holder et al. |
| 7,679,281 | B2 | 3/2010 | Kim et al. |
| 7,686,481 | B1 | 3/2010 | Condon et al. |
| 7,690,810 | B2 | 4/2010 | Saitoh et al. |
| 7,703,942 | B2 | 4/2010 | Narendran et al. |
| 7,703,945 | B2 | 4/2010 | Leung et al. |
| 7,703,951 | B2 | 4/2010 | Piepgras |
| 7,722,227 | B2 | 5/2010 | Zhang |
| 7,727,009 | B2 | 6/2010 | Goto |
| 7,731,395 | B2 | 6/2010 | Parkyn et al. |
| 7,731,396 | B2 | 6/2010 | Fay |
| 7,736,029 | B2 | 6/2010 | Chen et al. |
| 7,737,634 | B2 | 6/2010 | Leng et al. |
| 7,740,380 | B2 | 6/2010 | Thrailkill |
| 7,744,259 | B2 | 6/2010 | Walczak |
| 7,744,266 | B2 | 6/2010 | Higley |
| 7,748,870 | B2 | 7/2010 | Chang |
| 7,759,881 | B1 | 7/2010 | Melanson |
| 7,766,508 | B2 | 8/2010 | Villard et al. |
| 7,766,518 | B2 | 8/2010 | Piepgras |
| 7,784,966 | B2 | 8/2010 | Verfuerth |
| 7,785,124 | B2 | 8/2010 | Lin |
| D625,870 | S | 10/2010 | Feigenbaum |
| D626,094 | S | 10/2010 | Alexander |
| 7,806,562 | B2 | 10/2010 | Behr |
| 7,810,951 | B1 | 10/2010 | Lee et al. |
| 7,810,955 | B2 | 10/2010 | Stimac et al. |
| 7,810,995 | B2 | 10/2010 | Fadler et al. |
| 7,813,111 | B2 | 10/2010 | Anderson |
| 7,819,549 | B2 | 10/2010 | Narendran |
| D627,507 | S | 11/2010 | Lai |
| D627,727 | S | 11/2010 | Alexander |
| D628,156 | S | 11/2010 | Alexander |
| 7,828,576 | B2 | 11/2010 | Lin |
| 7,829,899 | B2 | 11/2010 | Hutchins |
| 7,837,348 | B2 | 11/2010 | Narendran |
| 7,841,739 | B2 | 11/2010 | Liu et al. |
| 7,841,753 | B2 | 11/2010 | Liu |
| D629,365 | S | 12/2010 | Garcia De Vicuna |
| 7,845,393 | B2 | 12/2010 | Kao |
| 7,857,482 | B2 | 12/2010 | Reo et al. |
| 7,857,498 | B2 | 12/2010 | Smith |
| 7,862,212 | B2 | 1/2011 | Huang et al. |
| 7,866,845 | B2 | 1/2011 | Man |
| 7,866,850 | B2 | 1/2011 | Alexander |
| 7,874,700 | B2 | 1/2011 | Patrick |
| D633,244 | S | 2/2011 | Kramer et al. |
| D633,248 | S | 2/2011 | Alexander |
| 7,889,421 | B2 | 2/2011 | Narendran |
| 7,896,517 | B2 | 3/2011 | Mandy |
| 7,901,108 | B2 | 3/2011 | Kabuki et al. |
| 7,914,162 | B1 | 3/2011 | Huang |
| 7,914,198 | B2 | 3/2011 | Mier-Langner |
| 7,918,581 | B2 | 4/2011 | Van De Ven |
| 7,918,589 | B2 | 4/2011 | Mayfield, III et al. |
| 7,922,364 | B2 | 4/2011 | Tessnow |
| 7,923,907 | B2 | 4/2011 | Tessnow |
| 7,942,559 | B2 | 5/2011 | Holder et al. |
| 7,952,114 | B2 | 5/2011 | Gingrich, III |
| 7,963,666 | B2 | 6/2011 | Leung et al. |
| 7,965,494 | B1 | 6/2011 | Morris |
| 7,967,477 | B2 | 6/2011 | Bloemen et al. |
| 7,972,038 | B2 | 7/2011 | Albright |
| 7,972,054 | B2 | 7/2011 | Alexander |
| 7,976,194 | B2 | 7/2011 | Wilcox et al. |
| 7,985,005 | B2 | 7/2011 | Alexander |
| 7,988,336 | B1 | 8/2011 | Harbers |
| 7,993,031 | B2 | 8/2011 | Grajcar |
| 8,002,438 | B2 | 8/2011 | Ko |
| 8,007,131 | B2 | 8/2011 | Liu et al. |
| D645,007 | S | 9/2011 | Alexander |
| D645,594 | S | 9/2011 | Grawe |
| 8,021,008 | B2 | 9/2011 | Ramer |
| 8,029,157 | B2 | 10/2011 | Li et al. |
| 8,031,393 | B2 | 10/2011 | Narendran et al. |
| 8,033,680 | B2 | 10/2011 | Sharrah |
| 8,052,310 | B2 | 11/2011 | Gingrich, III |
| 8,066,403 | B2 | 11/2011 | Sanfilippo et al. |
| 8,066,408 | B2 | 11/2011 | Rinko |
| D650,504 | S | 12/2011 | Kim et al. |
| D650,935 | S | 12/2011 | Beghelli |

(56) References Cited

U.S. PATENT DOCUMENTS

| | | | |
|---|---|---|---|
| 8,080,819 | B2 | 12/2011 | Mueller et al. |
| 8,083,364 | B2 | 12/2011 | Allen |
| 8,096,668 | B2 | 1/2012 | Abu-Ageel |
| 8,100,560 | B2 | 1/2012 | Ahland, III et al. |
| 8,100,564 | B2 | 1/2012 | Ono |
| 8,102,167 | B2 | 1/2012 | Irissou et al. |
| 8,102,683 | B2 | 1/2012 | Gaknoki et al. |
| D654,607 | S | 2/2012 | Kim et al. |
| 8,118,450 | B2 | 2/2012 | Villard |
| 8,118,454 | B2 | 2/2012 | Rains, Jr. |
| 8,123,376 | B2 | 2/2012 | Van De Ven et al. |
| 8,125,776 | B2 | 2/2012 | Alexander |
| D655,432 | S | 3/2012 | Beghelli |
| D655,840 | S | 3/2012 | Heaton et al. |
| D655,842 | S | 3/2012 | Sabernig |
| 8,129,669 | B2 | 3/2012 | Chen et al. |
| 8,136,958 | B2 | 3/2012 | Verfuerth |
| 8,138,690 | B2 | 3/2012 | Chemel et al. |
| 8,142,047 | B2 | 3/2012 | Acampora et al. |
| 8,143,803 | B2 | 3/2012 | Beij et al. |
| 8,152,336 | B2 | 4/2012 | Alexander |
| 8,154,864 | B1 | 4/2012 | Nearman |
| 8,162,498 | B2 | 4/2012 | Ramer |
| 8,164,825 | B2 | 4/2012 | Narendran et al. |
| D659,871 | S | 5/2012 | Lee et al. |
| D660,229 | S | 5/2012 | Tseng |
| 8,172,425 | B2 | 5/2012 | Wen et al. |
| 8,172,436 | B2 | 5/2012 | Coleman |
| 8,177,395 | B2 | 5/2012 | Alexander |
| 8,182,122 | B2 | 5/2012 | Chiu |
| 8,191,613 | B2 | 6/2012 | Yuan |
| 8,193,738 | B2 | 6/2012 | Chu et al. |
| 8,201,965 | B2 | 6/2012 | Yamada |
| 8,205,998 | B2 | 6/2012 | Ramer |
| 8,210,722 | B2 | 7/2012 | Holder et al. |
| 8,212,469 | B2 | 7/2012 | Rains, Jr. |
| 8,215,798 | B2 | 7/2012 | Rains, Jr. |
| 8,232,745 | B2 | 7/2012 | Chemel et al. |
| D665,340 | S | 8/2012 | Obata |
| 8,242,766 | B2 | 8/2012 | Gaknoki et al. |
| 8,246,212 | B2 | 8/2012 | Schaefer et al. |
| 8,287,150 | B2 | 10/2012 | Schaefer et al. |
| 8,292,482 | B2 | 10/2012 | Harbers |
| 8,297,788 | B2 | 10/2012 | Bishop |
| 8,297,792 | B1 | 10/2012 | Wang |
| 8,297,808 | B2 | 10/2012 | Yuan |
| 8,319,437 | B2 | 11/2012 | Carlin |
| 8,324,838 | B2 | 12/2012 | Shah et al. |
| 8,328,403 | B1 | 12/2012 | Morgan et al. |
| 8,330,378 | B2 | 12/2012 | Maehara et al. |
| 8,337,043 | B2 | 12/2012 | Verfuerth |
| 8,344,602 | B2 | 1/2013 | Lai |
| 8,360,609 | B2 | 1/2013 | Lee et al. |
| 8,360,621 | B2 | 1/2013 | Avila et al. |
| 8,378,563 | B2 * | 2/2013 | Reed ..... F21V 7/05 313/112 |
| 8,385,071 | B2 | 2/2013 | Lin |
| 8,403,541 | B1 | 3/2013 | Rashidi |
| 8,410,716 | B2 | 4/2013 | Yao et al. |
| 8,414,178 | B2 | 4/2013 | Alexander |
| 8,434,898 | B2 | 5/2013 | Sanfilippo et al. |
| 8,436,556 | B2 | 5/2013 | Eisele et al. |
| 8,454,193 | B2 | 6/2013 | Simon et al. |
| 8,459,841 | B2 | 6/2013 | Huang |
| 8,462,523 | B2 | 6/2013 | Gaknoki et al. |
| 8,466,611 | B2 | 6/2013 | Negley et al. |
| 8,469,542 | B2 | 6/2013 | Zampini, II et al. |
| 8,503,083 | B2 | 8/2013 | Seo |
| 8,529,102 | B2 | 9/2013 | Pickard et al. |
| 8,531,134 | B2 | 9/2013 | Chemel et al. |
| 8,536,802 | B2 | 9/2013 | Chemel et al. |
| 8,536,805 | B2 | 9/2013 | Shah et al. |
| 8,540,394 | B2 | 9/2013 | Veerasamy et al. |
| 8,543,249 | B2 | 9/2013 | Chemel et al. |
| D690,859 | S | 10/2013 | Mollaghaffari |
| 8,545,045 | B2 | 10/2013 | Tress |
| 8,545,049 | B2 | 10/2013 | Davis et al. |
| 8,547,034 | B2 | 10/2013 | Melanson et al. |
| 8,552,664 | B2 | 10/2013 | Chemel et al. |
| 8,556,469 | B2 | 10/2013 | Pickard |
| 8,558,518 | B2 | 10/2013 | Irissou et al. |
| 8,562,180 | B2 | 10/2013 | Alexander |
| 8,569,972 | B2 | 10/2013 | Melanson |
| 8,573,807 | B2 | 11/2013 | Borkar et al. |
| 8,573,816 | B2 | 11/2013 | Negley et al. |
| 8,575,858 | B2 | 11/2013 | Policy et al. |
| 8,579,467 | B1 | 11/2013 | Szeto |
| 8,581,504 | B2 | 11/2013 | Kost et al. |
| 8,581,521 | B2 | 11/2013 | Welten et al. |
| 8,585,245 | B2 | 11/2013 | Black et al. |
| 8,587,211 | B2 | 11/2013 | Melanson |
| 8,593,074 | B2 | 11/2013 | Hatley et al. |
| 8,593,129 | B2 | 11/2013 | Gaknoki et al. |
| 8,593,814 | B2 | 11/2013 | Ji |
| D694,925 | S | 12/2013 | Fukasawa |
| 8,598,809 | B2 | 12/2013 | Negley et al. |
| 8,602,591 | B2 | 12/2013 | Lee |
| 8,610,364 | B2 | 12/2013 | Melanson et al. |
| 8,610,365 | B2 | 12/2013 | King et al. |
| 8,611,106 | B2 | 12/2013 | Fang |
| 8,616,724 | B2 | 12/2013 | Pickard |
| 8,624,505 | B2 | 1/2014 | Huang |
| 8,632,225 | B2 | 1/2014 | Koo et al. |
| D699,179 | S | 2/2014 | Alexander |
| 8,643,038 | B2 | 2/2014 | Collins |
| 8,646,944 | B2 | 2/2014 | Villard |
| 8,646,949 | B2 | 2/2014 | Brunt |
| 8,651,685 | B2 | 2/2014 | Roberts et al. |
| 8,652,357 | B2 | 2/2014 | Ryu |
| 8,653,750 | B2 | 2/2014 | Deurenberg et al. |
| 8,657,479 | B2 | 2/2014 | Morgan et al. |
| D700,728 | S | 3/2014 | Fukasawa |
| 8,672,519 | B2 | 3/2014 | Schaefer et al. |
| 8,678,605 | B2 | 3/2014 | Leadford |
| 8,684,556 | B2 | 4/2014 | Negley et al. |
| 8,684,569 | B2 | 4/2014 | Pickard et al. |
| 8,690,383 | B2 | 4/2014 | Zampini, II et al. |
| 8,698,421 | B2 | 4/2014 | Ludorf |
| D704,369 | S | 5/2014 | Lindsley et al. |
| 8,723,427 | B2 | 5/2014 | Collins et al. |
| 8,740,444 | B2 | 6/2014 | Reynolds et al. |
| 8,742,684 | B2 | 6/2014 | Melanson |
| 8,749,131 | B2 | 6/2014 | Rains, Jr. |
| 8,749,173 | B1 | 6/2014 | Melanson et al. |
| 8,757,840 | B2 | 6/2014 | Pickard et al. |
| 8,760,073 | B2 | 6/2014 | Ko |
| 8,760,080 | B2 | 6/2014 | Yu |
| 8,764,225 | B2 | 7/2014 | Narendran |
| 8,777,455 | B2 | 7/2014 | Pickard et al. |
| 8,783,938 | B2 | 7/2014 | Alexander |
| 8,786,201 | B2 | 7/2014 | Hamamoto et al. |
| 8,786,210 | B2 | 7/2014 | Delucia |
| 8,786,211 | B2 | 7/2014 | Gilliom |
| 8,786,212 | B2 | 7/2014 | Terazawa |
| 8,786,213 | B2 | 7/2014 | Yang et al. |
| 8,791,642 | B2 | 7/2014 | Van De Ven |
| 8,794,792 | B1 | 8/2014 | Moghal |
| 8,796,948 | B2 | 8/2014 | Weaver |
| 8,810,227 | B2 | 8/2014 | Flaibani et al. |
| 8,814,385 | B2 | 8/2014 | Onaka et al. |
| 8,816,593 | B2 | 8/2014 | Lys et al. |
| 8,820,964 | B2 | 9/2014 | Gould |
| 8,827,476 | B2 | 9/2014 | Harbers |
| 8,836,226 | B2 | 9/2014 | Mercier et al. |
| 8,840,278 | B2 | 9/2014 | Pickard |
| 8,845,137 | B2 | 9/2014 | Van De Ven et al. |
| 8,847,515 | B2 | 9/2014 | King et al. |
| 8,853,958 | B2 | 10/2014 | Athalye et al. |
| 8,858,028 | B2 | 10/2014 | Kim |
| 8,876,322 | B2 | 11/2014 | Alexander |
| 8,882,298 | B2 | 11/2014 | Gershaw |
| 8,888,315 | B2 | 11/2014 | Edwards et al. |
| 8,888,506 | B2 | 11/2014 | Nishimura |
| 8,901,838 | B2 | 12/2014 | Akiyama et al. |

(56) References Cited

U.S. PATENT DOCUMENTS 8,905,575 B2 12/2014 Durkee et al.
8,944,642 B2 2/2015 Kuo
8,944,647 B2 2/2015 Bueeler
8,960,953 B2 2/2015 Narendran et al.
8,960,964 B2 2/2015 Weaver
D724,773 S 3/2015 Ryu
8,970,101 B2 3/2015 Sutardja
8,992,052 B2 3/2015 Cai et al.
9,010,967 B2 4/2015 Jensen
9,028,129 B2 5/2015 McCollum et al.
9,041,286 B2 5/2015 Fisher et al.
9,052,071 B2 6/2015 Hsu et al.
9,052,100 B2 6/2015 Blackstone
9,091,417 B2 7/2015 Castillo et al.
9,105,816 B2 8/2015 Narendran et al.
9,157,602 B2 10/2015 Pickard
9,164,268 B2 10/2015 Bigliatti et al.
9,166,127 B2 10/2015 Kato et al.
9,182,098 B2 11/2015 Caldwell et al.
9,184,350 B2 11/2015 Mastin et al.
9,234,638 B2 1/2016 Hussell et al.
9,307,588 B2 4/2016 Li
9,329,322 B2 5/2016 Yamada et al.
9,360,186 B2 6/2016 Choi et al.
9,388,963 B2 7/2016 Dai et al.
9,410,687 B2 8/2016 Hussell et al.
9,429,296 B2 8/2016 Randolph et al.
9,437,786 B2 9/2016 Mastin et al.
9,447,945 B2 9/2016 Narendran et al.
9,453,622 B2 9/2016 Zhang et al.
9,453,633 B2 9/2016 Kim et al.
9,557,099 B2 1/2017 Wang et al.
9,574,739 B2 2/2017 Yu et al.
9,601,670 B2 3/2017 Bhat et al.
2001/0006463 A1 7/2001 Fischer
2001/0053628 A1 12/2001 Hayakawa
2002/0046826 A1 4/2002 Kao
2002/0067613 A1 6/2002 Grove
2002/0106925 A1 8/2002 Yamagishi
2002/0117692 A1 8/2002 Lin
2003/0058658 A1 3/2003 Lee
2003/0072156 A1 4/2003 Pohlert
2003/0128543 A1 7/2003 Rekow
2003/0174517 A1 9/2003 Kiraly et al.
2003/0185005 A1 10/2003 Sommers
2003/0209963 A1 11/2003 Altgilbers
2004/0005800 A1 1/2004 Hou
2004/0090781 A1 5/2004 Yeoh
2004/0090784 A1 5/2004 Ward
2004/0212991 A1 10/2004 Galli
2004/0218372 A1 11/2004 Hamasaki
2005/0032402 A1 2/2005 Takanashi
2005/0047170 A1 3/2005 Hilburger
2005/0083698 A1 4/2005 Zampini
2005/0122713 A1 6/2005 Hutchins
2005/0130336 A1 6/2005 Collins, III
2005/0146884 A1 7/2005 Scheithauer
2005/0174780 A1 8/2005 Park
2005/0205878 A1 9/2005 Kan
2005/0242362 A1 11/2005 Shimizu
2005/0269060 A1 12/2005 Ku
2005/0270775 A1 12/2005 Harbers
2005/0286265 A1 12/2005 Zampini et al.
2006/0001381 A1 1/2006 Robinson
2006/0039156 A1 2/2006 Chen
2006/0062019 A1 3/2006 Young
2006/0076672 A1 4/2006 Petroski
2006/0141851 A1 6/2006 Matsui
2006/0146422 A1 7/2006 Koike
2006/0146531 A1 7/2006 Reo et al.
2006/0152140 A1 7/2006 Brandes
2006/0221272 A1 10/2006 Negley et al.
2006/0262544 A1 11/2006 Piepgras
2006/0262545 A1 11/2006 Piepgras
2007/0025103 A1 2/2007 Chan
2007/0064428 A1 3/2007 Beauchamp
2007/0109795 A1 3/2007 Gabrius
2007/0096057 A1 5/2007 Hampden-Smith
2007/0139923 A1 6/2007 Negley et al.
2007/0153521 A1 7/2007 Konuma
2007/0158668 A1 7/2007 Tarsa et al.
2007/0170447 A1 7/2007 Negley et al.
2007/0223219 A1 9/2007 Medendorp, Jr. et al.
2007/0238327 A1 10/2007 Hsu
2007/0242461 A1 10/2007 Reisenauer
2007/0253201 A1 11/2007 Blincoe
2007/0253202 A1 11/2007 Wu
2007/0253209 A1 11/2007 Loh et al.
2007/0268698 A1 11/2007 Chen et al.
2007/0269915 A1 11/2007 Leong et al.
2007/0275576 A1 11/2007 Yang
2007/0285028 A1 12/2007 Tsinker et al.
2007/0295969 A1 12/2007 Chew et al.
2007/0297177 A1 12/2007 Wang
2008/0012036 A1 1/2008 Loh et al.
2008/0013316 A1 1/2008 Chiang
2008/0030993 A1 2/2008 Narendran
2008/0042153 A1 2/2008 Beeson et al.
2008/0043470 A1 2/2008 Wimberly
2008/0076272 A1 3/2008 Hsu
2008/0080190 A1 4/2008 Walczak
2008/0084700 A1 4/2008 Van De Ven
2008/0106907 A1 5/2008 Trott
2008/0112121 A1 5/2008 Cheng
2008/0117500 A1 5/2008 Narendran
2008/0121921 A1 5/2008 Loh et al.
2008/0130275 A1 6/2008 Higley
2008/0142194 A1 6/2008 Zhou
2008/0157112 A1 7/2008 He
2008/0158881 A1 7/2008 Liu
2008/0158887 A1 7/2008 Zhu
2008/0165530 A1 7/2008 Hendrikus
2008/0170413 A1 7/2008 Beeson et al.
2008/0173884 A1 7/2008 Chitnis et al.
2008/0179611 A1 7/2008 Chitnis et al.
2008/0182353 A1 7/2008 Zimmerman et al.
2008/0192478 A1 8/2008 Chen
2008/0198112 A1 8/2008 Roberts
2008/0219002 A1 9/2008 Sommers et al.
2008/0219303 A1 9/2008 Chen et al.
2008/0224598 A1 9/2008 Baretz
2008/0224631 A1 9/2008 Melanson
2008/0247172 A1 10/2008 Beeson et al.
2008/0274641 A1 11/2008 Weber
2008/0298058 A1 12/2008 Kan et al.
2008/0308825 A1 12/2008 Chakraborty et al.
2009/0021936 A1 1/2009 Stimac et al.
2009/0026913 A1 1/2009 Mrakovich
2009/0034283 A1 2/2009 Albright
2009/0046464 A1 2/2009 Liu
2009/0050907 A1 2/2009 Yuan et al.
2009/0050908 A1 2/2009 Yuan et al.
2009/0052158 A1 2/2009 Bierhuizen
2009/0073683 A1 3/2009 Chen et al.
2009/0080185 A1 3/2009 McMillan
2009/0086474 A1 4/2009 Chou
2009/0091935 A1 4/2009 Tsai
2009/0103299 A1 4/2009 Boyer et al.
2009/0129084 A1 5/2009 Tsao
2009/0140272 A1 6/2009 Beeson et al.
2009/0141500 A1 6/2009 Peng
2009/0154166 A1 6/2009 Zhang
2009/0167203 A1 7/2009 Dahlman et al.
2009/0180276 A1 7/2009 Benitez
2009/0184616 A1 7/2009 Van De Ven et al.
2009/0195168 A1 8/2009 Greenfeld
2009/0225551 A1 9/2009 Chang et al.
2009/0236997 A1 9/2009 Liu
2009/0294114 A1 12/2009 Yang
2009/0296388 A1 12/2009 Wu et al.
2009/0310354 A1 12/2009 Zampini, II et al.
2009/0317988 A1 12/2009 Lin
2010/0015821 A1 1/2010 Hsu
2010/0019697 A1 1/2010 Korsunsky

(56) References Cited

U.S. PATENT DOCUMENTS

2010/0026158 A1 2/2010 Wu
2010/0027258 A1 2/2010 Maxik
2010/0046234 A1 2/2010 Abu-Ageel
2010/0060202 A1 3/2010 Melanson et al.
2010/0072505 A1 3/2010 Gingrich, III
2010/0073783 A1 3/2010 Sun
2010/0073884 A1 3/2010 Peloza
2010/0091487 A1 4/2010 Shin
2010/0091497 A1 4/2010 Chen
2010/0102696 A1 4/2010 Sun
2010/0110684 A1 5/2010 Abdelsamed et al.
2010/0110728 A1 5/2010 Dubrow
2010/0128484 A1 5/2010 Peng
2010/0132918 A1 6/2010 Lin
2010/0141173 A1 6/2010 Negrete
2010/0142189 A1 6/2010 Hong
2010/0149818 A1 6/2010 Ruffin
2010/0157605 A1 6/2010 Chang
2010/0174345 A1 7/2010 Ashdown
2010/0195323 A1 8/2010 Schaefer et al.
2010/0230709 A1 9/2010 Kanno
2010/0238630 A1 9/2010 Xu
2010/0243219 A1 9/2010 Yang
2010/0246179 A1 9/2010 Long
2010/0260945 A1 10/2010 Kites
2010/0284181 A1 11/2010 O'Brien et al.
2010/0296289 A1 11/2010 Villard et al.
2010/0301360 A1 12/2010 Van De Ven
2010/0301774 A1 12/2010 Chemel et al.
2010/0308361 A1 12/2010 Beeson et al.
2010/0308742 A1 12/2010 Melanson
2010/0319953 A1 12/2010 Yochum
2011/0013397 A1 1/2011 Catone et al.
2011/0043129 A1 2/2011 Koolen
2011/0044046 A1 2/2011 Abu-Ageel
2011/0049749 A1 3/2011 Bailey
2011/0050100 A1 3/2011 Bailey
2011/0050101 A1 3/2011 Bailey
2011/0050124 A1 3/2011 Bailey
2011/0051407 A1 3/2011 St. Ives et al.
2011/0051414 A1 3/2011 Bailey
2011/0090684 A1 4/2011 Logan et al.
2011/0097921 A1 4/2011 Hsu
2011/0103070 A1 5/2011 Zhang et al.
2011/0115381 A1 5/2011 Carlin
2011/0122643 A1 5/2011 Spork
2011/0134634 A1 6/2011 Gingrich, III
2011/0136374 A1 6/2011 Mostoller
2011/0140620 A1 6/2011 Lin et al.
2011/0180841 A1 7/2011 Chang
2011/0193490 A1 8/2011 Kumar
2011/0210360 A1 9/2011 Negley
2011/0215707 A1 9/2011 Brunt, Jr.
2011/0222270 A1 9/2011 Porciatti
2011/0222277 A1 9/2011 Negley
2011/0253358 A1 10/2011 Huang
2011/0255287 A1 10/2011 Li
2011/0273079 A1 11/2011 Pickard
2011/0279015 A1 11/2011 Negley
2011/0285308 A1 11/2011 Crystal
2011/0285314 A1 11/2011 Carney et al.
2011/0292483 A1 12/2011 Pakhchyan et al.
2011/0306219 A1 12/2011 Swanger
2011/0309773 A1 12/2011 Beers
2011/0316441 A1 12/2011 Huynh
2011/0316446 A1 12/2011 Kang et al.
2012/0002417 A1 1/2012 Li
2012/0014115 A1 1/2012 Park et al.
2012/0018754 A1 1/2012 Lowes
2012/0019127 A1 1/2012 Hirosaki
2012/0021623 A1 1/2012 Gorman
2012/0025729 A1 2/2012 Melanson et al.
2012/0038280 A1 2/2012 Zoorob et al.
2012/0038291 A1 2/2012 Hasnain
2012/0051041 A1 3/2012 Edmond et al.
2012/0051048 A1 3/2012 Smit
2012/0051056 A1 3/2012 Derks
2012/0051068 A1 3/2012 Pelton
2012/0086028 A1 4/2012 Beeson et al.
2012/0092860 A1 4/2012 Blackstone
2012/0106152 A1 5/2012 Zheng
2012/0112661 A1 5/2012 Van De Ven
2012/0119658 A1 5/2012 McDaniel
2012/0140468 A1 6/2012 Chang
2012/0140474 A1 6/2012 Jurik et al.
2012/0146519 A1 6/2012 Briggs
2012/0169242 A1 7/2012 Olson
2012/0175653 A1 7/2012 Weber
2012/0187830 A1 7/2012 Shum
2012/0218624 A1 8/2012 Narendran et al.
2012/0223657 A1 9/2012 Van De Ven
2012/0224177 A1 9/2012 Harbers et al.
2012/0236553 A1 9/2012 Cash
2012/0250309 A1 10/2012 Handsaker
2012/0268894 A1 10/2012 Alexander
2012/0280264 A1 11/2012 Beeson et al.
2012/0286304 A1 11/2012 Letoquin
2012/0286319 A1 11/2012 Lee
2012/0287642 A1 11/2012 Zeng
2012/0292660 A1 11/2012 Kanno
2012/0307487 A1 12/2012 Eckel
2012/0307494 A1 12/2012 Zlotnikov et al.
2012/0313124 A1 12/2012 Clatterbuck
2012/0327650 A1 12/2012 Lay et al.
2013/0002167 A1 1/2013 Van De Ven
2013/0003370 A1 1/2013 Watanabe
2013/0003388 A1 1/2013 Jensen
2013/0026942 A1 1/2013 Ryan
2013/0042510 A1 2/2013 Nall et al.
2013/0049602 A1 2/2013 Raj
2013/0049603 A1 2/2013 Bradford
2013/0049627 A1 2/2013 Roberts
2013/0069561 A1 3/2013 Melanson et al.
2013/0070441 A1 3/2013 Moon
2013/0070442 A1 3/2013 Negley
2013/0082612 A1 4/2013 Kim
2013/0083510 A1 4/2013 Park
2013/0094225 A1 4/2013 Leichner
2013/0095673 A1 4/2013 Brandon
2013/0140490 A1 6/2013 Fujinaga
2013/0162140 A1 6/2013 Shamoto et al.
2013/0170220 A1 7/2013 Bueeler
2013/0170221 A1 7/2013 Isogai
2013/0176728 A1 7/2013 Bizzotto et al.
2013/0193869 A1 8/2013 Hong et al.
2013/0221489 A1 8/2013 Cao et al.
2013/0229114 A1 9/2013 Eisele et al.
2013/0229804 A1 9/2013 Holder et al.
2013/0235555 A1 9/2013 Tanaka
2013/0235579 A1 9/2013 Smith
2013/0235580 A1 9/2013 Smith
2013/0241392 A1 9/2013 Pickard et al.
2013/0241440 A1 9/2013 Gaknoki et al.
2013/0249434 A1 9/2013 Medendorp
2013/0250573 A1 9/2013 Taskar et al.
2013/0250581 A1 9/2013 Tang et al.
2013/0258636 A1 10/2013 Rettke
2013/0265777 A1 10/2013 Zollers et al.
2013/0277643 A1* 10/2013 Williamson ..... H01L 27/156
257/13
2013/0300303 A1 11/2013 Liu
2013/0301252 A1 11/2013 Hussell et al.
2013/0322072 A1 12/2013 Pu et al.
2014/0015419 A1 1/2014 Shah et al.
2014/0016318 A1 1/2014 Pokrajac
2014/0036510 A1 2/2014 Preston et al.
2014/0043813 A1 2/2014 Dube' et al.
2014/0048743 A1 2/2014 Le-Mercier
2014/0049241 A1 2/2014 Gaknoki et al.
2014/0049962 A1 2/2014 Holder et al.
2014/0055038 A1 2/2014 Cappitelli et al.
2014/0055054 A1 2/2014 Borkar et al.
2014/0062330 A1 3/2014 Neundorfer
2014/0063779 A1 3/2014 Bradford

(56) References Cited

U.S. PATENT DOCUMENTS

| | | | |
|---|---|---|---|
| 2014/0071685 | A1 | 3/2014 | Black et al. |
| 2014/0071696 | A1 | 3/2014 | Park, II et al. |
| 2014/0078715 | A1 | 3/2014 | Pickard et al. |
| 2014/0078722 | A1 | 3/2014 | Caldwell |
| 2014/0078746 | A1 | 3/2014 | Caldwell |
| 2014/0103796 | A1 | 4/2014 | Jansen |
| 2014/0126205 | A1 | 5/2014 | Davis et al. |
| 2014/0126224 | A1 | 5/2014 | Brunt, Jr. |
| 2014/0134880 | A1 | 5/2014 | Yen |
| 2014/0140052 | A1 | 5/2014 | Villard |
| 2014/0159077 | A1 | 6/2014 | Kuenzler |
| 2014/0159600 | A1 | 6/2014 | Sutardja |
| 2014/0167601 | A1 | 6/2014 | Harry |
| 2014/0167646 | A1 | 6/2014 | Zukauskas et al. |
| 2014/0175966 | A1 | 6/2014 | Tan |
| 2014/0176016 | A1 | 6/2014 | Li |
| 2014/0198531 | A1 | 7/2014 | Iwasaki |
| 2014/0217433 | A1 | 8/2014 | Tudorica |
| 2014/0217443 | A1 | 8/2014 | Heikman et al. |
| 2014/0217907 | A1 | 8/2014 | Harris |
| 2014/0218909 | A1 | 8/2014 | Tetsuo et al. |
| 2014/0225132 | A1 | 8/2014 | Livesay et al. |
| 2014/0225511 | A1 | 8/2014 | Pickard et al. |
| 2014/0225532 | A1 | 8/2014 | Groeneveld |
| 2014/0233193 | A1 | 8/2014 | Alexander |
| 2014/0268631 | A1 | 9/2014 | Pickard |
| 2014/0268724 | A1 | 9/2014 | Yanping |
| 2014/0268737 | A1 | 9/2014 | Athalye et al. |
| 2014/0286016 | A1 | 9/2014 | Montagne |
| 2014/0286018 | A1 | 9/2014 | Zhang et al. |
| 2014/0361701 | A1 | 12/2014 | Siessegger et al. |
| 2014/0362563 | A1 | 12/2014 | Zimmerman et al. |
| 2014/0367633 | A1 | 12/2014 | Bibl |
| 2015/0002034 | A1 | 1/2015 | Van De Ven |
| 2015/0029717 | A1 | 1/2015 | Shen et al. |
| 2015/0036339 | A1 | 2/2015 | Ashdown et al. |
| 2015/0043218 | A1 | 2/2015 | Hu |
| 2015/0060922 | A1 | 3/2015 | Wilcox |
| 2015/0176776 | A1 | 6/2015 | Pelka et al. |
| 2015/0204509 | A1 | 7/2015 | Pelka et al. |
| 2015/0211723 | A1 | 7/2015 | Athalye |
| 2015/0236225 | A1 | 8/2015 | David |
| 2015/0241024 | A1 | 8/2015 | Smith et al. |
| 2015/0252982 | A1 | 9/2015 | Demuynck et al. |
| 2015/0260905 | A1 | 9/2015 | Yuan et al. |
| 2015/0276146 | A1 | 10/2015 | Wu et al. |
| 2015/0295144 | A1 | 10/2015 | Weiler |
| 2015/0325754 | A1 | 11/2015 | Narendran et al. |
| 2015/0338056 | A1 | 11/2015 | Pelka et al. |
| 2015/0338057 | A1 | 11/2015 | Kim et al. |
| 2016/0025296 | A1 | 1/2016 | Bigliatti et al. |
| 2016/0033108 | A1 | 2/2016 | Ji et al. |
| 2016/0109096 | A1 | 4/2016 | Park et al. |
| 2016/0174319 | A1 | 6/2016 | Li |
| 2016/0195238 | A1 | 7/2016 | Han et al. |
| 2016/0216561 | A1 | 7/2016 | Lee et al. |
| 2016/0252233 | A1 | 9/2016 | Han et al. |
| 2016/0320002 | A1 | 11/2016 | Tai et al. |
| 2016/0334079 | A1 | 11/2016 | Donnini |
| 2017/0002994 | A1 | 1/2017 | Fisher et al. |
| 2017/0003000 | A1 | 1/2017 | Narendran et al. |
| 2017/0009957 | A1 | 1/2017 | Lim et al. |
| 2017/0084802 | A1 | 3/2017 | Chiu |
| 2017/0114979 | A1 | 4/2017 | Kang et al. |
| 2017/0159896 | A1 | 6/2017 | Tran et al. |

FOREIGN PATENT DOCUMENTS

| | | | |
|---|---|---|---|
| CN | 201739849 | A | 2/2011 |
| CN | 202040752 | A | 11/2011 |
| CN | 102269351 | A | 12/2011 |
| GB | 2457016 | A | 8/2009 |
| JP | 61-070306 | U | 5/1986 |
| JP | 2003-092022 | A | 3/2003 |
| JP | 2004-179048 | A | 6/2004 |
| JP | 2004-265626 | A | 9/2004 |
| JP | 2005-017554 | A | 1/2005 |
| JP | 2005-071818 | A | 3/2005 |
| JP | 2005-235778 | A | 9/2005 |
| JP | 2005-267964 | A | 9/2005 |
| JP | 2006-236796 | A | 9/2006 |
| JP | 2006-253274 | A | 9/2006 |
| JP | 2006-310138 | A | 11/2006 |
| JP | D1307268 | B | 8/2007 |
| JP | D1307434 | B | 8/2007 |
| JP | 2007-273205 | A | 10/2007 |
| JP | 2007-273209 | A | 10/2007 |
| JP | 2011-508406 | A | 3/2011 |
| JP | 2011-204495 | A | 10/2011 |
| JP | 2011-204658 | A | 10/2011 |
| KR | 1020070039683 | A | 4/2007 |
| KR | 1020090013704 | A | 2/2009 |
| KR | 100974942 | B1 | 8/2010 |
| KR | 1020120050280 | A | 5/2012 |
| TW | 2004-25542 | A | 11/2004 |
| TW | 290967 | M | 5/2006 |
| TW | 296481 | M | 8/2006 |
| TW | 1273858 | B | 2/2007 |
| TW | 1318461 | B | 12/2009 |
| WO | DM/057383 | B | 9/2001 |
| WO | 2002/012788 | A1 | 2/2002 |
| WO | 2002/015281 | A2 | 2/2002 |
| WO | 2004/071143 | A1 | 8/2004 |
| WO | 2005/093862 | A2 | 10/2005 |
| WO | 2006/066531 | A1 | 6/2006 |
| WO | 2006066531 | A1 | 6/2006 |
| WO | 2007/128070 | A1 | 11/2007 |
| WO | 2008/108832 | A1 | 9/2008 |
| WO | 2009/044330 | A1 | 4/2009 |
| WO | 2009108799 | A1 | 9/2009 |
| WO | 2009/120555 | A1 | 10/2009 |
| WO | 2010/016002 | A1 | 2/2010 |
| WO | 2010059647 | A1 | 5/2010 |
| WO | 2011019945 | A1 | 2/2011 |
| WO | 2013059298 | A1 | 4/2013 |
| WO | 2013192014 | A2 | 12/2013 |
| WO | 2013192014 | A3 | 12/2013 |
| WO | 2014099681 | A2 | 6/2014 |
| WO | 2014099681 | A3 | 12/2014 |

OTHER PUBLICATIONS

"NNCrystal—blog post—May 17, 2010," downloaded from http://led-lights-led.blogspot.com/2010/05/nncrystal-us-corporation-to-supply.html, 4pp.

Knight, Colette, "Xicato—Investigations on the use of LED modules for optimized color appearance in retail applications," downloaded on May 28, 2014 from http://www.xicato.com/sites/default/files/documents/Summary_Investigations_on_the_use_of LED_modules_for_optimized_color_appearance_in_retail_applications.pdf, 6pp.

"Zumtobel—IYON Tunable White,", downloaded on Oct. 19, 2015 from http://www.zumtobel.com/tunablewhite/en/index.html#topic_04, 1p.

"Zumtobel—IYON LED Spotlight Catalog," downloaded on Oct. 19, 2015 from http://www.zumtobel.com/PDB/Ressource/teaser/en/com/Iyon.pdf, 40pp.

"Lumenpulse—Lumenbeam Large Pendant Dynamic White," downloaded on May 28, 2014 from http://www.lumenpulse.com/en/product/72/lumenbeam-large-pendant-dynamic-white, 1p.

"Lumileds Application Brief AB08—Optical Testing for SuperFlux, SnapLED and Luxeon Emitters," downloaded on Sep. 24, 2014 from www.lumileds.com, 15pp.

"Lumileds Luxeon Z,", downloaded on May 2, 2015 from www.lumileds.com, 2pp.

"A Warmer, Cozier White Light: NXP Transforms LED Color Quality," dated Jan. 9, 2013, downloaded from http://www.nxp.com/news/press-releases/2013/01/a-warmer-cozier-white-light-nxp-transforms-led-color-quality.html, 2pp.

"Philips Lighting—Dim Tone,", downloaded on May 27, 2014 from www.usa.lighting.philips.com/lightcommunity/trends/led/dimtone/, 1p.

(56) References Cited

OTHER PUBLICATIONS

"Philips—Dimmable to warm light for the perfect ambience," downloaded on May 27, 2014 from www.usa.lighting.philips.com, 2pp.
"Philips—Turn up Ambience and Tone Down Energy Use with Philips BR30 DimTone," downloaded on May 27, 2014 from www.usa.lighting.philips.com, 11pp.
Wikipedia, "Planckian locus," downloaded on May 30, 2014 from www.wikipedia.org, 5pp.
Wikipedia, "Quantum dot,", downloaded on May 30, 2014 from http://en.wikipedia.org/wiki/Quantum.dot, 15pp.
"Phosphortech—Flexible Phosphor Sheet—RadiantFlex Datasheet," Aug. 2014, downloaded from www.phosphortech.com, 10pp.
"Refraction by lenses," downloaded on Feb. 17, 2015 from www.physicsclassroom.com, 5pp.
"RTLED—White Paper: Binning and LED," downloaded on Oct. 13, 2014 from www.rtled.com, 3pp.
Near, Al, "Seeing Beyond CRI," LED Testing & Application, Nov. 2011, downloaded from www.ies.org/lda/hottopics/led/4.pdf, 2pp.
"Selux—Olivio luminaire," press release dated Mar. 26, 2014, downloaded from http://www.selux.com/be/en/news/press/press-detail/article/evolutionary-progress-the-olivio-family-of-system-luminaires-now-with-premium-quality-white-and.html, 3pp.
"LEDIL—Strada-F Series," downloaded on May 5, 2015 from www.ledil.com, 7pp.
"Sylvania—Ultra SE(tm) LED Lamp Family," downloaded on May 27, 2014 from www. sylvania.com, 3pp.
"Sylvania Ultra SE(tm) LED Light Bulbs with Color Dimming Sunset Effects," downloaded on May 27, 2014 from https://www.youtube.com/watch?v=oZEc-VfJ8EU, 2pp.
"USAI Lighting Catalog," downloaded on May 27, 2014 from http://www.usaillumination.com/pdf/Warm_Glow_Dimming.pdf, 50pp.
"Winona—Parata 700 Series Cove," downloaded on May 28, 2014 from www.acuitybrands.com, 2pp.
"Winona Parata Catalog," downloaded on May 28, 2014 from www.acuitybrands.com, 24pp.
PCT/US2016/030613, Ecosense Lighting Inc., International Search Report and Opinion dated Aug. 5, 2016.
PCT/US2016/046245, Ecosense Lighting Inc., Filed on Aug. 10, 2016.
PCT/US2016/015470, Ecosense Lighting Inc., International Search Report and Opinion dated Jul. 8, 2016.
PCT/US2016/015385, Ecosense Lighting Inc., International Search Report and Opinion dated Apr. 8, 2016.
PCT/US2016/015402, Ecosense Lighting Inc., International Search Report and Opinion dated Apr. 22, 2016.
PCT/US2016/015435, Ecosense Lighting Inc., International Search Report and Opinion dated Mar. 31, 2016.
PCT/US2016/015437, Ecosense Lighting Inc., International Search Report and Opinion dated Mar. 31, 2016.
PCT/US2016/015441, Ecosense Lighting Inc., International Search Report and Opinion dated Mar. 31, 2016.
Petluri et al., U.S. Appl. No. 14/526,504, filed Oct. 28, 2014, entitled "Lighting Systems Having Multiple Light Sources," 92pp.
Petluri et al., U.S. Appl. No. 14/636,204, filed Mar. 3, 2015, entitled "Lighting Systems Including Lens Modules for Selectable Light Distribution," 119pp.
Fletcher et al., U.S. Appl. No. 29/533,667, filed Jul. 20, 2015, entitled "LED Luminaire Having a Mounting System," 10pp.
Rodgers et al., U.S. Appl. No. 14/702,800, filed May 4, 2015, entitled "Lighting Systems Including Asymmetric Lens Modules for Selectable Light Distribution," 116pp.
Pickard et al., U.S. Appl. No. 14/636,205, filed Mar. 3, 2015, entitled "Low-Profile Lighting System Having Pivotable Lighting Enclosure," 56pp.
Fletcher et al., U.S. Appl. No. 14/702,765, filed May 4, 2015, entitled "Lighting System Having a Sealing System," 92pp.
Fletcher et al., U.S. Appl. No. 29/519,149, filed Mar. 3, 2015, entitled "LED Luminaire," 8pp.
Fletcher et al., U.S. Appl. No. 29/519,153, filed Mar. 3, 2015, entitled "LED Luminaire," 8pp.
Fletcher et al., U.S. Appl. No. 14/816,827, filed Aug. 3, 2015, entitled "Lighting System Having a Mounting Device," 126pp.
Rodgers et al., U.S. Appl. No. 62/202,936, filed Aug. 10, 2015, entitled "Optical Devices and Systems Having a Converging Lens With Grooves," 133pp.
Fletcher et al., U.S. Appl. No. 29/532,383, filed Jul. 6, 2015, entitled "LED Luminaire Having a Mounting System," 10pp.
Fletcher et al., U.S. Appl. No. 29/533,635, filed Jul. 20, 2015, entitled "LED Luminaire Having a Mounting System," 10pp.
Fletcher et al., U.S. Appl. No. 29/533,666, filed Jul. 20, 2015, entitled "LED Luminaire Having a Mounting System," 10pp.
Acuity Brands, "Acuity Brands Introduces Luminaire for Tunable White Technology," downloaded from http://news.acuitybrands.com/US/acuity-brands-introduces-luminaires-with-tunable-white-technology/s/54ae242f-1222-4b8b-be0d-36637bde8cd2 on May 28, 2014, 2pp.
Acuity Brands Lighting Inc. Product Catalog, downloaded from www.acuitybrands.com, dated Apr. 2013, 90pp.
Acuity Brands, "A Guided Tour of Area Light Sources—Past, Present and Future," downloaded from www.acuitybrands.com, version dated Jun. 20, 2013, 72pp.
Alanod GmbH, "WhiteOptics," downloaded from www.alanod.com, dated Apr. 2014, 12pp.
Altman Lighting, "Spectra Cube," downloaded from http://altmanstagelighting.com/altman-led-green-lighting/led-spectra-cube/Altman-Spectra-Cube-Data-Sheet-v3.pdf on May 28, 2014, 1p.
Bega Lighting, "In-ground luminaire RGBW IP 67 Product data sheet," downloaded from http://www.bega.com/download/datenblaetter/en/7926.pdf on May 28, 2014, 1p.
CORM 2011 Conference, Gaithersburg, MD, "Calculation of CCT and Duv and Practical Conversion Formulae," dated May 3-5, 2011, National Institute of Standards and Technology, 28pp.
Lumitronix, "Carclo lens for side emitting 360 degrees," downloaded from http://www.leds.de/en/High-Power-LEDs/Lenses-and-optics/Carclo-lens-for-side-emitting-360.html on May 28, 2014, 2pp.
"Introduction to Catmull-Rom Splines," downloaded on Aug. 7, 2015 from www.mvps.org/directx/articles/catmull/, 2pp.
Wikipedia, "CIE 1931 color space," version dated Apr. 23, 2014, downloaded from www.wikipedia.org, 12pp.
Osram Sylvania, "ColorCalculator User Guide", downloaded on Jun. 3, 2014 from www.sylvania.com, 44pp.
Osram Sylvania, "ColorCalculator User Guide", downloaded on Oct. 19, 2015 from www.sylvania.com, 50pp.
Philips Color Kinetics, "IntelliWhite LED Lighting Systems," downloaded on May 28, 2014 from http://www.colorkinetics.com/ls/intelliwhite/, 2pp.
Philips Color Kinetics, "Color-Changing LED Lighting Systems," downloaded on May 27, 2014 from http://www.colorkinetics.com/ls/rgb/, 2pp.
"Ecosense to reveal new TROV LED Linear Platform at 2015 Lighffair International in New York City," May 4, 2015, blog downloaded from www.ecosense.com, 3pp.
Freyssinier, Jean P. et al., "Class A Color Designation for Light Sources Used in General Illumination," J. Light & Vis. Env., vol. 37, Nos. 2-3, Nov. 7, 2013, pp. 10-14.
Freyssinier, Jean P. et al., "White Lighting: A Provisional Model for Predicting Perceived Tint in 'White' Illumination," Color Res. & App'n, vol. 39, No. 5, Oct. 2014, pp. 466-479.
Rea et al., "White lighting for residential applications," Lighting Res. Technol., Mar. 27, 2012, downloaded from www.sagepublications.com at http://lrt.sagepub.com/content/early/2012/03/27/1477153512442936, 15pp.
"KKDC Catalog 2.0," downloaded on May 28, 2014 from http://www.kkdc.co.uk/media/kkdc-catalogue.pdf, 134pp.
"KKDC UK—Linear LED Lighting," downloaded from www.kkdc.co.uk/application/interior.php on Oct. 22, 2015, 6pp.

(56) References Cited

OTHER PUBLICATIONS

"LEDnovation—BR30 Warm Dimming," downloaded on May 28, 2014 from www.lednovation.com/products/BR30_LED.asp, 2pp.
"Lightolier—Solid-State Lighting," downloaded on May 28, 2014 from http://www.lightolier.com/prospots/leds_solidstate.jsp, 1p.
PCT/US2007/023110, Journee Lighting Inc., International Preliminary Report on Patentability dated Sep. 8, 2009.
PCT/US2009/035321, Journee Lighting Inc., International Preliminary Report on Patentability dated Aug. 31, 2010.
PCT/US2009/064858, Journee Lighting Inc., International Preliminary Report on Patentability dated May 24, 2011.
PCT/US2010/045361, Journee Lighting Inc., International Preliminary Report on Patentability dated Feb. 14, 2012.
PCT/US2012/060588, Ecosense Lighting Inc., Filed on Oct. 17, 2012.
PCT/US2012/060588, Ecosense Lighting Inc., International Search Report and Opinion dated Mar. 29, 2013.
PCT/US2012/060588, Ecosense Lighting Inc., International Preliminary Report on Patentability dated Apr. 22, 2014.
PCT/US2013/045708, Journee Lighting Inc., International Search Report and Opinion dated Nov. 27, 2013.
PCT/US2013/045708, Journee Lighting Inc., International Preliminary Report on Patentability dated May 12, 2015.
PCT/US2013/075172, Ecosense Lighting Inc., Filed on Dec. 13, 2013.
PCT/US2013/075172, Ecosense Lighting Inc., International Search Report and Opinion dated Sep. 26, 2014.
PCT/US2013/075172, Ecosense Lighting Inc., International Preliminary Report on Patentability dated Jun. 23, 2015.
PCT/US2016/020521, Ecosense Lighting Inc., Filed on Mar. 2, 2016.
PCT/US2016/020521, Ecosense Lighting Inc., International Search Report and Opinion dated May 3, 2016.
PCT/US2016/030613, Ecosense Lighting Inc., Filed on May 3, 2016.
PCT/US2016/020523, Ecosense Lighting Inc., Filed on Mar. 2, 2016.
PCT/US2016/020523, Ecosense Lighting Inc., International Search Report and Opinion dated May 6, 2016.
PCT/US2016/015470, Ecosense Lighting Inc., Filed on Jan. 28, 2016, Entitled "Zoned Optical Cup."
Petluri et al., U.S. Appl. No. 62/288,368, filed Jan. 28, 2016, entitled "Multizone Mixing Cup".
PCT/US2016/015473, Ecosense Lighting Inc., Filed on Jan. 28, 2016, Entitled "Illuminating With a Multizone Mixing Cup."
PCT/US2016/015473, Ecosense Lighting Inc., International Search Report and Opinion dated Apr. 22, 2016.
Petluri et al., U.S. Appl. No. 15/170,806, filed Jun. 1, 2016, entitled "Illuminating With a Multizone Mixing Cup."
PCT/US2016/015318, Ecosense Lighting Inc., Filed on Jan. 28, 2016, Entitled "Compositions for LED Light Conversions."
PCT/US2016/015318, Ecosense Lighting Inc., International Search Report and Opinion, dated Apr. 11, 2016.
PCT/US2016/015348, Ecosense Lighting Inc., Filed on Jan. 28, 2016, Entitled "Systems for Providing Tunable White Light With High Color Rendering."
PCT/US2016/015348, Ecosense Lighting Inc., International Search Report and Opinion dated Apr. 11, 2016.
PCT/US2016/015368, Ecosense Lighting Inc., Filed on Jan. 28, 2016, Entitled "Systems for Providing Tunable White Light With High Color Rendering."
PCT/US2016/015368, Ecosense Lighting Inc., International Search Report and Opinion dated Apr. 19, 2016.
Petluri et al., U.S. Appl. No. 15/173,538, filed Jun. 3, 2016, entitled "System for Providing Tunable White Light With High Color Rendering."
Petluri et al., U.S. Appl. No. 15/173,554, filed Jun. 3, 2016, entitled "System for Providing Tunable White Light With High Color Rendering."
PCT/US2016/015385, Ecosense Lighting Inc., Filed on Jan. 28, 2016, Entitled "Methods for Generating Tunable White Light With High Color Rendering."
PCT/US2016/015402, Ecosense Lighting Inc., Filed on Jan. 28, 2016, Entitled "Methods for Generating Tunable White Light With High Color Rendering."
PCT/US2016/015435, Ecosense Lighting Inc., Filed on Jan. 28, 2016, Entitled "Methods for Generating Melatonin-Response-Tuned White Light With High Color Rendering."
PCT/US2016/015437, Ecosense Lighting Inc., Filed on Jan. 28, 2016, Entitled "Methods for Generating Melatonin-Response-Tuned White Light With High Color Rendering."
PCT/US2016/015441, Ecosense Lighting Inc., Filed on Jan. 28, 2016, Entitled "Methods for Generating Melatonin-Response-Tuned White Light With High Color Rendering."
Petluri et al., U.S. Appl. No. 15/176,083, filed Jun. 7, 2016, entitled "Compositions for LED Light Conversions."
"Optagon Targetti—Shopping Like You've Never Seen Before," downloaded on Mar. 28, 2017 from: https://download.architonic.com/pdf/310/0370/targetti-optagon-en.pdf; 12 pages.
"Targetti Company Profile", 2016, downloaded from http://www.targetti.com/media/files/catalogue-brochure/T_Company_2016_EN.pdf; 37 pages.
PCT/US2016/016972, Ecosense Lighting Inc., International Preliminary Report on Patentability, dated Aug. 24, 2017, 9pp.
Kahen, Keith, "High-Efficiency Colloidal Quantum Dot Phosphors," University at Buffalo, SUNY, DOE SSL R&D Workshop, Long Beach, California, Jan. 29-31, 2013, 12pp.
Freyssinier, Jean P. et al., "Class A Lighting," Rensselaer Polytechnic Institute, Strategies in Light 2012, 27 pp.
Oh, Jeong et al., "Full down-conversion of amber-emitting phosphor-converted light-emitting diodes with powder phosphors and a long-wave pass filter," Optics Express, vol. 18, No. 11, May 24, 2010, pp. 11063-11072.
"Microcellular Reflective Sheet MCPET," downloaded on Feb. 3, 2015 from www.furukawa.co.jp/foam/, 6pp.
Overton, Gail, "LEDS: White LED comprises blue LED and inexpensive dye," LaserFocusWorld, Feb. 12, 2013, Downloaded from http://www.laserfocusworld.com/articles/print/volume-49/issue-02/world-news/leds--white-led-comprises-blue-led-and-inexpensive-dye.html, 5pp.
"LEDIL TIR Lens Guide," downloaded from www.ledil.com on Jan. 22, 2015, 8pp.
Knight, Colette, "XICATO—Investigations on the use of LED modules for optimized color appearance in retail applications," downloaded on May 28, 2014 from http://www.xicato.com/sites/default/files/documents/Summary_investigations_on_the_use_of LED_modules_for_optimized_color_appearance_in_retail_applications.pdf, 5pp.
"CandlePowerForums—SOLD: Luxeon III side-emitter white LED," downloaded on May 28, 2014 from http://www.candlepowerforums.com/vb/showthread.php?140276-SOLD-Luxeon-III-side-emitter-white-LED, 4pp.
"Alanod MIRO Catalog," downloaded on Jan. 30, 2015 from www.alanod.com, 8pp.
"Nanoco Group—Cadmium Free Quantum Dots," downloaded on May 30, 2014 from www.nanocotechnologies.com/what-we-do/products/cadmium-free-quantum-dots, 3pp.
"Nanosys—Quantum Dots," downloaded on May 30, 2014 from www.nanosysinc.com/what-we-do/quantum-dots/, 3pp.
"Ocean NanoTech—Products," downloaded on May 30, 2014 from www.oceannanotech.com/Products.php, 1p.
"NNCrystal—blog post—May 17, 2010," downloaded from http://led-lights-led.blogspot.c,om/2010/05/nncrystal-us-corporation-to-supply.html, 4pp.
"Lighting Global Technical Notes, Optical Control Techniques for Off-grid Lighting Products," Jul. 2011 and May 2012, 6pp.
"Pacific Light Technologies—Quantum Dots in Solid State Lighting," downloaded on Oct. 23, 2015 from www.pacificlighttech.com/quantum-dots-in-ssl/, 2pp.
Wikipedia, "Quantum dot,", downloaded on May 30, 2014 from http://en.wikipedia.org/wiki/Quantum_dot, 15pp.

(56) References Cited

OTHER PUBLICATIONS

Wikipedia, "Reflectivity,", downloaded on Jan. 22, 2015 from www.wikipedia.org, 3pp.
Wikipedia, "Transmittance," downloaded on Jan. 22, 2015 from www.wikipedia.org, 4pp.
"United Lumen—A Volumetric Displaced Phosphor Light Engine which elegantly and efficiently distributes light in a pattern similar to an incandescent bulb," downloaded on Jul. 9, 2014 from www.unitedlumen.com, 1p.
"United Lumen—Solid State Volumetric Technology," downloaded on Jul. 9, 2014 from www.unitedlumen.com, 1p.
"United Lumen—High Brightness V-LED Technology," downloaded on May 15, 2014 from www.unitedlumen.com, 1p.
PCT/US2016/016972, Ecosense Lighting Inc., filed on Feb. 8, 2016.
PCT/US2016/016972, Ecosense Lighting Inc., International Search Report and Opinion dated Apr. 11, 2016.
Acuity Brands, "Acuity Brands Introduces Luminaire for Tunable White Technology, " downloaded from http://news.acuitybrands.com/US/acuity-brands-introduces-luminaires-with-tunable-white-technology/s/54ae242f-1222-4b8b-be0d-36637bde8cd2 on May 28, 2014, 2pp.
Kenneth Kelly, "Color Designations for Lights," U.S. Department of Commerce, National Bureau of Standards, Research Paper RP1565, Journal of Research of the National Bureau of Standards, vol. 31, Nov. 1943, pp. 271-278.
Philips Color Kinetics, "LED Cove Lighting," downloaded on May 28, 2014 from http://www.colorkinetics.com/ls/guides-brochures/pck-led-cove-lighting.pdf, 32pp.
Philips Color Kinetics, "IntelliWhite LED Lighting Systems," downloaded on May 28, 2014 from http://www.colorkinetics,com/ls/intelliwhite/, 2pp.
Philips Color Kinetics, "Color-Changing LED Lighting Systems," downloaded on May 27, 2014 from hftp://www.colorkinetics.com/ls/rgb/, 2pp.
Wikipedia, "Color temperature," version dated May 21, 2014, downloaded on Jun. 3, 2014 from www.wikipedia.org, 17pp.
Cree, "LED Color Mixing: Basics and Background," downloaded on Sep. 24, 2014 from www.cree.com, 24pp.
Cree, "Cree(r) LMH2 LED Modules," Product Family Data Sheet, downloaded on May 27, 2014 from http://www.cree.com/~/media/Files/Cree/LED%20Components%20and%20Modules/Modules/Data%20Sheets/LEDModules_LMH2.pdf, 18pp.
"Dialight ES Series RGB LED Luminaire," downloaded on May 28, 2014 from http://www.dialight.com/Assets/Brochures_And_Catalogs/Illumination/MDEXESTEMORGB_A.pdf, 2pp.
Naomi Miller, "Color Spaces and Planckian Loci: Understanding all those Crazy Color Metrics," U.S. Department of Energy, Pacific Northwest National Laboratory, Portland, Oregon, downloaded on May 30, 2014, 49pp.
Bush, Steve, "Chip gives dim-to-warm LED lighting without MCU," dated Apr. 1, 2014, downloaded from http://www.electronicsweekly.com/news/components/led-lighting/chip-gives-dim-warm-led-lighting-without-mcu-2014-04/, 6pp.
"Ecosense to reveal new TROV LED Linear Platform at 2015 Lightfair International in New York City," May 4, 2015, blog downloaded from www.ecosense.com, 3pp.
"Ecosense to reveal new TROV LED Linear Platform at 2015 Lightfair International in New York City," May 4, 2015, press release downloaded from www.ecosense.com, 2pp.
Freyssinier, Jean P. et al., "Class A Color Designation for Light Sources Used in General Illumination," J. Light & Vis. Env., vol. 37, No. 2-3, Nov. 7, 2013, pp. 10-14.
Freyssinier, Jean P. et al., "White Lighting: A Provisional Model for Predicting Perceived Tint in 'White' Illumination," color Res. & App'n, vol. 39, No. 5, Oct. 2014, pp. 466-479.
Freyssinier, Jean P. et al., "The Class A Color Designation for Light Sources," Rensselaer Polytechnic Institute, 2013 DOE Solid-State Lighting R&D Workshop, Hilton Long Beach, California, Jan. 29-31, 2013, 26pp.
Freyssinier, Jean P. et al., "White Lighting," Color Res. & App'n, (volume unknown), Sep. 3, 2011, downloaded from http://www.lrc.rpi.edu/programs/solidstate/assist/pdf/SIL-2012_FreyssinierRea_WhiteLighting.pdf, 12pp.
Rea et al., "White lighting for residential applications," Lighting Res. Technol., Mar. 27, 2012, downloaded from www.sagepublications.com at http://lrt.sagepub.com/content/early/2012/03/27/1477153512442936, 15pp.
"Aculux—Black Body Dimming and Tunable White Responsive Technologies," downloaded on May 28, 2014 from http://www.junolightinggroup.com/literature/LIT-AX-LED-BBD-TW.pdf , 28pp.
"Khatod—Symmetric & Asymmetric Strip Lens," downloaded on May 5, 2015 from www.khatod.com, 3pp.
"KKDC Catalog 2.0," downloaded on May 28, 2014 from http://www.kkdc.co.uk/medialkkdc-catalogue.pdf, 134pp.
"KKDC UK—Linear LED Lighting," downloaded from www.kkdc.co.uk/application/interior.php on Oct. 22, 2015, 5pp.
Overton, Gail, "LEDS: White LED comprises blue LED and inexpensive dye," LaserFocusWorld, Feb. 12, 2013, Downloaded from http://www.laserfocusworld.com/articles/print/volume-49/issue-02/world-news/leds—white-led-comprises-blue-led-and-inexpensive-dye.html, 5pp.
"LED Linear—linear lighting solutions, product overview," downloaded on May 28, 2014 from http://www.led-linear.com/en/product-overview/system-catalogue/, 3pp.
"LEDnovation—BR30 Warm Dimming," downloaded on May 28, 2014 from www.lednovation.com/products/ BR30_LED.asp, 2pp.
Wikipedia, "Lenticular lens," downloaded on Feb. 18, 2015 from www.wikipedia.org, 5pp.
"Lenticular Sheets," downloaded on Feb. 24, 2015 from www.lenticular-sheets.lpceurope.eu/, 2pp.
Unzner, Norbert, "Light Analysis in lighting technology," B&S Electronische Geralte GmbH, 2001, 14pp.
"Lightolierr—Solid-State Lighting," downloaded on May 28, 2014 from http://www.lightolier.com/prospots/leds_solidstate.jsp, 1p.
Wikipedia, "Line of purples," downloaded on Oct. 20, 2015 from www.wikipedia.org, 2pp.
"Lumenbeam Catalog," downloaded on May 27, 2014 from 11_160_en_lumenpulse_lumenbeam_rgb_lbl_rgb_brochure.zip, 63pp.
"Lumenetix—Araya Technology," downloaded on May 28, 2014 from www.lumenetix.com/araya-technology, 3pp.
"Lumenpulse—Lumenbeam Large Color Changing,", downloaded on May 27, 2014 from www.lumenpulse.com/en/product/11/lumenbeam-large-color-changing, 4pp.
"Lumenpulse—Lumencove Family," downloaded on May 28, 2014 from http://www.lumenpulse.com/en/products#!3/0/0/0/0/0, 2pp.

* cited by examiner

LIGHTING SYSTEMS HAVING A TRUNCATED PARABOLIC- OR HYPERBOLIC-CONICAL LIGHT REFLECTOR, OR A TOTAL INTERNAL REFLECTION LENS; AND HAVING ANOTHER LIGHT REFLECTOR

BACKGROUND OF THE INVENTION

1. Field of the Invention

The present invention relates to the field of lighting systems that include semiconductor light-emitting devices, and processes related to such lighting systems.

2. Background of the Invention

Numerous lighting systems that include semiconductor light-emitting devices have been developed. As examples, some of such lighting systems may convert wavelengths and change propagation directions of light emitted by the semiconductor light-emitting devices. Despite the existence of these lighting systems, further improvements are still needed in lighting systems that include semiconductor light-emitting devices, and in processes related to such lighting systems.

SUMMARY

In an example of an implementation, a lighting system is provided that includes a light source, a visible light reflector, and a volumetric lumiphor. In this example of the lighting system, the light source includes a semiconductor light-emitting device being configured for emitting, along a central axis, light emissions having a first spectral power distribution. The visible light reflector in this example of a lighting system has a reflective surface and is spaced apart along the central axis at a distance away from the semiconductor light-emitting device. Also in this example of the lighting system, the volumetric lumiphor is located along the central axis between the semiconductor light-emitting device and the visible light reflector. Further in this example of the lighting system, the volumetric lumiphor is configured for converting some of the light emissions having the first spectral power distribution into light emissions having a second spectral power distribution being different than the first spectral power distribution. The reflective surface of the visible light reflector in this example of the lighting system is configured for causing a portion of the light emissions having the first and second spectral power distributions to be reflected by the visible light reflector. Additionally in this example of the lighting system, the visible light reflector is configured for permitting another portion of the light emissions having the first and second spectral power distributions to be transmitted through the visible light reflector along the central axis.

In some examples of the lighting system, the volumetric lumiphor may be integral with a visible light reflector.

In further examples of the lighting system, a reflective surface may be configured for causing the portion of the light emissions having the first and second spectral power distributions that are reflected by a visible light reflector to have reflectance values throughout the visible light spectrum being within a range of about 0.80 and about 0.95.

In additional examples of the lighting system, a visible light reflector may be configured for causing an another portion of the light emissions having the first and second spectral power distributions that may be transmitted through the visible light reflector to have transmittance values throughout the visible light spectrum being within a range of about 0.20 and about 0.05.

In further examples of the lighting system, a reflective surface of a visible light reflector may be configured for causing some of the light emissions having the first and second spectral power distributions that are reflected by the visible light reflector to be redirected in a plurality of lateral directions away from the central axis.

In other examples, the lighting system may further include a primary visible light reflector being configured for causing some of the light emissions having the first and second spectral power distributions to be redirected in a plurality of directions intersecting the central axis.

In some examples of the lighting system, the semiconductor light-emitting device may be configured for emitting the light emissions of the first spectral power distribution as having a luminous flux of a first magnitude, and the lighting system may be configured for causing the some of the light emissions that may be redirected in the plurality of directions intersecting the central axis to have a luminous flux of a second magnitude being at least about 50% as great as the first magnitude.

In further examples of the lighting system, the semiconductor light-emitting device may be configured for emitting the light emissions of the first spectral power distribution as having a luminous flux of a first magnitude, and the lighting system may be configured for causing the some of the light emissions that may be redirected in the plurality of directions intersecting the central axis to have a luminous flux of a second magnitude being at least about 80% as great as the first magnitude.

Additional examples of the lighting system may include a primary visible light reflector including a truncated parabolic reflector.

Other examples of the lighting system may include a primary visible light reflector including a truncated conical reflector.

Further examples of the lighting system may include a primary total internal reflection lens being configured for causing some of the light emissions having the first and second spectral power distributions to be redirected in a plurality of directions intersecting the central axis.

In other examples of the lighting system, the semiconductor light-emitting device may be configured for emitting the light emissions of the first spectral power distribution as having a luminous flux of a first magnitude, and the lighting system may be configured for causing some of the light emissions to be redirected in a plurality of directions intersecting the central axis and to have a luminous flux of a second magnitude being at least about 50% as great as the first magnitude.

In some examples of the lighting system, the semiconductor light-emitting device may be configured for emitting the light emissions of the first spectral power distribution as having a luminous flux of a first magnitude, and the lighting system may be configured for causing some of the light emissions to be redirected in a plurality of directions intersecting the central axis and to have a luminous flux of a second magnitude being at least about 80% as great as the first magnitude.

In further examples, the lighting system may include a light guide being configured for causing some of the light emissions having the first and second spectral power distributions to be redirected in a plurality of other directions being different than the lateral directions.

In additional examples, the lighting system may be configured for forming combined light emissions by causing some of the light emissions having the first spectral power distribution to be combined together with some of the light emissions having the second spectral power distribution, and the lighting system may be configured for causing some of the combined light emissions to be emitted from the lighting system in a plurality of directions intersecting the central axis.

In other examples, the lighting system may be configured for causing some of the combined light emissions to be emitted from the lighting system in a plurality of directions diverging away from the central axis.

In some examples, the lighting system may be configured for causing some of the combined light emissions to be emitted from the lighting system in a plurality of directions along the central axis.

In further examples of the lighting system, the semiconductor light-emitting device may be located along the central axis between another visible light reflector and the volumetric lumiphor, and the another visible light reflector may have another reflective surface being configured for causing some of the light emissions having the first and second spectral power distributions to be reflected by the another visible light reflector.

In additional examples of the lighting system, an another reflective surface of another visible light reflector may be configured for causing some of the light emissions having the first and second spectral power distributions to be reflected by the another visible light reflector in a plurality of lateral directions away from the central axis.

In other examples, the lighting system may include a primary visible light reflector being configured for causing some of the light emissions having the first and second spectral power distributions to be redirected in a plurality of directions intersecting the central axis.

In some examples, the lighting system may include a primary total internal reflection lens being configured for causing some of the light emissions having the first and second spectral power distributions to be redirected in a plurality of directions intersecting the central axis.

In further examples, the lighting system may include a light guide being configured for causing some of the light emissions having the first and second spectral power distributions to be redirected in a plurality of other directions being different than the lateral directions.

In other examples of the lighting system, a visible light reflector may have a shape being centered on the central axis.

In some examples of the lighting system, a visible light reflector may have a shape that extends away from the central axis in directions being transverse to the central axis.

In further examples of the lighting system, the shape of a visible light reflector may have a maximum width in the directions transverse to the central axis, and the volumetric lumiphor may have a shape that extends away from the central axis in directions being transverse to the central axis, and the shape of the volumetric lumiphor may have a maximum width in the directions transverse to the central axis being smaller than a maximum width of a visible light reflector.

In other examples of the lighting system, the shape of a visible light reflector may have a maximum width in the directions transverse to the central axis, and the volumetric lumiphor may have a shape that extends away from the central axis in directions being transverse to the central axis, and the shape of the volumetric lumiphor may have a maximum width in the directions transverse to the central axis being equal to or larger than a maximum width of a visible light reflector.

In additional examples of the lighting system, a reflective surface of a visible light reflector may have a distal portion being located at a greatest distance away from the central axis, and the distal portion of the reflective surface may have a beveled edge.

In other examples of the lighting system, a portion of a reflective surface of a visible light reflector may be a planar reflective surface.

In some examples of the lighting system, a portion of a reflective surface of a visible light reflector may face toward the semiconductor light-emitting device and may extend away from the central axis in the directions transverse to the central axis.

In further examples of the lighting system, a portion of a reflective surface of a visible light reflector may face toward the semiconductor light-emitting device, and the volumetric lumiphor may have an exterior surface, and a portion of the exterior surface may face toward the portion of the reflective surface of the visible light reflector.

In other examples of the lighting system, a portion of an exterior surface of the volumetric lumiphor may be configured for permitting entry into the volumetric lumiphor by light emissions that have the first and second spectral power distributions.

In some examples of the lighting system, a portion of a reflective surface of a visible light reflector may be a convex reflective surface facing toward the semiconductor light-emitting device.

In further examples of the lighting system, a shortest distance between the semiconductor light-emitting device and a portion of a reflective surface of a visible light reflector may be located along the central axis.

In other examples of the lighting system, a convex reflective surface of a visible light reflector may be configured for causing some of the light emissions having the first and second spectral power distributions that may be reflected by the visible light reflector to be redirected in a plurality of lateral directions away from the central axis.

In some examples of the lighting system, a portion of a reflective surface of a visible light reflector may be a mound-shaped reflective surface facing toward the semiconductor light-emitting device.

In further examples of the lighting system, the volumetric lumiphor may have an exterior surface, and a portion of the exterior surface may be a concave exterior surface being configured for receiving a mound-shaped reflective surface of a visible light reflector.

In additional examples, the lighting system may be configured for causing some of the light emissions having the first and second spectral power distributions to be emitted from the volumetric lumiphor through a concave exterior surface, and a visible light reflector may be configured for causing some of the light emissions to be reflected by the reflective surface and to enter into the volumetric lumiphor through the concave exterior surface.

In other examples of the lighting system, the volumetric lumiphor may have an exterior surface, wherein a portion of the exterior surface may be a concave exterior surface forming a gap between the semiconductor light-emitting device and the volumetric lumiphor.

In some examples, the lighting system may be configured for causing entry of some of the light emissions from the semiconductor light-emitting device having the first spectral power distribution into the volumetric lumiphor through a concave exterior surface, and the volumetric lumiphor may be configured for causing refraction of some of the light emissions having the first spectral power distribution.

In further examples of the lighting system, the volumetric lumiphor may have an exterior surface, wherein a portion of the exterior surface may be a convex exterior surface surrounded by a concave exterior surface, and the concave exterior surface may form a gap between the semiconductor light-emitting device and the volumetric lumiphor.

In other examples of the lighting system, the volumetric lumiphor may have an exterior surface, wherein a portion of the exterior surface may be a convex exterior surface being located at a distance away from and surrounding the central axis.

In some examples, the lighting system may be configured for causing some of the light emissions having the first and second spectral power distributions to be emitted from the volumetric lumiphor through a convex exterior surface, and the convex exterior surface may be configured for causing refraction of some of the light emissions.

In further examples of the lighting system, the volumetric lumiphor may have an exterior surface, wherein a portion of the exterior surface may be a concave exterior surface being located at a distance away from and surrounding the central axis.

In other examples, the lighting system may be configured for causing some of the light emissions having the first and second spectral power distributions to be emitted from the volumetric lumiphor through a concave exterior surface, and the concave exterior surface may be configured for causing refraction of some of the light emissions.

In some examples of the lighting system, the volumetric lumiphor may include: a phosphor; a quantum dot; a quantum wire; a quantum well; a photonic nanocrystal; a semiconducting nanoparticle; a scintillator; a lumiphoric ink; a lumiphoric organic dye; or a day glow tape.

In further examples of the lighting system, the volumetric lumiphor may be configured for down-converting some of the light emissions of the semiconductor light-emitting device having wavelengths of the first spectral power distribution into light emissions having wavelengths of the second spectral power distribution as being longer than wavelengths of the first spectral power distribution.

In other examples of the lighting system, the semiconductor light-emitting device may be configured for emitting light having a dominant- or peak-wavelength being within a range of between about 380 nanometers and about 530 nanometers.

In some examples of the lighting system, the semiconductor light-emitting device may be configured for emitting light having a color point being greenish-blue, blue, or purplish-blue.

In further examples, the lighting system may further include another semiconductor light-emitting device, and the another semiconductor light-emitting device may be configured for emitting light having a dominant- or peak-wavelength being within a range of between about 380 nanometers and about 530 nanometers.

In other examples of the lighting system, the semiconductor light-emitting device may be configured for emitting light having a dominant- or peak-wavelength being within a range of between about 420 nanometers and about 510 nanometers.

In some examples of the lighting system, the semiconductor light-emitting device may be configured for emitting light having a dominant- or peak-wavelength being within a range of between about 445 nanometers and about 490 nanometers.

In other examples, the lighting system may be configured for causing the light emissions having the first and second spectral power distributions to be combined together forming combined light emissions having a color point with a color rendition index (CRI-Ra including $R_{1-8}$) being about equal to or greater than 50.

In some examples, the lighting system may be configured for causing the light emissions having the first and second spectral power distributions to be combined together forming combined light emissions having a color point with a color rendition index (CRI-Ra including $R_{1-8}$) being about equal to or greater than 75.

In further examples, the lighting system may be configured for causing the light emissions having the first and second spectral power distributions to be combined together forming combined light emissions having a color point with a color rendition index (CRI-Ra including $R_{1-8}$) being about equal to or greater than 95.

In other examples, the lighting system may be configured for causing the light emissions having the first and second spectral power distributions to be combined together forming combined light emissions having a color point with a color rendition index (CRI-$R_9$) being about equal to or greater than 50.

In some examples, the lighting system may be configured for causing the light emissions having the first and second spectral power distributions to be combined together forming combined light emissions having a color point with a color rendition index (CRI-$R_9$) being about equal to or greater than 75.

In additional examples, the lighting system may be configured for causing the light emissions having the first and second spectral power distributions to be combined together forming combined light emissions having a color point with a color rendition index (CRI-$R_9$) being about equal to or greater than 90.

In other examples, the lighting system may be configured for forming combined light emissions by causing some of the light emissions having the first spectral power distribution to be combined together with some of the light emissions having the second spectral power distribution, and the semiconductor light-emitting device and the volumetric lumiphor may be configured for causing the combined light emissions to have a color point being within a distance of about equal to or less than +/−0.009 delta(uv) away from a Planckian—black-body locus throughout a spectrum of correlated color temperatures (CCTs) within a range of between about 1800K and about 6500K.

In some examples, the lighting system may be configured for forming combined light emissions by causing some of the light emissions having the first spectral power distribution to be combined together with some of the light emissions having the second spectral power distribution, and the semiconductor light-emitting device and the volumetric lumiphor may be configured for causing the combined light emissions to have a color point being below a Planckian—black-body locus by a distance of about equal to or less than 0.009 delta(uv) throughout a spectrum of correlated color temperatures (CCTs) within a range of between about 1800K and about 6500K.

In further examples of the lighting system, the volumetric lumiphor may be configured for down-converting some of the light emissions of the semiconductor light-emitting device having wavelengths of the first spectral power distribution into light emissions having wavelengths of the second spectral power distribution, and the second spectral power distribution may have a perceived color point being within a range of between about 491 nanometers and about 575 nanometers.

In other examples of the lighting system, the volumetric lumiphor may include a first lumiphor that generates light emissions having a perceived color point being within a range of between about 491 nanometers and about 575 nanometers, and the first lumiphor may include: a phosphor; a quantum dot; a quantum wire; a quantum well; a photonic nanocrystal; a semiconducting nanoparticle; a scintillator; a lumiphoric ink; a lumiphoric organic dye; or a day glow tape.

In some examples of the lighting system, the volumetric lumiphor may be configured for down-converting some of the light emissions of the semiconductor light-emitting device having the first spectral power distribution into light emissions having wavelengths of a third spectral power distribution being different than the first and second spectral power distributions; and the third spectral power distribution may have a perceived color point being within a range of between about 610 nanometers and about 670 nanometers.

In further examples of the lighting system, the volumetric lumiphor may include a second lumiphor that may generate light emissions having a perceived color point being within a range of between about 610 nanometers and about 670 nanometers, and the second lumiphor may include: a phosphor; a quantum dot; a quantum wire; a quantum well; a photonic nanocrystal; a semiconducting nanoparticle; a scintillator; a lumiphoric ink; a lumiphoric organic dye; or a day glow tape.

In additional examples, the lighting system may be configured for causing light emissions having first, second and third spectral power distributions to be combined together to form combined light emissions having a color point with a color rendition index (CRI-Ra including $R_{1-8}$) being about equal to or greater than 50.

In other examples, the lighting system may be configured for causing light emissions having first, second and third spectral power distributions to be combined together to form combined light emissions having a color point with a color rendition index (CRI-Ra including $R_{1-8}$) being about equal to or greater than 75.

In some examples, the lighting system may be configured for causing light emissions having first, second and third spectral power distributions to be combined together to form combined light emissions having a color point with a color rendition index (CRI-Ra including $R_{1-8}$) being about equal to or greater than 95.

In further examples, the lighting system may be configured for causing light emissions having first, second and third spectral power distributions to be combined together to form combined light emissions having a color point with a color rendition index (CRI-$R_9$) being about equal to or greater than 50.

In other examples, the lighting system may be configured for causing light emissions having first, second and third spectral power distributions to be combined together to form combined light emissions having a color point with a color rendition index (CRI-$R_9$) being about equal to or greater than 75.

In some examples, the lighting system may be configured for causing light emissions having first, second and third spectral power distributions to be combined together to form combined light emissions having a color point with a color rendition index (CRI-$R_9$) being about equal to or greater than 90.

In further examples of the lighting system, the volumetric lumiphor may be configured for causing light emissions having first, second and third spectral power distributions to be combined together to form combined light emissions having a color point being within a distance of about equal to or less than +/−0.009 delta(uv) away from a Planckian—black-body locus throughout a spectrum of correlated color temperatures (CCTs) within a range of between about 1800K and about 6500K.

In additional examples of the lighting system, the volumetric lumiphor may be configured for causing light emissions having first, second and third spectral power distributions to be combined together to form combined light emissions having a color point being below a Planckian—black-body locus by a distance of about equal to or less than 0.009 delta(uv) throughout a spectrum of correlated color temperatures (CCTs) within a range of between about 1800K and about 6500K.

In other examples of the lighting system, a first lumiphor may include a first quantum material, and a second lumiphor may include a different second quantum material, and each one of the first and second quantum materials may have a spectral power distribution for light absorption being separate from both of the second and third spectral power distributions.

In another example of an implementation, a lighting system is provided that includes a light source and a volumetric lumiphor. The light source in this example of the lighting system includes a semiconductor light-emitting device being configured for emitting, along a central axis, light emissions having a first spectral power distribution. Also in this example of the lighting system, the volumetric lumiphor is located along the central axis and is configured for converting some of the light emissions having the first spectral power distribution into light emissions having a second spectral power distribution being different than the first spectral power distribution. The volumetric lumiphor in this example of the lighting system has an exterior surface, wherein a portion of the exterior surface of the volumetric lumiphor is a concave exterior surface forming a gap between the semiconductor light-emitting device and the volumetric lumiphor. In this example, the lighting system is configured for causing entry of some of the light emissions from the semiconductor light-emitting device having the first spectral power distribution into the volumetric lumiphor through the concave exterior surface. Further in this example of the lighting system, the volumetric lumiphor is configured for causing refraction of some of the light emissions having the first spectral power distribution. In some examples, the lighting system may include a visible light reflector having a reflective surface, and the volumetric lumiphor may be located along the central axis between the semiconductor light-emitting device and the visible light reflector. In further examples of the lighting system, another portion of the exterior surface of the volumetric lumiphor may be a convex exterior surface, and the convex exterior surface may be surrounded by the concave exterior surface.

In a further example of an implementation, a lighting system is provided that includes a light source and a volumetric lumiphor. The light source in this example of the lighting system includes a semiconductor light-emitting device being configured for emitting, along a central axis, light emissions having a first spectral power distribution. Also in this example of the lighting system, the volumetric lumiphor is located along the central axis and is configured for converting some of the light emissions having the first spectral power distribution into light emissions having a second spectral power distribution being different than the first spectral power distribution. The volumetric lumiphor in this example of the lighting system has an exterior surface, wherein a portion of the exterior surface of the volumetric lumiphor is a convex exterior surface being located at a distance away from and surrounding the central axis. In this example, the lighting system is configured for causing some of the light emissions having the first and second spectral power distributions to enter into and be emitted from the volumetric lumiphor through the convex exterior surface. Additionally in this example of the lighting system, the volumetric lumiphor is configured for causing refraction of some of the light emissions. In some examples, the lighting system may further include a visible light reflector having a reflective surface, and the volumetric lumiphor may be located along the central axis between the semiconductor light-emitting device and the visible light reflector.

In an additional example of an implementation, a lighting system is provided that includes a light source and a volumetric lumiphor. The light source in this example of the lighting system includes a semiconductor light-emitting device being configured for emitting, along a central axis, light emissions having a first spectral power distribution. Also in this example of the lighting system, the volumetric lumiphor is located along the central axis and is configured for converting some of the light emissions having the first spectral power distribution into light emissions having a second spectral power distribution being different than the first spectral power distribution. The volumetric lumiphor in this example of the lighting system has an exterior surface, wherein a portion of the exterior surface of the volumetric lumiphor is a concave exterior surface being located at a distance away from and surrounding the central axis. In this example, the lighting system is configured for causing some of the light emissions having the first and second spectral power distributions to enter into and be emitted from the volumetric lumiphor through the concave exterior surface. Additionally in this example of the lighting system, the volumetric lumiphor is configured for causing refraction of some of the light emissions. In some examples, the lighting system may further include a visible light reflector having a reflective surface, and the volumetric lumiphor may be located along the central axis between the semiconductor light-emitting device and the visible light reflector.

As a further example of an implementation, a lighting process is provided that includes providing a lighting system including: a light source that includes a semiconductor light-emitting device being configured for emitting, along a central axis, light emissions having a first spectral power distribution; and a volumetric lumiphor being located along the central axis and being configured for converting some of the light emissions having the first spectral power distribution into light emissions having a second spectral power distribution being different than the first spectral power distribution, the volumetric lumiphor having a concave exterior surface forming a gap between the semiconductor light-emitting device and the volumetric lumiphor. This example of the lighting process further includes: causing the semiconductor light-emitting device to emit light emissions having the first spectral power distribution; and causing some of the light emissions having the first spectral power distribution to enter into the volumetric lumiphor through the concave exterior surface and to be refracted by the volumetric lumiphor.

As an additional example of an implementation, a lighting process is provided that includes providing a lighting system including: a light source that includes a semiconductor light-emitting device being configured for emitting, along a central axis, light emissions having a first spectral power distribution; and a volumetric lumiphor being located along the central axis and being configured for converting some of the light emissions having the first spectral power distribution into light emissions having a second spectral power distribution being different than the first spectral power distribution, the volumetric lumiphor having a convex exterior surface being located at a distance away from and surrounding the central axis. This example of the lighting process further includes: causing the semiconductor light-emitting device to emit light emissions having the first spectral power distribution; and causing some of the light emissions having the first spectral power distribution to enter into and to be emitted from the volumetric lumiphor through the convex exterior surface, and to be refracted by the volumetric lumiphor.

In another example of an implementation, a lighting process is provided that includes providing a lighting system including: a light source that includes a semiconductor light-emitting device being configured for emitting, along a central axis, light emissions having a first spectral power distribution; and a volumetric lumiphor being located along the central axis and being configured for converting some of the light emissions having the first spectral power distribution into light emissions having a second spectral power distribution being different than the first spectral power distribution, the volumetric lumiphor having a concave exterior surface being located at a distance away from and surrounding the central axis. This example of the lighting process further includes: causing the semiconductor light-emitting device to emit light emissions having the first spectral power distribution; and causing some of the light emissions having the first spectral power distribution to enter into and to be emitted from the volumetric lumiphor through the concave exterior surface, and to be refracted by the volumetric lumiphor.

As a further example of an implementation, a lighting process is provided that includes providing a lighting system including: a light source that includes a semiconductor light-emitting device being configured for emitting, along a central axis, light emissions having a first spectral power distribution; a volumetric lumiphor being located along the central axis and being configured for converting some of the light emissions having the first spectral power distribution into light emissions having a second spectral power distribution being different than the first spectral power distribution; and a visible light reflector having a reflective surface and being spaced apart along the central axis at a distance away from the semiconductor light-emitting device, with the volumetric lumiphor being located along the central axis between the semiconductor light-emitting device and the visible light reflector. This example of the lighting process further includes: causing the semiconductor light-emitting device to emit light emissions having the first spectral power distribution; and causing the reflective surface of the visible light reflector to reflect a portion of the light emissions having the first and second spectral power distributions. In some examples, the lighting process may further include permitting another portion of the light emissions to be transmitted through the visible light reflector along the central axis. In additional examples of the lighting process, the providing the lighting system may further include: providing the reflective surface of the visible light reflector as including a mound-shaped reflective surface; and providing the exterior surface of the volumetric lumiphor as including a concave exterior surface configured for receiving the mound-shaped reflective surface of the visible light reflector.

Other systems, processes, features and advantages of the invention will be or will become apparent to one with skill in the art upon examination of the following figures and detailed description. It is intended that all such additional systems, processes, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
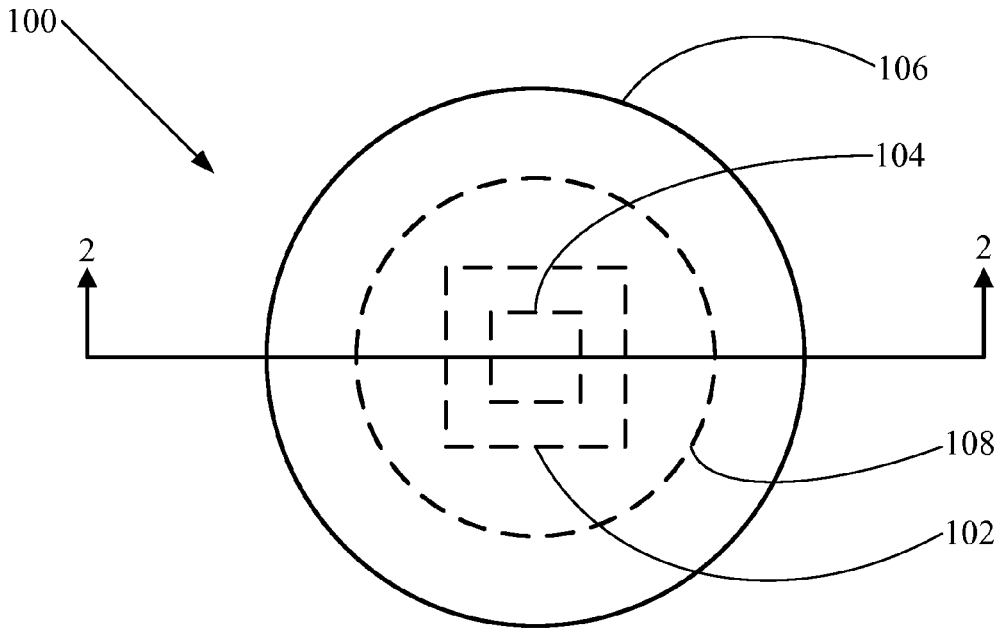
FIG. 1 is a schematic top view showing an example of an implementation of a lighting system.

Various lighting systems and processes that utilize semiconductor light-emitting devices have been designed. Many such lighting systems and processes exist that are capable of emitting light along a central axis. However, existing lighting systems and processes often have demonstrably failed to provide controlled light emissions having a perceived uniform color point and brightness; and often have generated light emissions being perceived as having aesthetically-unpleasing glare. Many lighting systems and processes also exist that utilize lumiphors for converting light emissions having a first spectral power distribution into light emissions having a second spectral power distribution being different than the first spectral power distribution. However, existing lighting systems and processes often have demonstrably failed to protect the lumiphors from heat-induced degradation that may be caused by heat generated during light emissions by the semiconductor light-emitting devices, which may result in the light emissions being perceived as having unstable color points and non-uniform brightness.

Lighting systems accordingly are provided herein, including a light source and a volumetric lumiphor. The light source includes a semiconductor light-emitting device being configured for emitting, along a central axis, light emissions having a first spectral power distribution. The volumetric lumiphor is located along the central axis and is configured for converting some of the light emissions having the first spectral power distribution into light emissions having a second spectral power distribution being different than the first spectral power distribution. In some examples, the lighting system may further include a visible light reflector having a reflective surface, with the volumetric lumiphor being located along the central axis between the semiconductor light-emitting device and the visible light reflector. In those examples of the lighting system, the reflective surface may be configured for causing a portion of the light emissions having the first and second spectral power distributions to be reflected by the visible light reflector. Further in those examples, the visible light reflector may be configured for permitting another portion of the light emissions having the first and second spectral power distributions to be transmitted through the visible light reflector along the central axis. In additional examples of the lighting system, the volumetric lumiphor may have an exterior surface wherein a portion of the exterior surface is a concave exterior surface forming a gap between the semiconductor light-emitting device and the volumetric lumiphor. In other examples of the lighting system, the volumetric lumiphor may have an exterior surface wherein a portion of the exterior surface is a convex exterior surface being located at a distance away from and surrounding the central axis. In further examples of the lighting system, the volumetric lumiphor may have an exterior surface wherein a portion of the exterior surface is a concave exterior surface being located at a distance away from and surrounding the central axis. Lighting processes also accordingly are provided herein, which include providing a lighting system. The lighting processes further include causing a semiconductor light-emitting device of the lighting system to emit light emissions having a first spectral power distribution. In some examples, the lighting process may include causing a reflective surface of a visible light reflector to reflect a portion of the light emissions; and may additionally include permitting another portion of the light emissions to be transmitted through the visible light reflector along the central axis.

The lighting systems provided herein may, for example, produce light emissions wherein the directions of propagation of a portion of the light emissions constituting at least about 50% or at least about 80% of a total luminous flux of the semiconductor light-emitting device or devices are redirected by and therefore controlled by the lighting systems. The controlled light emissions from these lighting systems may have, as examples: a perceived uniform color point; a perceived uniform brightness; a perceived uniform appearance; and a perceived aesthetically-pleasing appearance without perceived glare. The controlled light emissions from these lighting systems may further, as examples, be utilized in generating specialty lighting effects being perceived as having a more uniform appearance in applications such as wall wash, corner wash, and floodlight. The lighting systems provided herein may further, for example, protect the lumiphors of the lighting systems from heat-induced degradation that may be caused by heat generated during light emissions by the semiconductor light-emitting devices, resulting in, as examples: a stable color point; and a long-lasting stable brightness. The light emissions from these lighting systems may, for the foregoing reasons, accordingly be perceived as having, as examples: a uniform color point; a uniform brightness; a uniform appearance; an aesthetically-pleasing appearance without perceived glare; a stable color point; and a long-lasting stable brightness.

The following definitions of terms, being stated as applying "throughout this specification", are hereby deemed to be incorporated throughout this specification, including but not limited to the Summary, Brief Description of the Figures, Detailed Description, and Claims.

Throughout this specification, the term "semiconductor" means: a substance, examples including a solid chemical element or compound, that can conduct electricity under some conditions but not others, making the substance a good medium for the control of electrical current.

Throughout this specification, the term "semiconductor light-emitting device" (also being abbreviated as "SLED") means: a light-emitting diode; an organic light-emitting diode; a laser diode; or any other light-emitting device having one or more layers containing inorganic and/or organic semiconductor(s). Throughout this specification, the term "light-emitting diode" (herein also referred to as an "LED") means: a two-lead semiconductor light source having an active pn-junction. As examples, an LED may include a series of semiconductor layers that may be epitaxially grown on a substrate such as, for example, a substrate that includes sapphire, silicon, silicon carbide, gallium nitride or gallium arsenide. Further, for example, one or more semiconductor p-n junctions may be formed in these epitaxial layers. When a sufficient voltage is applied across the p-n junction, for example, electrons in the n-type semiconductor layers and holes in the p-type semiconductor layers may flow toward the p-n junction. As the electrons and holes flow toward each other, some of the electrons may recombine with corresponding holes, and emit photons. The energy release is called electroluminescence, and the color of the light, which corresponds to the energy of the photons, is determined by the energy band gap of the semiconductor. As examples, a spectral power distribution of the light generated by an LED may generally depend on the particular semiconductor materials used and on the structure of the thin epitaxial layers that make up the "active region" of the device, being the area where the light is generated. As examples, an LED may have a light-emissive electroluminescent layer including an inorganic semiconductor, such as a Group III-V semiconductor, examples including: gallium nitride; silicon; silicon carbide; and zinc oxide. Throughout this specification, the term "organic light-emitting diode" (herein also referred to as an "OLED") means: an LED having a light-emissive electroluminescent layer including an organic semiconductor, such as small organic molecules or an organic polymer. It is understood throughout this specification that a semiconductor light-emitting device may include: a non-semiconductor-substrate or a semiconductor-substrate; and may include one or more electrically-conductive contact layers. Further, it is understood throughout this specification that an LED may include a substrate formed of materials such as, for example: silicon carbide; sapphire; gallium nitride; or silicon. It is additionally understood throughout this specification that a semiconductor light-emitting device may have a cathode contact on one side and an anode contact on an opposite side, or may alternatively have both contacts on the same side of the device.

Further background information regarding semiconductor light-emitting devices is provided in the following documents, the entireties of all of which hereby are incorporated by reference herein: U.S. Pat. Nos. 7,564,180; 7,456,499; 7,213,940; 7,095,056; 6,958,497; 6,853,010; 6,791,119; 6,600,175; 6,201,262; 6,187,606; 6,120,600; 5,912,477; 5,739,554; 5,631,190; 5,604,135; 5,523,589; 5,416,342; 5,393,993; 5,359,345; 5,338,944; 5,210,051; 5,027,168; 5,027,168; 4,966,862; and 4,918,497; and U.S. Patent Application Publication Nos. 2014/0225511; 2014/0078715; 2013/0241392; 2009/0184616; 2009/0080185; 2009/0050908; 2009/0050907; 2008/0308825; 2008/0198112; 2008/0179611; 2008/0173884; 2008/0121921; 2008/0012036; 2007/0253209; 2007/0223219; 2007/0170447; 2007/0158668; 2007/0139923; and 2006/0221272.

Throughout this specification, the term "spectral power distribution" means: the emission spectrum of the one or more wavelengths of light emitted by a semiconductor light-emitting device. Throughout this specification, the term "peak wavelength" means: the wavelength where the spectral power distribution of a semiconductor light-emitting device reaches its maximum value as detected by a photo-detector. As an example, an LED may be a source of nearly monochromatic light and may appear to emit light having a single color. Thus, the spectral power distribution of the light emitted by such an LED may be centered about its peak wavelength. As examples, the "width" of the spectral power distribution of an LED may be within a range of between about 10 nanometers and about 30 nanometers, where the width is measured at half the maximum illumination on each side of the emission spectrum. Throughout this specification, the term "full-width-half-maximum" ("FWHM") means: the width of the spectral power distribution of a semiconductor light-emitting device measured at half the maximum illumination on each side of its emission spectrum. Throughout this specification, the term "dominant wavelength" means: the wavelength of monochromatic light that has the same apparent color as the light emitted by a semiconductor light-emitting device, as perceived by the human eye. As an example, since the human eye perceives yellow and green light better than red and blue light, and because the light emitted by a semiconductor light-emitting device may extend across a range of wavelengths, the color perceived (i.e., the dominant wavelength) may differ from the peak wavelength.

Throughout this specification, the term "luminous flux", also referred to as "luminous power", means: the measure in lumens of the perceived power of light, being adjusted to reflect the varying sensitivity of the human eye to different wavelengths of light. Throughout this specification, the term "radiant flux" means: the measure of the total power of electromagnetic radiation without being so adjusted. Throughout this specification, the term "central axis" means a direction along which the light emissions of a semiconductor light-emitting device have a greatest radiant flux. It is understood throughout this specification that light emissions "along a central axis" means light emissions that: include light emissions in the direction of the central axis; and may further include light emissions in a plurality of other generally similar directions.

Throughout this specification, the term "color bin" means: the designated empirical spectral power distribution and related characteristics of a particular semiconductor light-emitting device. For example, individual light-emitting diodes (LEDs) are typically tested and assigned to a designated color bin (i.e., "binned") based on a variety of characteristics derived from their spectral power distribution. As an example, a particular LED may be binned based on the value of its peak wavelength, being a common metric to characterize the color aspect of the spectral power distribution of LEDs. Examples of other metrics that may be utilized to bin LEDs include: dominant wavelength; and color point.

Throughout this specification, the term "luminescent" means: characterized by absorption of electromagnetic radiation (e.g., visible light, UV light or infrared light) causing the emission of light by, as examples: fluorescence; and phosphorescence.

Throughout this specification, the term "object" means a material article or device. Throughout this specification, the term "surface" means an exterior boundary of an object. Throughout this specification, the term "incident visible light" means visible light that propagates in one or more directions towards a surface. Throughout this specification, the term "reflective surface" means a surface of an object that causes incident visible light, upon reaching the surface, to then propagate in one or more different directions away from the surface without passing through the object. Throughout this specification, the term "planar reflective surface" means a generally flat reflective surface.

Throughout this specification, the term "reflectance" means a fraction of a radiant flux of incident visible light having a specified wavelength that is caused by a reflective surface of an object to propagate in one or more different directions away from the surface without passing through the object. Throughout this specification, the term "reflected light" means the incident visible light that is caused by a reflective surface to propagate in one or more different directions away from the surface without passing through the object. Throughout this specification, the term "Lambertian reflectance" means diffuse reflectance of visible light from a surface, in which the reflected light has uniform radiant flux in all of the propagation directions. Throughout this specification, the term "specular reflectance" means mirror-like reflection of visible light from a surface, in which light from a single incident direction is reflected into a single propagation direction. Throughout this specification, the term "spectrum of reflectance values" means a spectrum of values of fractions of radiant flux of incident visible light, the values corresponding to a spectrum of wavelength values of visible light, that are caused by a reflective surface to propagate in one or more different directions away from the surface without passing through the object. Throughout this specification, the term "transmittance" means a fraction of a radiant flux of incident visible light having a specified wavelength that is permitted by a reflective surface to pass through the object having the reflective surface. Throughout this specification, the term "transmitted light" means the incident visible light that is permitted by a reflective surface to pass through the object having the reflective surface. Throughout this specification, the term "spectrum of transmittance values" means a spectrum of values of fractions of radiant flux of incident visible light, the values corresponding to a spectrum of wavelength values of visible light, that are permitted by a reflective surface to pass through the object having the reflective surface. Throughout this specification, the term "absorbance" means a fraction of a radiant flux of incident visible light having a specified wavelength that is permitted by a reflective surface to pass through the reflective surface and is absorbed by the object having the reflective surface. Throughout this specification, the term "spectrum of absorbance values" means a spectrum of values of fractions of radiant flux of incident visible light, the values corresponding to a spectrum of wavelength values of visible light, that are permitted by a reflective surface to pass through the reflective surface and are absorbed by the object having the reflective surface. Throughout this specification, it is understood that a reflective surface, or an object, may have a spectrum of reflectance values, and a spectrum of transmittance values, and a spectrum of absorbance values. The spectra of reflectance values, absorbance values, and transmittance values of a reflective surface or of an object may be measured, for example, utilizing an ultraviolet-visible-near infrared (UV-VIS-NIR) spectrophotometer. Throughout this specification, the term "visible light reflector" means an object having a reflective surface. In examples, a visible light reflector may be selected as having a reflective surface characterized by light reflections that are more Lambertian than specular.

Throughout this specification, the term "lumiphor" means: a medium that includes one or more luminescent materials being positioned to absorb light that is emitted at a first spectral power distribution by a semiconductor light-emitting device, and to re-emit light at a second spectral power distribution in the visible or ultra violet spectrum being different than the first spectral power distribution, regardless of the delay between absorption and re-emission. Lumiphors may be categorized as being down-converting, i.e., a material that converts photons to a lower energy level (longer wavelength); or up-converting, i.e., a material that converts photons to a higher energy level (shorter wavelength). As examples, a luminescent material may include: a phosphor; a quantum dot; a quantum wire; a quantum well; a photonic nanocrystal; a semiconducting nanoparticle; a scintillator; a lumiphoric ink; a lumiphoric organic dye; a day glow tape; a phosphorescent material; or a fluorescent material. Throughout this specification, the term "quantum material" means any luminescent material that includes: a quantum dot; a quantum wire; or a quantum well. Some quantum materials may absorb and emit light at spectral power distributions having narrow wavelength ranges, for example, wavelength ranges having spectral widths being within ranges of between about 25 nanometers and about 50 nanometers. In examples, two or more different quantum materials may be included in a lumiphor, such that each of the quantum materials may have a spectral power distribution for light emissions that may not overlap with a spectral power distribution for light absorption of any of the one or more other quantum materials. In these examples, cross-absorption of light emissions among the quantum materials of the lumiphor may be minimized. As examples, a lumiphor may include one or more layers or bodies that may contain one or more luminescent materials that each may be: (1) coated or sprayed directly onto an semiconductor light-emitting device; (2) coated or sprayed onto surfaces of a lens or other elements of packaging for an semiconductor light-emitting device; (3) dispersed in a matrix medium; or (4) included within a clear encapsulant (e.g., an epoxy-based or silicone-based curable resin or glass or ceramic) that may be positioned on or over an semiconductor light-emitting device. A lumiphor may include one or multiple types of luminescent materials. Other materials may also be included with a lumiphor such as, for example, fillers, diffusants, colorants, or other materials that may as examples improve the performance of or reduce the overall cost of the lumiphor. In examples where multiple types of luminescent materials may be included in a lumiphor, such materials may, as examples, be mixed together in a single layer or deposited sequentially in successive layers.

Throughout this specification, the term "volumetric lumiphor" means a lumiphor being distributed in an object having a shape including defined exterior surfaces. In some examples, a volumetric lumiphor may be formed by dispersing a lumiphor in a volume of a matrix medium having suitable spectra of visible light transmittance values and visible light absorbance values. As examples, such spectra may be affected by a thickness of the volume of the matrix medium, and by a concentration of the lumiphor being distributed in the volume of the matrix medium. In examples, the matrix medium may have a composition that includes polymers or oligomers of: a polycarbonate; a silicone; an acrylic; a glass; a polystyrene; or a polyester such as polyethylene terephthalate. Throughout this specification, the term "remotely-located lumiphor" means a lumiphor being spaced apart at a distance from and positioned to receive light that is emitted by a semiconductor light-emitting device.

Throughout this specification, the term "light-scattering particles" means small particles formed of a non-luminescent, non-wavelength-converting material. In some examples, a volumetric lumiphor may include light-scattering particles being dispersed in the volume of the matrix medium for causing some of the light emissions having the first spectral power distribution to be scattered within the volumetric lumiphor. As an example, causing some of the light emissions to be so scattered within the matrix medium may cause the luminescent materials in the volumetric lumiphor to absorb more of the light emissions having the first spectral power distribution. In examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In examples, light-scattering particles may have particle sizes being within a range of about 0.01 micron (10 nanometers) and about 2.0 microns (2,000 nanometers).

In some examples, a visible light reflector may be formed by dispersing light-scattering particles having a first index of refraction in a volume of a matrix medium having a second index of refraction being suitably different from the first index of refraction for causing the volume of the matrix medium with the dispersed light-scattering particles to have suitable spectra of reflectance values, transmittance values, and absorbance values for functioning as a visible light reflector. As examples, such spectra may be affected by a thickness of the volume of the matrix medium, and by a concentration of the light-scattering particles being distributed in the volume of the matrix medium, and by physical characteristics of the light-scattering particles such as the particle sizes and shapes, and smoothness or roughness of exterior surfaces of the particles. In an example, the smaller the difference between the first and second indices of refraction, the more light-scattering particles may need to be dispersed in the volume of the matrix medium to achieve a given amount of light-scattering. As examples, the matrix medium for forming a visible light reflector may have a composition that includes polymers or oligomers of: a polycarbonate; a silicone; an acrylic; a glass; a polystyrene; or a polyester such as polyethylene terephthalate. In further examples, the light-scattering particles may include: rutile titanium dioxide; anatase titanium dioxide; barium sulfate; diamond; alumina; magnesium oxide; calcium titanate; barium titanate; strontium titanate; or barium strontium titanate. In other examples, a visible light reflector may include a reflective polymeric or metallized surface formed on a visible light-transmissive polymeric or metallic object such as, for example, a volume of a matrix medium. Additional examples of visible light reflectors may include microcellular foamed polyethylene terephthalate sheets ("MCPET"). Suitable visible light reflectors may be commercially available under the trade names White Optics® and MIRO® from WhiteOptics LLC, 243-G Quigley Blvd., New Castle, Del. 19720 USA. Suitable MCPET visible light reflectors may be commercially available from the Furukawa Electric Co., Ltd., Foamed Products Division, Tokyo, Japan. Additional suitable visible light reflectors may be commercially available from CVI Laser Optics, 200 Dorado Place SE, Albuquerque, N. Mex. 87123 USA.

In further examples, a volumetric lumiphor and a visible light reflector may be integrally formed. As examples, a volumetric lumiphor and a visible light reflector may be integrally formed in respective layers of a volume of a matrix medium, including a layer of the matrix medium having a dispersed lumiphor, and including another layer of the same or a different matrix medium having light-scattering particles being suitably dispersed for causing the another layer to have suitable spectra of reflectance values, transmittance values, and absorbance values for functioning as the visible light reflector. In other examples, an integrally-formed volumetric lumiphor and visible light reflector may incorporate any of the further examples of variations discussed above as to separately-formed volumetric lumiphors and visible light reflectors.

Throughout this specification, the term "phosphor" means: a material that exhibits luminescence when struck by photons. Examples of phosphors that may utilized include: $CaAlSiN_3$:Eu, $SrAlSiN_3$:Eu, $CaAlSiN_3$:Eu, $Ba_3Si_6O_{12}N_2$:Eu, $Ba_2SiO_4$:Eu, $Sr_2SiO_4$:Eu, $Ca_2SiO_4$:Eu, $Ca_3Sc_2Si_3O_{12}$:Ce, $Ca_3Mg_2Si_3O_{12}$:Ce, $CaSc_2O_4$:Ce, $CaSi_2O_2N_2$:Eu, $SrSi_2O_2N_2$:Eu, $BaSi_2O_2N_2$:Eu, $Ca_5(PO_4)_3Cl$:Eu, $Ba_5(PO_4)_3Cl$:Eu, $Cs_2CaP_2O_7$, $Cs_2SrP_2O_7$, $SrGa_2S_4$:Eu, $Lu_3Al_5O_{12}$:Ce, $Ca_8Mg(SiO_4)_4Cl_2$:Eu, $Sr_8Mg(SiO_4)_4Cl_2$:Eu, $La_3Si_6N_{11}$:Ce, $Y_3Al_5O_{12}$:Ce, $Y_3Ga_5O_{12}$:Ce, $Gd_3Al_5O_{12}$:Ce, $Gd_3Ga_5O_{12}$:Ce, $Tb_3Al_5O_{12}$:Ce, $Tb_3Ga_5O_{12}$:Ce, $Lu_3Ga_5O_{12}$:Ce, (SrCa)$AlSiN_3$:Eu, LuAG:Ce, $(Y,Gd)_2Al_5)_{12}$:Ce, CaS:Eu, SrS:Eu, $SrGa_2S_4$:$E_4$, $Ca_2(Sc,Mg)_2SiO_{12}$:Ce, $Ca_2Sc_2Si_2)_{12}$:C2, $Ca_2Sc_2O_4$:Ce, $Ba_2Si_6O_{12}N_2$:Eu, (Sr,Ca)$AlSiN_2$:Eu, and $CaAlSiN_2$:Eu.

Throughout this specification, the term "quantum dot" means: a nanocrystal made of semiconductor materials that are small enough to exhibit quantum mechanical properties, such that its excitons are confined in all three spatial dimensions.

Throughout this specification, the term "quantum wire" means: an electrically conducting wire in which quantum effects influence the transport properties.

Throughout this specification, the term "quantum well" means: a thin layer that can confine (quasi-)particles (typically electrons or holes) in the dimension perpendicular to the layer surface, whereas the movement in the other dimensions is not restricted.

Throughout this specification, the term "photonic nanocrystal" means: a periodic optical nanostructure that affects the motion of photons, for one, two, or three dimensions, in much the same way that ionic lattices affect electrons in solids.

Throughout this specification, the term "semiconducting nanoparticle" means: a particle having a dimension within a range of between about 1 nanometer and about 100 nanometers, being formed of a semiconductor.

Throughout this specification, the term "scintillator" means: a material that fluoresces when struck by photons.

Throughout this specification, the term "lumiphoric ink" means: a liquid composition containing a luminescent material. For example, a lumiphoric ink composition may contain semiconductor nanoparticles. Examples of lumiphoric ink compositions that may be utilized are disclosed in Cao et al., U.S. Patent Application Publication No. 20130221489 published on Aug. 29, 2013, the entirety of which hereby is incorporated herein by reference.

Throughout this specification, the term "lumiphoric organic dye" means an organic dye having luminescent up-converting or down-converting activity. As an example, some perylene-based dyes may be suitable.

Throughout this specification, the term "day glow tape" means: a tape material containing a luminescent material.

Throughout this specification, the term "CIE 1931 XY chromaticity diagram" means: the 1931 International Commission on Illumination two-dimensional chromaticity diagram, which defines the spectrum of perceived color points of visible light by (x, y) pairs of chromaticity coordinates that fall within a generally U-shaped area that includes all of the hues perceived by the human eye. Each of the x and y axes of the CIE 1931 XY chromaticity diagram has a scale of between 0.0 and 0.8. The spectral colors are distributed around the perimeter boundary of the chromaticity diagram, the boundary encompassing all of the hues perceived by the human eye. The perimeter boundary itself represents maximum saturation for the spectral colors. The CIE 1931 XY chromaticity diagram is based on the three dimensional CIE 1931 XYZ color space. The CIE 1931 XYZ color space utilizes three color matching functions to determine three corresponding tristimulus values which together express a given color point within the CIE 1931 XYZ three dimensional color space. The CIE 1931 XY chromaticity diagram is a projection of the three dimensional CIE 1931 XYZ color space onto a two dimensional (x, y) space such that brightness is ignored. A technical description of the CIE 1931 XY chromaticity diagram is provided in, for example, the "Encyclopedia of Physical Science and Technology", vol. 7, pp. 230-231 (Robert A Meyers ed., 1987); the entirety of which hereby is incorporated herein by reference. Further background information regarding the CIE 1931 XY chromaticity diagram is provided in Harbers et al., U.S. Patent Application Publication No. 2012/0224177A1 published on Sep. 6, 2012, the entirety of which hereby is incorporated herein by reference.

Throughout this specification, the term "color point" means: an (x, y) pair of chromaticity coordinates falling within the CIE 1931 XY chromaticity diagram. Color points located at or near the perimeter boundary of the CIE 1931 XY chromaticity diagram are saturated colors composed of light having a single wavelength, or having a very small spectral power distribution. Color points away from the perimeter boundary within the interior of the CIE 1931 XY chromaticity diagram are unsaturated colors that are composed of a mixture of different wavelengths.

Throughout this specification, the term "combined light emissions" means: a plurality of different light emissions that are mixed together. Throughout this specification, the term "combined color point" means: the color point, as perceived by human eyesight, of combined light emissions. Throughout this specification, a "substantially constant" combined color points are: color points of combined light emissions that are perceived by human eyesight as being uniform, i.e., as being of the same color.

Throughout this specification, the term "Planckian—black-body locus" means the curve within the CIE 1931 XY chromaticity diagram that plots the chromaticity coordinates (i.e., color points) that obey Planck's equation: $E(\lambda)=A\lambda-5/(eB/T-1)$, where E is the emission intensity, X is the emission wavelength, T is the color temperature in degrees Kelvin of a black-body radiator, and A and B are constants. The Planckian—black-body locus corresponds to the locations of color points of light emitted by a black-body radiator that is heated to various temperatures. As a black-body radiator is gradually heated, it becomes an incandescent light emitter (being referred to throughout this specification as an "incandescent light emitter") and first emits reddish light, then yellowish light, and finally bluish light with increasing temperatures. This incandescent glowing occurs because the wavelength associated with the peak radiation of the black-body radiator becomes progressively shorter with gradually increasing temperatures, consistent with the Wien Displacement Law. The CIE 1931 XY chromaticity diagram further includes a series of lines each having a designated corresponding temperature listing in units of degrees Kelvin spaced apart along the Planckian—black-body locus and corresponding to the color points of the incandescent light emitted by a black-body radiator having the designated temperatures. Throughout this specification, such a temperature listing is referred to as a "correlated color temperature" (herein also referred to as the "CCT") of the corresponding color point. Correlated color temperatures are expressed herein in units of degrees Kelvin (K). Throughout this specification, each of the lines having a designated temperature listing is referred to as an "isotherm" of the corresponding correlated color temperature.

Throughout this specification, the term "chromaticity bin" means: a bounded region within the CIE 1931 XY chromaticity diagram. As an example, a chromaticity bin may be defined by a series of chromaticity (x,y) coordinates, being connected in series by lines that together form the bounded region. As another example, a chromaticity bin may be defined by several lines or other boundaries that together form the bounded region, such as: one or more isotherms of CCT's; and one or more portions of the perimeter boundary of the CIE 1931 chromaticity diagram.

Throughout this specification, the term "delta(uv)" means: the shortest distance of a given color point away from (i.e., above or below) the Planckian—black-body locus. In general, color points located at a delta(uv) of about equal to or less than 0.015 may be assigned a correlated color temperature (CCT).

Throughout this specification, the term "greenish-blue light" means: light having a perceived color point being within a range of between about 490 nanometers and about 482 nanometers (herein referred to as a "greenish-blue color point.").

Throughout this specification, the term "blue light" means: light having a perceived color point being within a range of between about 482 nanometers and about 470 nanometers (herein referred to as a "blue color point.").

Throughout this specification, the term "purplish-blue light" means: light having a perceived color point being within a range of between about 470 nanometers and about 380 nanometers (herein referred to as a "purplish-blue color point.").

Throughout this specification, the term "reddish-orange light" means: light having a perceived color point being within a range of between about 610 nanometers and about 620 nanometers (herein referred to as a "reddish-orange color point.").

Throughout this specification, the term "red light" means: light having a perceived color point being within a range of between about 620 nanometers and about 640 nanometers (herein referred to as a "red color point.").

Throughout this specification, the term "deep red light" means: light having a perceived color point being within a range of between about 640 nanometers and about 670 nanometers (herein referred to as a "deep red color point.").

Throughout this specification, the term "visible light" means light having one or more wavelengths being within a range of between about 380 nanometers and about 670 nanometers; and "visible light spectrum" means the range of wavelengths of between about 380 nanometers and about 670 nanometers.

Throughout this specification, the term "white light" means: light having a color point located at a delta(uv) of about equal to or less than 0.006 and having a CCT being within a range of between about 10000K and about 1800K (herein referred to as a "white color point."). Many different hues of light may be perceived as being "white." For example, some "white" light, such as light generated by a tungsten filament incandescent lighting device, may appear yellowish in color, while other "white" light, such as light generated by some fluorescent lighting devices, may appear more bluish in color. As examples, white light having a CCT of about 3000K may appear yellowish in color, while white light having a CCT of about equal to or greater than 8000K may appear more bluish in color and may be referred to as "cool" white light. Further, white light having a CCT of between about 2500K and about 4500K may appear reddish or yellowish in color and may be referred to as "warm" white light. "White light" includes light having a spectral power distribution of wavelengths including red, green and blue color points. In an example, a CCT of a lumiphor may be tuned by selecting one or more particular luminescent materials to be included in the lumiphor. For example, light emissions from a semiconductor light-emitting device that includes three separate emitters respectively having red, green and blue color points with an appropriate spectral power distribution may have a white color point. As another example, light perceived as being "white" may be produced by mixing light emissions from a semiconductor light-emitting device having a blue, greenish-blue or purplish-blue color point together with light emissions having a yellow color point being produced by passing some of the light emissions having the blue, greenish-blue or purplish-blue color point through a lumiphor to down-convert them into light emissions having the yellow color point. General background information on systems and processes for generating light perceived as being "white" is provided in "Class A Color Designation for Light Sources Used in General Illumination", Freyssinier and Rea, *J. Light & Vis. Env.*, Vol. 37, No. 2 & 3 (Nov. 7, 2013, Illuminating Engineering Institute of Japan), pp. 10-14; the entirety of which hereby is incorporated herein by reference.

Throughout this specification, the term "color rendition index" (herein also referred to as "CRI-Ra") means: the quantitative measure on a scale of 1-100 of the capability of a given light source to accurately reveal the colors of one or more objects having designated reference colors, in comparison with the capability of a black-body radiator to accurately reveal such colors. The CRI-Ra of a given light source is a modified average of the relative measurements of color renditions by that light source, as compared with color renditions by a reference black-body radiator, when illuminating objects having the designated reference color(s). The CRI is a relative measure of the shift in perceived surface color of an object when illuminated by a particular light source versus a reference black-body radiator. The CRI-Ra will equal 100 if the color coordinates of a set of test colors being illuminated by the given light source are the same as the color coordinates of the same set of test colors being irradiated by the black-body radiator. The CRI system is administered by the International Commission on Illumination (CIE). The CIE selected fifteen test color samples (respectively designated as $R_{1-15}$) to grade the color properties of a white light source. The first eight test color samples (respectively designated as $R_{1-8}$) are relatively low saturated colors and are evenly distributed over the complete range of hues. These eight samples are employed to calculate the general color rendering index Ra. The general color rendering index Ra is simply calculated as the average of the first eight color rendering index values, $R_{1-8}$. An additional seven samples (respectively designated as $R_{9-15}$) provide supplementary information about the color rendering properties of a light source; the first four of them focus on high saturation, and the last three of them are representative of well-known objects. A set of color rendering index values, $R_{1-15}$, can be calculated for a particular correlated color temperature (CCT) by comparing the spectral response of a light source against that of each test color sample, respectively. As another example, the CRI-Ra may consist of one test color, such as the designated red color of $R_9$.

As examples, sunlight generally has a CRI-Ra of about 100; incandescent light bulbs generally have a CRI-Ra of about 95; fluorescent lights generally have a CRI-Ra of about 70 to 85; and monochromatic light sources generally have a CRI-Ra of about zero. As an example, a light source for general illumination applications where accurate rendition of object colors may not be considered important may generally need to have a CRI-Ra value being within a range of between about 70 and about 80. Further, for example, a light source for general interior illumination applications may generally need to have a CRI-Ra value being at least about 80. As an additional example, a light source for general illumination applications where objects illuminated by the lighting device may be considered to need to appear to have natural coloring to the human eye may generally need to have a CRI-Ra value being at least about 85. Further, for example, a light source for general illumination applications where good rendition of perceived object colors may be considered important may generally need to have a CRI-Ra value being at least about 90.

Throughout this specification, the term "in contact with" means: that a first object, being "in contact with" a second object, is in either direct or indirect contact with the second object. Throughout this specification, the term "in indirect contact with" means: that the first object is not in direct contact with the second object, but instead that there are a plurality of objects (including the first and second objects), and each of the plurality of objects is in direct contact with at least one other of the plurality of objects (e.g., the first and second objects are in a stack and are separated by one or more intervening layers). Throughout this specification, the term "in direct contact with" means: that the first object, which is "in direct contact" with a second object, is touching the second object and there are no intervening objects between at least portions of both the first and second objects.

Throughout this specification, the term "spectrophotometer" means: an apparatus that can measure a light beam's intensity as a function of its wavelength and calculate its total luminous flux.

Throughout this specification, the term "integrating sphere-spectrophotometer" means: a spectrophotometer operationally connected with an integrating sphere. An integrating sphere (also known as an Ulbricht sphere) is an optical component having a hollow spherical cavity with its interior covered with a diffuse white reflective coating, with small holes for entrance and exit ports. Its relevant property is a uniform scattering or diffusing effect. Light rays incident on any point on the inner surface are, by multiple scattering reflections, distributed equally to all other points. The effects of the original direction of light are minimized. An integrating sphere may be thought of as a diffuser which preserves power but destroys spatial information. Another type of integrating sphere that can be utilized is referred to as a focusing or Coblentz sphere. A Coblentz sphere has a mirror-like (specular) inner surface rather than a diffuse inner surface. Light scattered by the interior of an integrating sphere is evenly distributed over all angles. The total power (radiant flux) of a light source can then be measured without inaccuracy caused by the directional characteristics of the source. Background information on integrating sphere-spectrophotometer apparatus is provided in Liu et al., U.S. Pat. No. 7,532,324 issued on May 12, 2009, the entirety of which hereby is incorporated herein by reference. It is understood throughout this specification that color points may be measured, for example, by utilizing a spectrophotometer, such as an integrating sphere-spectrophotometer. The spectra of reflectance values, absorbance values, and transmittance values of a reflective surface or of an object may be measured, for example, utilizing an ultraviolet-visible-near infrared (UV-VIS-NIR) spectrophotometer.

Figure 2:
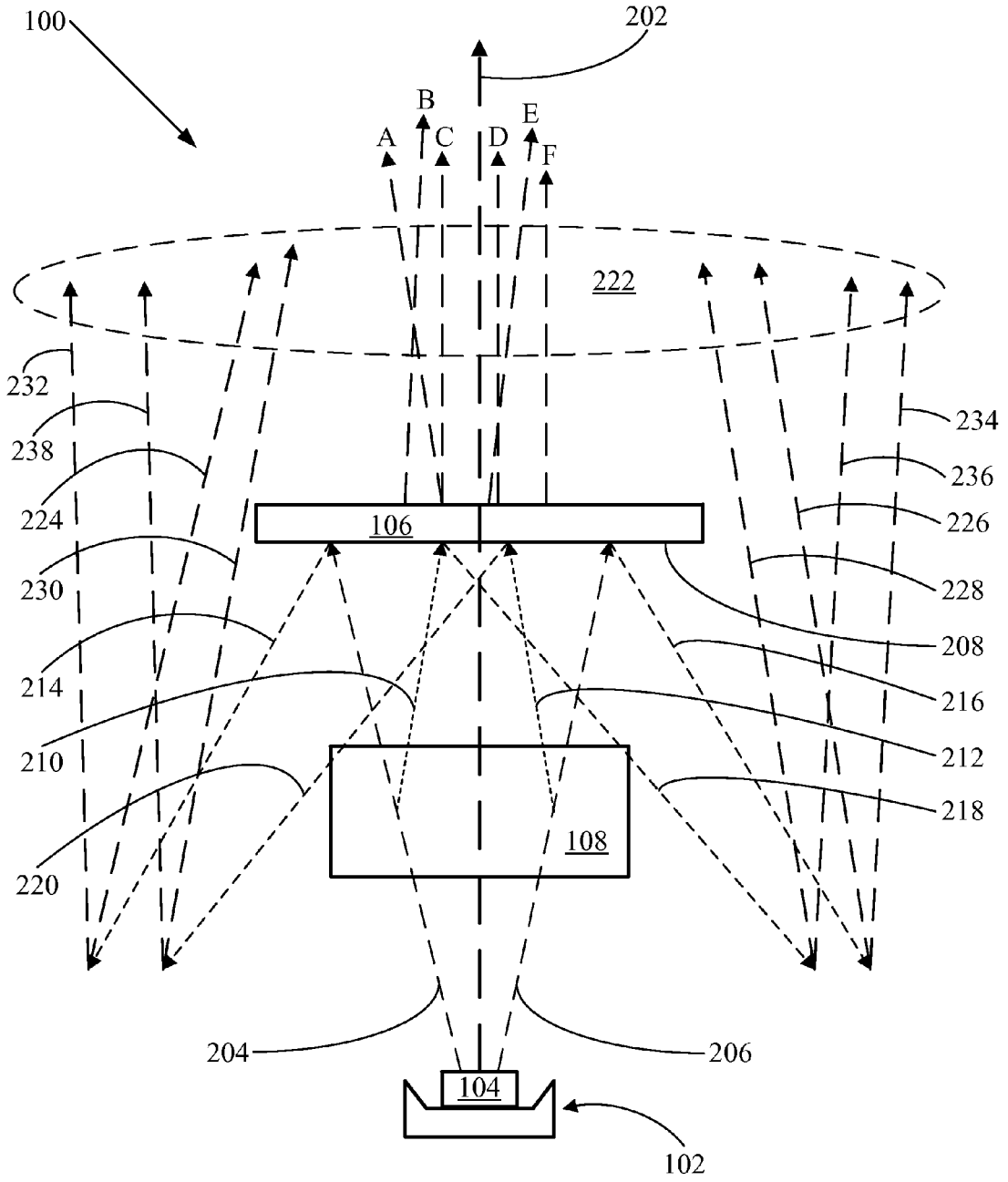
FIG. 2 is a schematic cross-sectional view taken along the line 2-2 showing the example of the lighting system.

FIG. 1 is a schematic top view showing an example [100] of an implementation of a lighting system. FIG. 2 is a schematic cross-sectional view taken along the line 2-2 showing the example [100] of the lighting system. Another example [300] of an implementation of the lighting system will subsequently be discussed in connection with FIGS. 3-4. A further example [500] of an implementation of the lighting system will subsequently be discussed in connection with FIGS. 5-6. An additional example [700] of an implementation of the lighting system will subsequently be discussed in connection with FIGS. 7-8. An example [900] of an implementation of a lighting process will be subsequently discussed in connection with FIG. 9. It is understood throughout this specification that the example [100] of an implementation of the lighting system may be modified as including any of the features or combinations of features that are disclosed in connection with: the another example [300] of an implementation of the lighting system; or the further example [500] of an implementation of the lighting system; or the additional example [700] of an implementation of the lighting system; or the example [900] of an implementation of a lighting process. Accordingly, FIGS. 3-9 and the entireties of the subsequent discussions of the examples [300], [500] and [700] of implementations of the lighting system and of the example [900] of an implementation of a lighting process are hereby incorporated into the following discussion of the example [100] of an implementation of the lighting system.

As shown in FIGS. 1 and 2, the example [100] of the implementation of the lighting system includes a light source [102] that includes a semiconductor light-emitting device [104]. As further shown in FIGS. 1 and 2, the example [100] of the lighting system includes a visible light reflector [106] and a volumetric lumiphor [108]. In another example (not shown) of the example [100] of the lighting system, the visible light reflector [106] may be omitted. In a further example (not shown) of the example [100] of the lighting system, the visible light reflector [106] may be integral with the volumetric lumiphor [108]. The semiconductor light-emitting device [104] of the example [100] of the lighting system is configured for emitting light emissions, having a first spectral power distribution, along a central axis represented by an arrow [202] and that may include, as examples, directions represented by the arrows [204], [206]. The visible light reflector [106] of the example [100] of the lighting system has a reflective surface [208] and is spaced apart along the central axis [202] at a distance away from the semiconductor light-emitting device [104]. As additionally shown in FIG. 2, the volumetric lumiphor [108] is located along the central axis [202] between the semiconductor light-emitting device [104] and the visible light reflector [106]. The volumetric lumiphor [108] may be, as shown in FIG. 2, remotely-located at a distance away from the semiconductor light-emitting device [104]. In another example (not shown), the volumetric lumiphor [108] may be in direct contact along the central axis [202] with the semiconductor light-emitting device [104]. In the example [100] of the lighting system, the light source [102] and the semiconductor light-emitting device [104] are shown in FIG. 1 as being objects having square shapes; and the visible light reflector [106] and the volumetric lumiphor [108] are shown in FIG. 1 as being objects having circular shapes. In other examples (not shown) of the example [100] of the lighting system, the light source [102], the semiconductor light-emitting device [104], the visible light reflector [106], and the volumetric lumiphor [108] may each independently be objects having other shapes and other relative sizes than their shapes and relative sizes as shown in FIG. 1.

The volumetric lumiphor [108] of the example [100] of the lighting system is configured for converting some of the light emissions [204], [206] of the semiconductor light-emitting device [104] having the first spectral power distribution into light emissions represented by the arrows [210], [212] having a second spectral power distribution being different than the first spectral power distribution. In the example [100] of the lighting system, the reflective surface [208] of the visible light reflector [106] is configured for causing a portion of the light emissions [204], [206] having the first spectral power distribution and a portion of the light emissions [210], [212] having the second spectral power distribution to be reflected in directions represented by the arrows [214], [216], [218], [220] by the visible light reflector [106]. The visible light reflector [106] is further configured for permitting another portion of the light emissions having the first spectral power distribution and another portion of the light emissions having the second spectral power distribution to be transmitted through the visible light reflector [106] along the central axis [202]. For example, the visible light reflector [106] may be configured for permitting the another portions of the light emissions having the first and second spectral power distributions to be transmitted through the visible light reflector [106] in the direction of the central axis [202]. Further, for example, the visible light reflector [106] may be configured for permitting the another portions of the light emissions having the first and second spectral power distributions to be transmitted through the visible light reflector [106]: in the direction of the central axis [202]; and in the examples represented by the arrows A, B, C, D, E and F of a plurality of other generally similar directions.

As an example, the reflective surface [208] of the visible light reflector [106] in the example [100] of the lighting system may be configured for causing the portions of the light emissions [214], [216], [218], [220] having the first and second spectral power distributions that are reflected by the visible light reflector [106] to have reflectance values throughout the visible light spectrum being within a range of about 0.80 and about 0.95. In another example, the visible light reflector [106] in the example [100] of the lighting system may be configured for causing the another portions of the light emissions having the first and second spectral power distributions that are transmitted through the visible light reflector [106] to have transmittance values throughout the visible light spectrum being within a range of about 0.20 and about 0.05. Further, for example, the reflective surface [208] of the visible light reflector [106] in the example [100]

of the lighting system may be configured for causing some of the light emissions [214], [216], [218], [220] having the first and second spectral power distributions that are reflected by the visible light reflector [106] to be redirected in a plurality of lateral directions away from the central axis [202].

As examples, the volumetric lumiphor [108] of the example [100] of the lighting system may include: a phosphor; a quantum dot; a quantum wire; a quantum well; a photonic nanocrystal; a semiconducting nanoparticle; a scintillator; a lumiphoric ink; a lumiphoric organic dye; or a day glow tape. Further, for example, the volumetric lumiphor [108] of the example [100] of the lighting system may be configured for down-converting some of the light emissions [204], [206] of the semiconductor light-emitting device [104] having wavelengths of the first spectral power distribution into light emissions [210], [212] having wavelengths of the second spectral power distribution as being longer than wavelengths of the first spectral power distribution. As examples, the semiconductor light-emitting device [104] of the example [100] of the lighting system may be configured for emitting light having a dominant- or peak-wavelength being: within a range of between about 380 nanometers and about 530 nanometers; or being within a range of between about 420 nanometers and about 510 nanometers; or being within a range of between about 445 nanometers and about 490 nanometers. In another example, the semiconductor light-emitting device [104] of the example [100] of the lighting system may be configured for emitting light having a color point being greenish-blue, blue, or purplish-blue.

Further, for example, the semiconductor light-emitting device [104] of the example [100] of the lighting system may be configured for emitting light with the first spectral power distribution as having a dominant- or peak-wavelength being within a range of between about 445 nanometers and about 490 nanometers; and the volumetric lumiphor [108] may be configured for down-converting some of the light emissions of the semiconductor light-emitting device [104] having wavelengths of the first spectral power distribution into light emissions having wavelengths of the second spectral power distribution as having a perceived color point being within a range of between about 491 nanometers and about 575 nanometers. In that example, configuring the volumetric lumiphor [108] for down-converting some of the light emissions of the semiconductor light-emitting device [104] into light emissions having wavelengths of the second spectral power distribution may include providing the volumetric lumiphor [108] as including a first lumiphor that generates light emissions having a perceived color point being within the range of between about 491 nanometers and about 575 nanometers, wherein the first lumiphor includes: a phosphor; a quantum dot; a quantum wire; a quantum well; a photonic nanocrystal; a semiconducting nanoparticle; a scintillator; a lumiphoric ink; a lumiphoric organic dye; or a day glow tape.

In another example, the semiconductor light-emitting device [104] of the example [100] of the lighting system may be configured for emitting light with the first spectral power distribution as having a dominant- or peak-wavelength being within a range of between about 445 nanometers and about 490 nanometers; and the volumetric lumiphor [108] may be configured for down-converting some of the light emissions of the semiconductor light-emitting device [104] having wavelengths of the first spectral power distribution into light emissions having wavelengths of a third spectral power distribution having a perceived color point being within a range of between about 610 nanometers and about 670 nanometers. In that example, configuring the volumetric lumiphor [108] for down-converting some of the light emissions of the semiconductor light-emitting device [104] into light emissions having wavelengths of the third spectral power distribution may also include providing the volumetric lumiphor [108] as including a second lumiphor that generates light emissions having a perceived color point being within the range of between about 610 nanometers and about 670 nanometers, wherein the second lumiphor includes: a phosphor; a quantum dot; a quantum wire; a quantum well; a photonic nanocrystal; a semiconducting nanoparticle; a scintillator; a lumiphoric ink; a lumiphoric organic dye; or a day glow tape.

In an additional example, the volumetric lumiphor [108] of the example [100] of the lighting system may include: a first lumiphor that generates light emissions having a second spectral power distribution with a perceived color point being within the range of between about 491 nanometers and about 575 nanometers; and a second lumiphor that generates light emissions having a third spectral power distribution with a perceived color point being within the range of between about 610 nanometers and about 670 nanometers. Further in that additional example, the semiconductor light-emitting device [104] of the example [100] of the lighting system may be configured for emitting light with the first spectral power distribution as having a dominant- or peak-wavelength being within a range of between about 445 nanometers and about 490 nanometers. As a further example of the example [100] of the lighting system, the first lumiphor may include a first quantum material, and the second lumiphor may include a different second quantum material, and the first and second quantum materials may both have spectral power distributions for light absorption being separate from the second and third spectral power distributions of their respective light emissions. In this further example, cross-absorption of light emissions among the two different quantum materials of the lumiphor [108] may be minimized, which may result in an increased luminous flux, and an increased CRI-Ra, of the light emissions of the example [100] of the lighting system. Further, for example, the example [100] of the lighting system may include three, four, or five, or more different quantum materials each having a spectral power distribution for light absorption being separate from the second and third spectral power distributions and from any further spectral power distributions of the light emissions of the quantum materials. In additional examples, the example [100] of the lighting system may be configured for generating light emissions having a selected total luminous flux, such as, for example, 500 lumens, or 1,500 lumens, or 5,000 lumens. As examples, configuring the example [100] of the lighting system for generating light emissions having such a selected total luminous flux may include: selecting particular luminescent materials for or varying the concentrations of one or more luminescent materials or light-scattering particles in the volumetric lumiphor [108]; and varying a total luminous flux of the light emissions from the semiconductor light-emitting device [104].

As another example, the example [100] of the lighting system may be configured for forming combined light emissions [222] by causing some or most of the light emissions [214], [216] having the first spectral power distribution to be redirected in a plurality of directions represented by the arrows [224], [226] intersecting the central axis [202] and combined together with some or most of the light emissions [218], [220] having the second spectral power distribution being redirected in a plurality of directions represented by the arrows [228], [230] intersecting the central axis [202]; and the example [100] of the lighting system may be configured for causing some or most of the combined light emissions [222] to be emitted from the example [100] of the lighting system in the plurality of directions [224], [226], [228], [230] intersecting the central axis [202]. As a further example, the example [100] of the lighting system may be configured for forming combined light emissions [222] by causing some or most of the light emissions [214], [216] having the first spectral power distribution to be redirected in a plurality of directions represented by the arrows [232], [234] diverging away from the central axis [202] and causing some or most of the light emissions [218], [220] having the second spectral power distribution to be redirected in a plurality of directions represented by the arrows [236], [238] diverging away from the central axis [202]; and the example [100] of the lighting system may be configured for causing some or most of the combined light emissions [222] to be emitted from the example [100] of the lighting system in the plurality of directions [232], [234], [236], [238] diverging away from the central axis [202].

Further, for example, the example [100] of the lighting system may be configured for causing the light emissions having the first and second spectral power distributions to be combined together forming combined light emissions [222] having a color point with a color rendition index (CRI-Ra including $R_{1-8}$ or including $R_{1-15}$) being: about equal to or greater than 50; or about equal to or greater than 75; or about equal to or greater than 95. Additionally, for example, the example [100] of the lighting system may be configured for causing the light emissions having the first and second spectral power distributions to be combined together forming combined light emissions [222] having a color point with a color rendition index (CRI-$R_9$) being: about equal to or greater than 50; or about equal to or greater than 75; or about equal to or greater than 90. In another example, the example [100] of the lighting system may be configured for causing light emissions having first, second and third spectral power distributions to be combined together forming combined light emissions [222] having a color point with a color rendition index (CRI-Ra including $R_{1-8}$ or including $R_{1-15}$) being: about equal to or greater than 50; or about equal to or greater than 75; or about equal to or greater than 95. In other examples, the example [100] of the lighting system may be configured for causing light emissions having first, second and third spectral power distributions to be combined together forming combined light emissions [222] having a color point with a color rendition index (CRI-$R_9$) being: about equal to or greater than 50; or about equal to or greater than 75; or about equal to or greater than 90.

In another example, the example [100] of the lighting system may be configured for causing some or most of the light emissions having the first and second spectral power distributions, or configured for causing some or most of the light emissions having first, second and third spectral power distributions, to be combined together to form combined light emissions [222] having a color point being: within a distance of about equal to or less than about +/−0.009 delta(uv) away from the Planckian—black-body locus throughout a spectrum of correlated color temperatures (CCTs) within a range of between about 1800K and about 6500K or within a range of between about 2400K and about 4000K; or below the Planckian—black-body locus by a distance of about equal to or less than about 0.009 delta(uv) throughout a spectrum of correlated color temperatures (CCTs) within a range of between about 1800K and about 6500K or within a range of between about 2400K and about 4000K. As an example, configuring the example [100] of the lighting system for causing some or most of the light emissions to be so combined together to form combined light emissions [222] having such a color point may include providing the volumetric lumiphor [108] being, as shown in FIG. 2, remotely-located at a distance away from the semiconductor light-emitting device [104].

Figure 3:
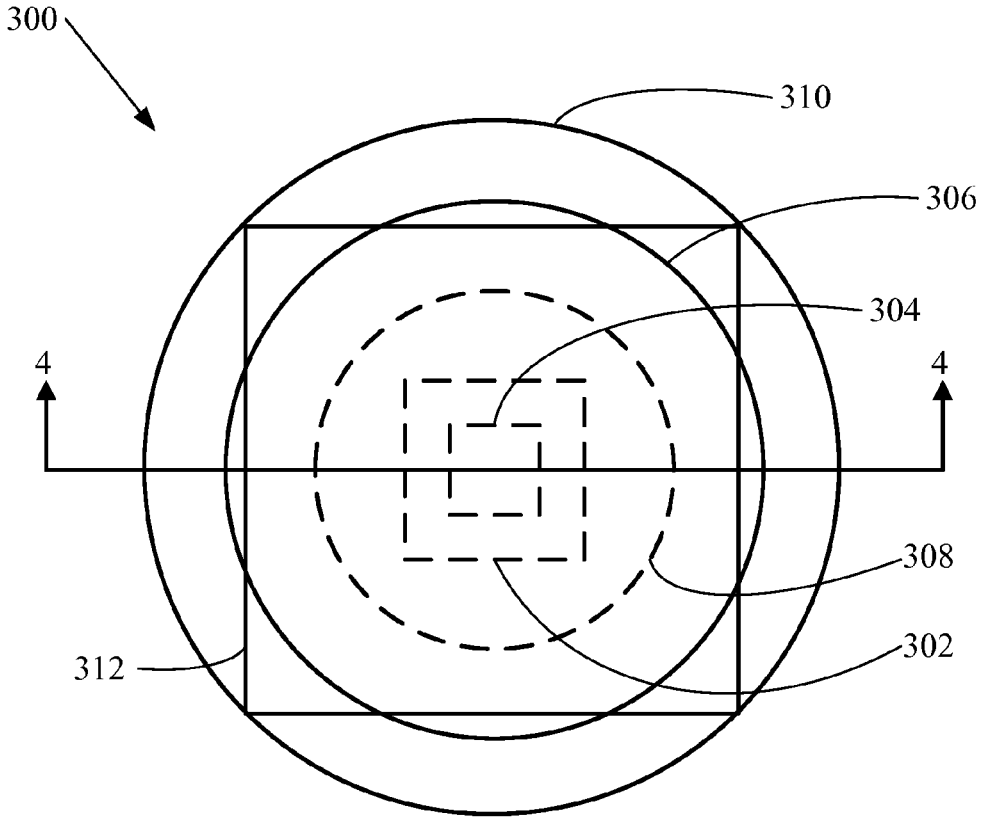
FIG. 3 is a schematic top view showing another example of an implementation of a lighting system.
Figure 4:
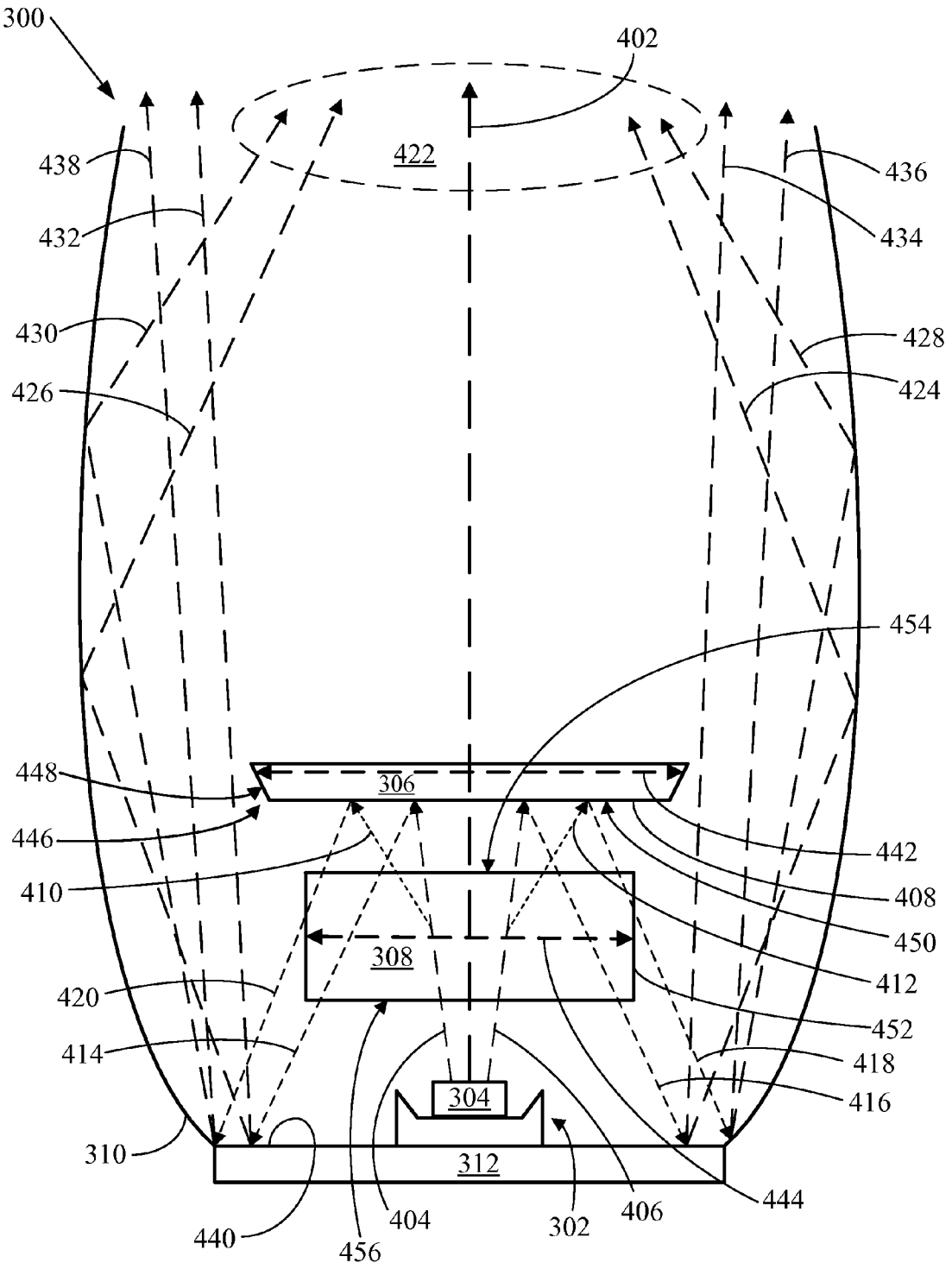
FIG. 4 is a schematic cross-sectional view taken along the line 4-4 showing the another example of the lighting system.

FIG. 3 is a schematic top view showing another example [300] of an implementation of a lighting system. FIG. 4 is a schematic cross-sectional view taken along the line 4-4 showing the another example [300] of the lighting system. Another example [100] of an implementation of the lighting system was earlier discussed in connection with FIGS. 1-2. A further example [500] of an implementation of the lighting system will subsequently be discussed in connection with FIGS. 5-6. An additional example [700] of an implementation of the lighting system will subsequently be discussed in connection with FIGS. 7-8. An example [900] of an implementation of a lighting process will be subsequently discussed in connection with FIG. 9. It is understood throughout this specification that the example [300] of an implementation of the lighting system may be modified as including any of the features or combinations of features that are disclosed in connection with: the another example [100] of an implementation of the lighting system; or the further example [500] of an implementation of the lighting system; or the additional example [700] of an implementation of the lighting system; or the example [900] of an implementation of a lighting process. Accordingly, FIGS. 1-2 and 5-9 and the entireties of the earlier discussion of the examples [100] of implementations of the lighting system and the subsequent discussions of the examples [500] and [700] of implementations of the lighting system and of the example [900] of an implementation of a lighting process are hereby incorporated into the following discussion of the example [300] of an implementation of the lighting system.

As shown in FIGS. 3 and 4, the example [300] of the implementation of the lighting system includes a light source [302] that includes a semiconductor light-emitting device [304]. As further shown in FIGS. 3 and 4, the example [300] of the lighting system includes a visible light reflector [306], a volumetric lumiphor [308], and a primary visible light reflector [310]. In another example (not shown) of the example [300] of the lighting system, the visible light reflector [306] may be omitted. Further for example, as shown in FIGS. 3-4, the primary visible light reflector [310] may include a truncated parabolic reflector. The semiconductor light-emitting device [304] of the example [300] of the lighting system is configured for emitting light emissions having a first spectral power distribution along a central axis represented by an arrow [402], and that may include, as examples, directions represented by the arrows [404], [406]. The visible light reflector [306] of the example [300] of the lighting system has a reflective surface [408] and is spaced apart along the central axis [402] at a distance away from the semiconductor light-emitting device [304]. As additionally shown in FIG. 4, the volumetric lumiphor [308] is located along the central axis [402] between the semiconductor light-emitting device [304] and the visible light reflector [306]. The volumetric lumiphor [308] may be, as shown in FIG. 4, remotely-located at a distance away from the semiconductor light-emitting device [304]. In another example (not shown), the volumetric lumiphor [308] may be in direct contact along the central axis [402] with the semiconductor light-emitting device [304]. Further, the volumetric lumiphor [308] of the example [300] of the lighting system is configured for converting some of the light emissions [404], [406] of the semiconductor light-emitting device [304] having the first spectral power distribution into light emissions represented by the arrows [410], [412] having a second spectral power distribution being different than the first spectral power distribution. In the example [300] of the lighting system, the reflective surface [408] of the visible light reflector [306] is configured for causing a portion of the light emissions [404], [406] having the first spectral power distribution and a portion of the light emissions [410], [412] having the second spectral power distribution to be reflected in directions represented by the arrows [414], [416], [418], [420] by the visible light reflector [306]. The visible light reflector [306] may be, as examples, further configured for permitting another portion of the light emissions having the first spectral power distribution and another portion of the light emissions having the second spectral power distribution to be transmitted through the visible light reflector [306] along the central axis [402].

In this example [300] of the lighting system, the reflective surface [408] of the visible light reflector [306] may be configured for causing some of the light emissions having the first and second spectral power distributions that are reflected by the visible light reflector [306] to be redirected in a plurality of lateral directions [414], [416], [418], [420] away from the central axis [402]. As another example, the primary visible light reflector [310] may be configured for causing some or most of the light emissions to be redirected from the lateral directions [414], [416], [418], [420] in a plurality of directions represented by the arrows [424], [426], [428], [430] intersecting the central axis [402]. In a further example of the example [300] of the lighting system, the semiconductor light-emitting device [304] may be configured for emitting the light emissions of the first spectral power distribution as having a luminous flux of a first magnitude, and the example [300] of the lighting system may be configured for causing the some or most of the light emissions that are redirected in the plurality of directions [424], [426], [428], [430] intersecting the central axis [402] to have a luminous flux of a second magnitude being: at least about 50% as great as the first magnitude; or at least about 80% as great as the first magnitude.

As another example, the example [300] of the lighting system may be configured for forming combined light emissions [422] by causing some or most of the light emissions [414], [416] having the first spectral power distribution to be combined together with some or most of the light emissions [418], [420] having the second spectral power distribution; and the example [300] of the lighting system may be configured for causing some or most of the combined light emissions [422] to be emitted from the example [300] of the lighting system in a plurality of directions [424], [426], [428], [430] intersecting the central axis [402]. In an additional example, the example [300] of the lighting system may be configured for forming combined light emissions [422] by causing some or most of the light emissions [414], [416] having the first spectral power distribution to be combined together with some or most of the light emissions [418], [420] having the second spectral power distribution; and the example [300] of the lighting system may be configured for causing some or most of the combined light emissions to be emitted from the example [300] of the lighting system in a plurality of directions represented by the arrows [432], [434], [436], [438] diverging away from the central axis [402]. Further, for example, the example [300] of the lighting system may be configured for causing the light emissions having the first and second spectral power distributions to be combined together forming combined light emissions [422] having a color point with a color rendition index (CRI-Ra including $R_{1-8}$ or including $R_{1-15}$) being: about equal to or greater than 50; or about equal to or greater than 75; or about equal to or greater than 95. Additionally, for example, the example [300] of the lighting system may be configured for causing the light emissions having the first and second spectral power distributions to be combined together forming combined light emissions [422] having a color point with a color rendition index (CRI-$R_9$) being: about equal to or greater than 50; or about equal to or greater than 75; or about equal to or greater than 90.

The example [300] of the lighting system may, for example, include another visible light reflector [312]. As an example, the semiconductor light-emitting device [304] in the example [300] of the lighting system may be located along the central axis [402] between the another visible light reflector [312] and the volumetric lumiphor [308]. Further, for example, the another visible light reflector [312] may have another reflective surface [440] being configured for causing some of the light emissions having the first and second spectral power distributions to be reflected by the another visible light reflector [312]. As an example, the another reflective surface [440] of the another visible light reflector [312] may be configured for causing some of the light emissions [414], [416], [418], [420] that are reflected by the visible light reflector [306] to be redirected by the another visible light reflector [312] in a plurality of lateral directions [432], [434], [436], [438] away from the central axis [402]. In another example, the example [300] of the lighting system may include another semiconductor light-emitting device (not shown), being located adjacent to the semiconductor light-emitting device [304] and being located between the another visible light reflector [312] and the volumetric lumiphor [308]. In that example, the another semiconductor light-emitting device may, for example, be configured for emitting light having a dominant- or peak-wavelength being within a range of between about 380 nanometers and about 530 nanometers.

In the example [300] of the lighting system, the visible light reflector [306] may, for example, have a shape that extends away from the central axis [402] in directions being transverse to the central axis [402]. In that example, the shape of the visible light reflector [306] may, for example, be centered on the central axis [402]. Further, for example, the shape of the visible light reflector [306] may have a maximum width in the directions transverse to the central axis [402] as represented by an arrow [442]. In the example [300] of the lighting system, the volumetric lumiphor [308] may, for example, have a shape that extends away from the central axis [402] in directions being transverse to the central axis [402]. In that example, the shape of the volumetric lumiphor [308] may, for example, be centered on the central axis [402]. Further, for example, the shape of the volumetric lumiphor [308] may have a maximum width in the directions transverse to the central axis [402] as represented by an arrow [444]. In the example [300] of the lighting system as shown in FIGS. 3-4, the maximum width of the volumetric lumiphor [308] in the directions transverse to the central axis [402] represented by the arrow [444] may be smaller than the maximum width of the visible light reflector [306] in the directions transverse to the central axis [402] represented by the arrow [442]. In another example [300] of the lighting system (not shown), the maximum width of the volumetric lumiphor [308] in the directions transverse to the central axis [402] represented by the arrow

[444] may be equal to or larger than the maximum width of the visible light reflector [306] in the directions transverse to the central axis [402] represented by the arrow [442].

Additionally, for example, a distal portion [446] of the reflective surface [408] of the visible light reflector [306] that is located at a greatest distance away from the central axis [402] may have a beveled edge [448]. As an example, the beveled edge [448] of the visible light reflector [306] may facilitate configuring the example [300] of the lighting system for causing most of the light emissions [414], [416], [418], [420] that are reflected by the reflective surface [408] of the visible light reflector [306] to be redirected by the primary visible light reflector [310] from the lateral directions [414], [416], [418], [420] in the plurality of directions [424], [426], [428], [430] intersecting the central axis [402].

As another example, a portion [450] of the reflective surface [408] of the visible light reflector [306] in the example [300] of the lighting system may be a planar reflective surface. Further, for example, the portion [450] of the reflective surface [408] of the visible light reflector [306] in the example [300] of the lighting system may face toward the semiconductor light-emitting device [304] and may extend away from the central axis [402] in directions being transverse to the central axis [402]. In the example [300] of the lighting system, the portion [450] of the reflective surface [408] of the visible light reflector [306] may for example, face toward the semiconductor light-emitting device [304]; and the volumetric lumiphor [308] may have an exterior surface [452], wherein a portion [454] of the exterior surface [452] may face toward the portion [450] of the reflective surface [408] of the visible light reflector [306]. Further, for example, the portion [454] of the exterior surface [452] of the volumetric lumiphor [308] may be configured for permitting entry into the volumetric lumiphor [308] by light emissions having the first and second spectral power distributions, including for example some of the light emissions [414], [416], [418], [420] reflected by the visible light reflector [306]. Additionally, for example, a portion [456] of the exterior surface [452] of the volumetric lumiphor [308] may face toward the semiconductor light-emitting device [304]. Further in that example, the portion [456] of the exterior surface [452] may cause some of the light emissions [404], [406] being emitted from the semiconductor light-emitting device [304] to be reflected in lateral directions towards the another visible light reflector [312].

Figure 5:
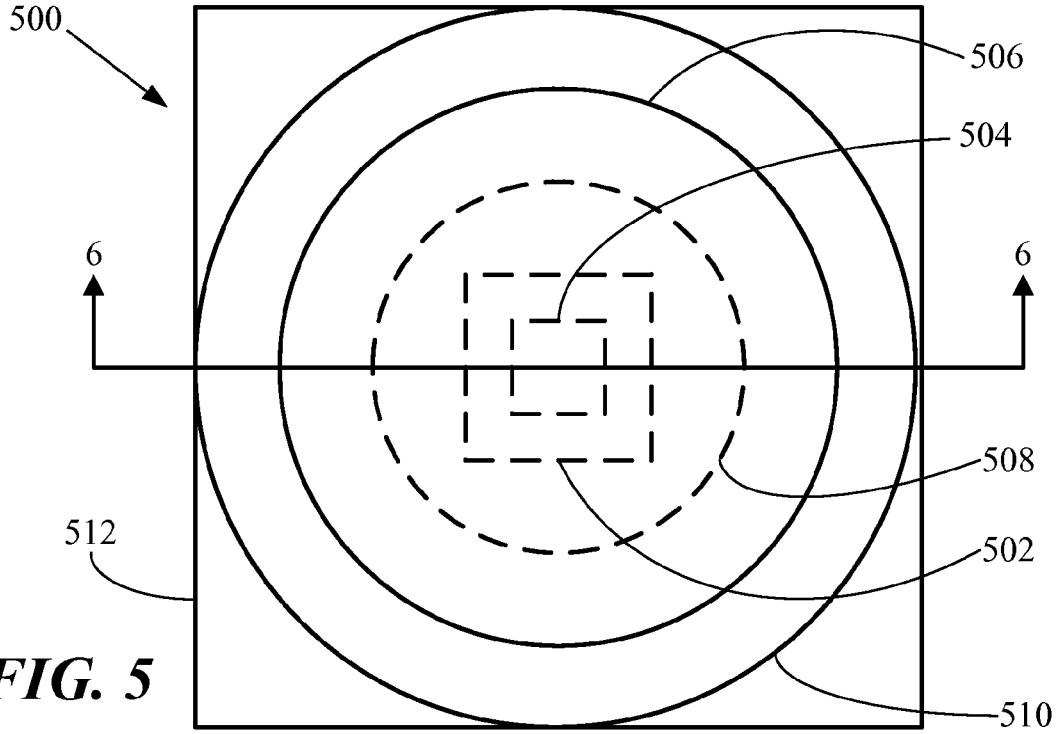
FIG. 5 is a schematic top view showing a further example of an implementation of a lighting system.
Figure 6:
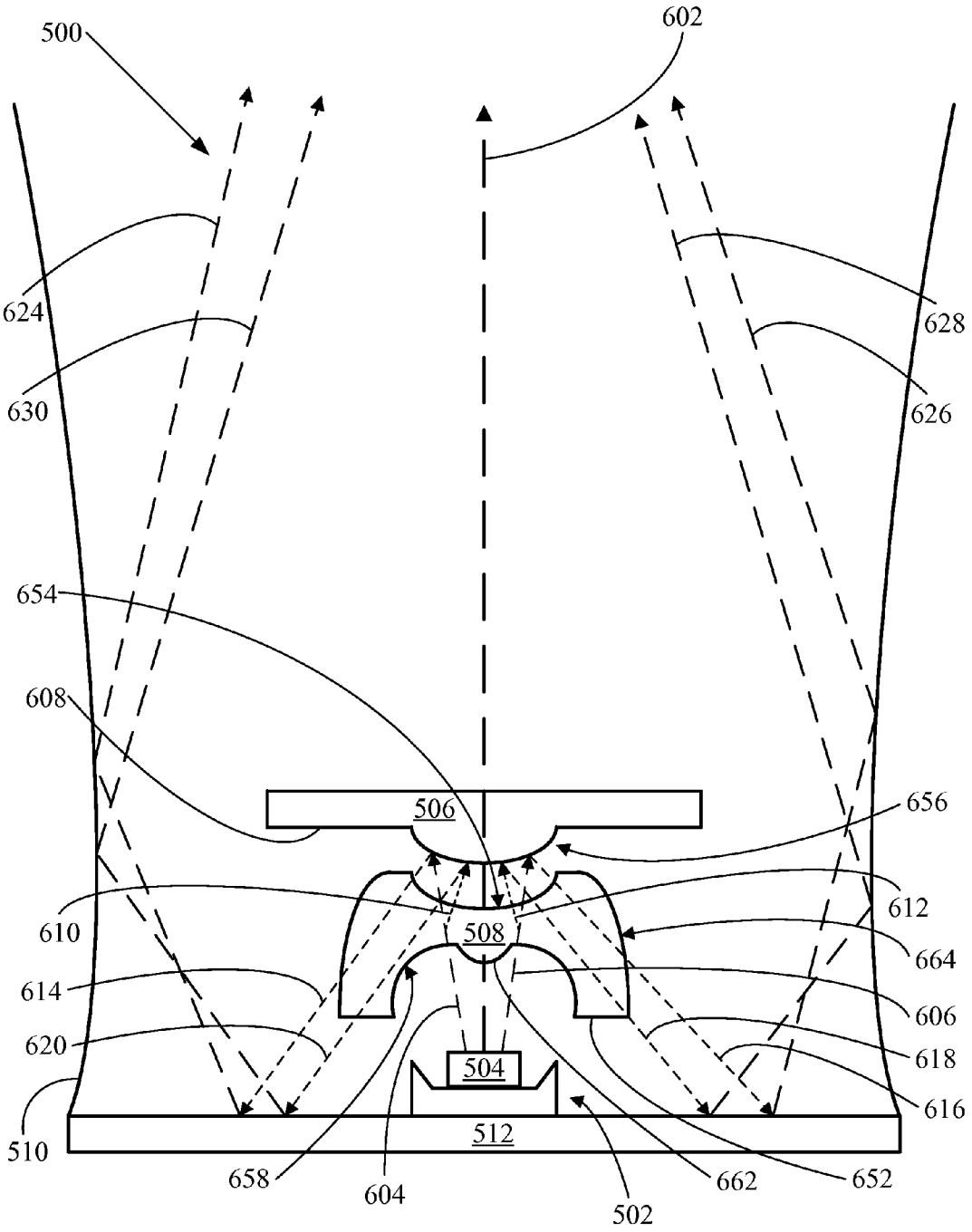
FIG. 6 is a schematic cross-sectional view taken along the line 6-6 showing the further example of the lighting system.

FIG. 5 is a schematic top view showing a further example [500] of an implementation of a lighting system. FIG. 6 is a schematic cross-sectional view taken along the line 6-6 showing the further example [500] of the lighting system. Another example [100] of an implementation of the lighting system was earlier discussed in connection with FIGS. 1-2. A further example [300] of an implementation of the lighting system was earlier discussed in connection with FIGS. 3-4. An additional example [700] of an implementation of the lighting system will subsequently be discussed in connection with FIGS. 7-8. An example [900] of an implementation of a lighting process will be subsequently discussed in connection with FIG. 9. It is understood throughout this specification that the example [500] of an implementation of the lighting system may be modified as including any of the features or combinations of features that are disclosed in connection with: the another example [100] of an implementation of the lighting system; or the further example [300] of an implementation of the lighting system; or the additional example [700] of an implementation of the lighting system; or the example [900] of an implementation of a lighting process. Accordingly, FIGS. 1-4 and 7-9 and the entireties of the earlier discussion of the examples [100] and [300] of implementations of the lighting system and the subsequent discussion of the examples [700] of implementations of the lighting system and of the example [900] of an implementation of a lighting process are hereby incorporated into the following discussion of the example [500] of an implementation of the lighting system.

As shown in FIGS. 5 and 6, the example [500] of the implementation of the lighting system includes a light source [502] that includes a semiconductor light-emitting device [504]. As further shown in FIGS. 5 and 6, the example [500] of the lighting system includes a visible light reflector [506], a volumetric lumiphor [508], and a primary visible light reflector [510]. In another example (not shown) of the example [500] of the lighting system, the visible light reflector [506] may be omitted. Further for example, as shown in FIGS. 5-6, the primary visible light reflector [510] may include a truncated conical reflector. The semiconductor light-emitting device [504] of the example [500] of the lighting system is configured for emitting light emissions, having a first spectral power distribution, along a central axis represented by an arrow [602], and that may include, as examples, directions represented by the arrows [604], [606]. The visible light reflector [506] of the example [500] of the lighting system has a reflective surface [608] and is spaced apart along the central axis [602] at a distance away from the semiconductor light-emitting device [504]. As additionally shown in FIG. 6, the volumetric lumiphor [508] is located along the central axis [602] between the semiconductor light-emitting device [504] and the visible light reflector [506]. The volumetric lumiphor [508] may be, as shown in FIG. 6, remotely-located at a distance away from the semiconductor light-emitting device [504]. In another example (not shown), the volumetric lumiphor [508] may be in direct contact along the central axis [602] with the semiconductor light-emitting device [504]. The example [500] of the lighting system may, for example, include another visible light reflector [512]. Further, the volumetric lumiphor [508] of the example [500] of the lighting system is configured for converting some of the light emissions [604], [606] of the semiconductor light-emitting device [504] having the first spectral power distribution into light emissions represented by the arrows [610], [612] having a second spectral power distribution being different than the first spectral power distribution. In the example [500] of the lighting system, the reflective surface [608] of the visible light reflector [506] is configured for causing a portion of the light emissions [604], [606] having the first spectral power distribution and a portion of the light emissions [610], [612] having the second spectral power distribution to be reflected in directions represented by the arrows [614], [616], [618], [620] by the visible light reflector [506]. The visible light reflector [506] may be, as examples, further configured for permitting another portion of the light emissions having the first spectral power distribution and another portion of the light emissions having the second spectral power distribution to be transmitted through the visible light reflector [506] along the central axis [602].

In this example [500] of the lighting system, the reflective surface [608] of the visible light reflector [506] may be configured for causing some of the light emissions having the first and second spectral power distributions that are reflected by the visible light reflector [506] to be redirected in a plurality of lateral directions [614], [616], [618], [620] away from the central axis [602]. As another example, the primary visible light reflector [510] may be configured for causing some or most of the light emissions having the first and second spectral power distributions, including for example some or most of the light emissions that are redirected in the lateral directions [614], [616], [618], [620], to be redirected in a plurality of directions represented by the arrows [624], [626], [628], [630] intersecting the central axis [602]. In a further example of the example [500] of the lighting system, the semiconductor light-emitting device [504] may be configured for emitting the light emissions of the first spectral power distribution as having a luminous flux of a first magnitude, and the example [500] of the lighting system may be configured for causing the some or most of the light emissions that are redirected in the plurality of directions [624], [626], [628], [630] intersecting the central axis [602] to have a luminous flux of a second magnitude being: at least about 50% as great as the first magnitude; or at least about 80% as great as the first magnitude. In an additional example, the example [500] of the lighting system may be configured for causing some or most of the light emissions [614], [616] having the first spectral power distribution and some or most of the light emissions [618], [620] having the second spectral power distribution to be emitted from the example [500] of the lighting system in a plurality of directions diverging away from the central axis [602].

In an example, a portion [656] of the reflective surface [608] of the visible light reflector [506] may be a mound-shaped reflective surface [656] facing toward the semiconductor light-emitting device [504]. In that example, a shortest distance between the semiconductor light-emitting device [504] and the portion [656] of the reflective surface [608] of the visible light reflector [506] may, as an example, be located along the central axis [602]. For example, the mound-shaped reflective surface [656] of the visible light reflector [506] may be configured for causing some of the light emissions [604], [606], [610], [612] that are reflected by the reflective surface [608] to be redirected in a plurality of lateral directions [614], [616], [618], [620] away from the central axis [602].

As another example, the portion [656] of the reflective surface [608] of the visible light reflector [506] in the example [500] of the lighting system may be a mound-shaped reflective surface [656] facing toward the semiconductor light-emitting device [504]. As an additional example, the mound-shaped reflective surface [656] of the visible light reflector [506] may be configured for causing some of the light emissions [604], [606], [610], [612] that are reflected by the reflective surface [608] to be redirected in a plurality of lateral directions [614], [616], [618], [620] away from the central axis [602]. Further, for example, the volumetric lumiphor [508] may have an exterior surface [652], wherein a portion [654] of the exterior surface [652] is a concave exterior surface [654] being configured for receiving the mound-shaped reflective surface [656] of the visible light reflector [506]. In that example [500], the lighting system may be configured for causing some of the light emissions having the first and second spectral power distributions to be emitted as represented by the arrows [604], [606], [610], [612] through the concave exterior surface [654] of the volumetric lumiphor [508]; and the reflective surface [656] of the visible light reflector [506] may be configured for causing some of the light emissions having the first and second spectral power distributions to be reflected by the reflective surface [608] and to enter into the volumetric lumiphor [508] through the concave exterior surface [654]. In an example, the concave exterior surface [654] of the volumetric lumiphor [508] may be spaced apart along the central axis [602] from the mound-shaped reflective surface [656] of the visible light reflector [506]. In another example (not shown), the concave exterior surface [654] of the volumetric lumiphor [508] may receive and be in direct contact with the mound-shaped reflective surface [656] of the visible light reflector [506].

In another example, the volumetric lumiphor [508] of the example [500] of the lighting system may have the exterior surface [652], wherein a portion [658] of the exterior surface [652] of the volumetric lumiphor [508] is a concave exterior surface [658] forming a gap between the semiconductor light-emitting device [504] and the volumetric lumiphor [508]. In that example, the example [500] of the lighting system may be configured for causing entry of some the light emissions [604], [606] having the first spectral power distribution into the volumetric lumiphor [508] through the concave exterior surface [658]; and the volumetric lumiphor [508] may be configured for causing refraction of some of the light emissions [604], [606] having the first spectral power distribution in a plurality of lateral directions [610], [612]. Further in that example, the concave exterior surface [658] may cause some of the light emissions [604], [606] being emitted from the semiconductor light-emitting device [504] to be reflected in lateral directions towards the another visible light reflector [512].

As an additional example of the example [500] of the lighting system, the concave exterior surface [658] of the volumetric lumiphor [508] may include, and surround, a convex exterior surface [662]. Further in that example, the convex exterior surface [662] may additionally cause some of the light emissions [604], [606] being emitted from the semiconductor light-emitting device [504] to be reflected in lateral directions towards the another visible light reflector [512].

As an additional example, the volumetric lumiphor [508] of the example [500] of the lighting system may have the exterior surface [652], and a portion [664] of the exterior surface [652] may be a convex exterior surface [664] being located at a distance away from and surrounding the central axis [602]. Further in that additional example, the example [500] of the lighting system may be configured for causing some of the light emissions having the first and second spectral power distributions to enter into and be emitted from the volumetric lumiphor [508] through the convex exterior surface [664]; and the volumetric lumiphor [508] may be configured for causing refraction of some of the light emissions.

Figure 7:
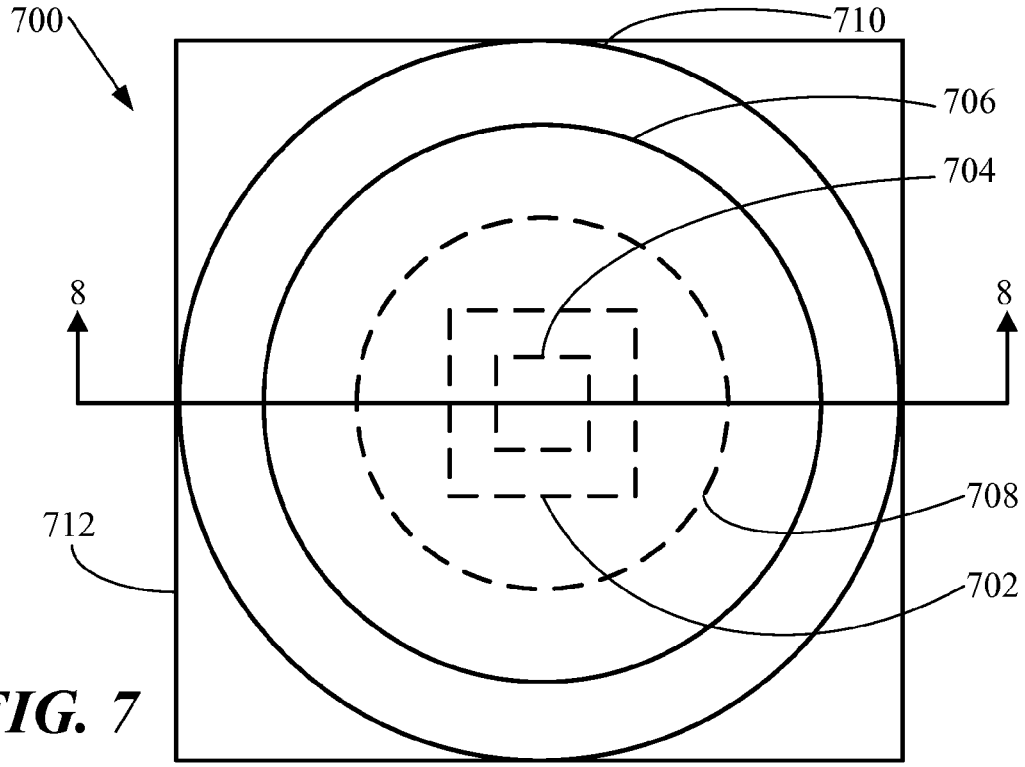
FIG. 7 is a schematic top view showing an additional example of an implementation of a lighting system.
Figure 8:
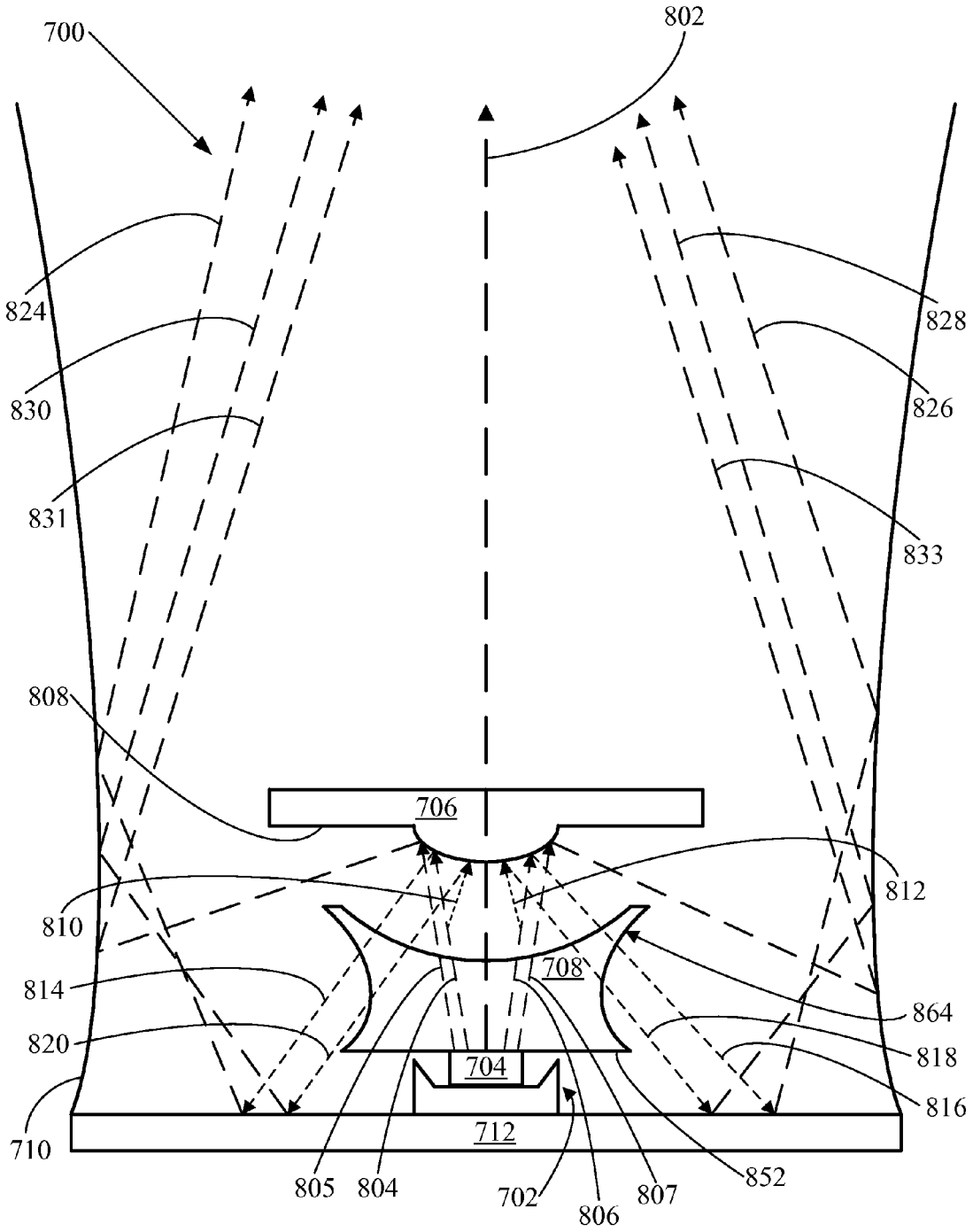
FIG. 8 is a schematic cross-sectional view taken along the line 8-8 showing the additional example of the lighting system.

FIG. 7 is a schematic top view showing an additional example [700] of an implementation of a lighting system. FIG. 8 is a schematic cross-sectional view taken along the line 8-8 showing the additional example [700] of the lighting system. Another example [100] of an implementation of the lighting system was earlier discussed in connection with FIGS. 1-2. A further example [300] of an implementation of the lighting system was earlier discussed in connection with FIGS. 3-4. An additional example [500] of an implementation of the lighting system was earlier discussed in connection with FIGS. 5-6. An example [900] of an implementation of a lighting process will be subsequently discussed in connection with FIG. 9. It is understood throughout this specification that the example [700] of an implementation of the lighting system may be modified as including any of the features or combinations of features that are disclosed in connection with: the another example [100] of an implementation of the lighting system; or the further example [300] of an implementation of the lighting system; or the additional example [500] of an implementation of the lighting system; or the example [900] of an implementation of a lighting process. Accordingly, FIGS. 1-6 and 9 and the entireties of the earlier discussion of the examples [100], [300], [500] of implementations of the lighting system and the subsequent discussion of the example [900] of an implementation of a lighting process are hereby incorporated into the following discussion of the example [700] of an implementation of the lighting system.

As shown in FIGS. 7 and 8, the example [700] of the implementation of the lighting system includes a light source [702] that includes a semiconductor light-emitting device [704]. As further shown in FIGS. 7 and 8, the example [700] of the lighting system includes a visible light reflector [706], a volumetric lumiphor [708], and a primary total internal reflection lens [710]. In another example (not shown) of the example [700] of the lighting system, the visible light reflector [706] may be omitted. The semiconductor light-emitting device [704] of the example [700] of the lighting system is configured for emitting light emissions, having a first spectral power distribution, along a central axis represented by an arrow [802], and that may include, as examples, directions represented by the arrows [804], [806]. The visible light reflector [706] of the example [700] of the lighting system has a reflective surface [808] and is spaced apart along the central axis [802] at a distance away from the semiconductor light-emitting device [704]. As additionally shown in FIG. 8, the volumetric lumiphor [708] is located along the central axis [802] between the semiconductor light-emitting device [704] and the visible light reflector [706]. The volumetric lumiphor [708] may be, as shown in FIG. 8, in direct contact along the central axis [802] with the semiconductor light-emitting device [704]. In another example (not shown), the volumetric lumiphor [708] may be remotely-located at a distance away from the semiconductor light-emitting device [704]. The example [700] of the lighting system may, for example, include another visible light reflector [712]. Further, the volumetric lumiphor [708] of the example [700] of the lighting system is configured for converting some of the light emissions [804], [806] of the semiconductor light-emitting device [704] having the first spectral power distribution into light emissions represented by the arrows [810], [812] having a second spectral power distribution being different than the first spectral power distribution. In the example [700] of the lighting system, the reflective surface [808] of the visible light reflector [706] is configured for causing a portion of the light emissions [804], [806] having the first spectral power distribution and a portion of the light emissions [810], [812] having the second spectral power distribution to be reflected, as examples in directions represented by the arrows [814], [816], [818], [820], by the visible light reflector [706]. The visible light reflector [706] may be, as examples, further configured for permitting another portion of the light emissions having the first spectral power distribution and another portion of the light emissions having the second spectral power distribution to be transmitted through the visible light reflector [706] along the central axis [802].

In this example [700] of the lighting system, the reflective surface [808] of the visible light reflector [706] may be configured for causing some of the light emissions having the first and second spectral power distributions that are reflected by the visible light reflector [706] to be redirected in a plurality of lateral directions [814], [816], [818], [820] away from the central axis [802]. As another example, the primary total internal reflection lens [710] may be configured for causing some or most of the light emissions, examples including the light emissions redirected in the lateral directions [814], [816], [818], [820], to be redirected in a plurality of directions represented by the arrows [824], [826], [828], [830] intersecting the central axis [802]. In further examples of this example [700] of the lighting system, the reflective surface [808] of the visible light reflector [706] may be configured for causing some of the light emissions represented by the arrows [805], [807] having the first spectral power distribution that are reflected by the visible light reflector [706], and some of the light emissions (not shown) having the second spectral power distribution that are likewise reflected by the visible light reflector [706], to be redirected in a plurality of directions represented by the arrows [831], [833] laterally away from the central axis [802] and then directly reflected by the primary total internal reflection lens [710]. In a further example of the example [700] of the lighting system, the semiconductor light-emitting device [704] may be configured for emitting the light emissions of the first spectral power distribution as having a luminous flux of a first magnitude, and the example [700] of the lighting system may be configured for causing the some or most of the light emissions that are redirected in the plurality of directions [824], [826], [828], [830] intersecting the central axis [802] to have a luminous flux of a second magnitude being: at least about 50% as great as the first magnitude; or at least about 80% as great as the first magnitude. In an additional example, the example [700] of the lighting system may be configured for causing some or most of the light emissions [814], [816] having the first spectral power distribution and some or most of the light emissions [818], [820] having the second spectral power distribution to be emitted from the example [700] of the lighting system in a plurality of directions diverging away from the central axis [802].

In a further example (not shown) the primary total internal reflection lens [710] may be substituted by a light guide being configured for causing some or most of the light emissions, examples including the light emissions redirected in the lateral directions [814], [816], [818], [820], to be redirected in a plurality of other directions being different than the lateral directions.

As an additional example, the volumetric lumiphor [708] of the example [700] of the lighting system may have an exterior surface [852], and a portion [864] of the exterior surface [852] may be a concave exterior surface [864] being located at a distance away from and surrounding the central axis [802]. Further in that additional example, the example [700] of the lighting system may be configured for causing some of the light emissions having the first and second spectral power distributions to enter into and be emitted from the volumetric lumiphor [708] through the concave exterior surface [864]; and the volumetric lumiphor [708] may be configured for causing refraction of some of the light emissions.

It is understood throughout this specification that an example [100], [300], [500], [700] of a lighting system may include any combination of the features discussed in connection with the examples [100], [300], [500], [700] of a lighting system. For example, it is understood throughout this specification that an example [100], [300], [500], [700] of a lighting system may include a volumetric lumiphor [108], [308], [508], [708] that includes any combination of the features discussed in connection with the examples [100], [300], [500], [700] of a lighting system, such as: an exterior surface [452], [652], [852]; a portion [454] of the exterior surface of the volumetric lumiphor [108], [308], [508], [708] facing toward a portion of the reflective surface [208], [408], [608], [808] of the visible light reflector [106], [306], [506], [706]; a concave exterior surface [654] of the volumetric lumiphor [108], [308], [508], [708] being configured for receiving a mound-shaped reflective surface [656] of the visible light reflector [106], [306], [506], [706]; a concave exterior surface [658] of the volumetric lumiphor [108], [308], [508], [708] forming a gap between the semiconductor light-emitting device [104], [304], [504], [704] and the volumetric lumiphor [108], [308], [508], [708]; a concave exterior surface [658] further including and surrounding a convex exterior surface [662] of the volumetric lumiphor [108], [308], [508], [708]; a convex exterior surface [664] of the volumetric lumiphor [108], [308], [508], [708] being located at a distance away from and surrounding the central axis [202], [402], [602], [802]; or a concave exterior surface [864] of the volumetric lumiphor [108], [308], [508], [708] being located at a distance away from and surrounding the central axis [202], [402], [602], [802].

Figure 9:
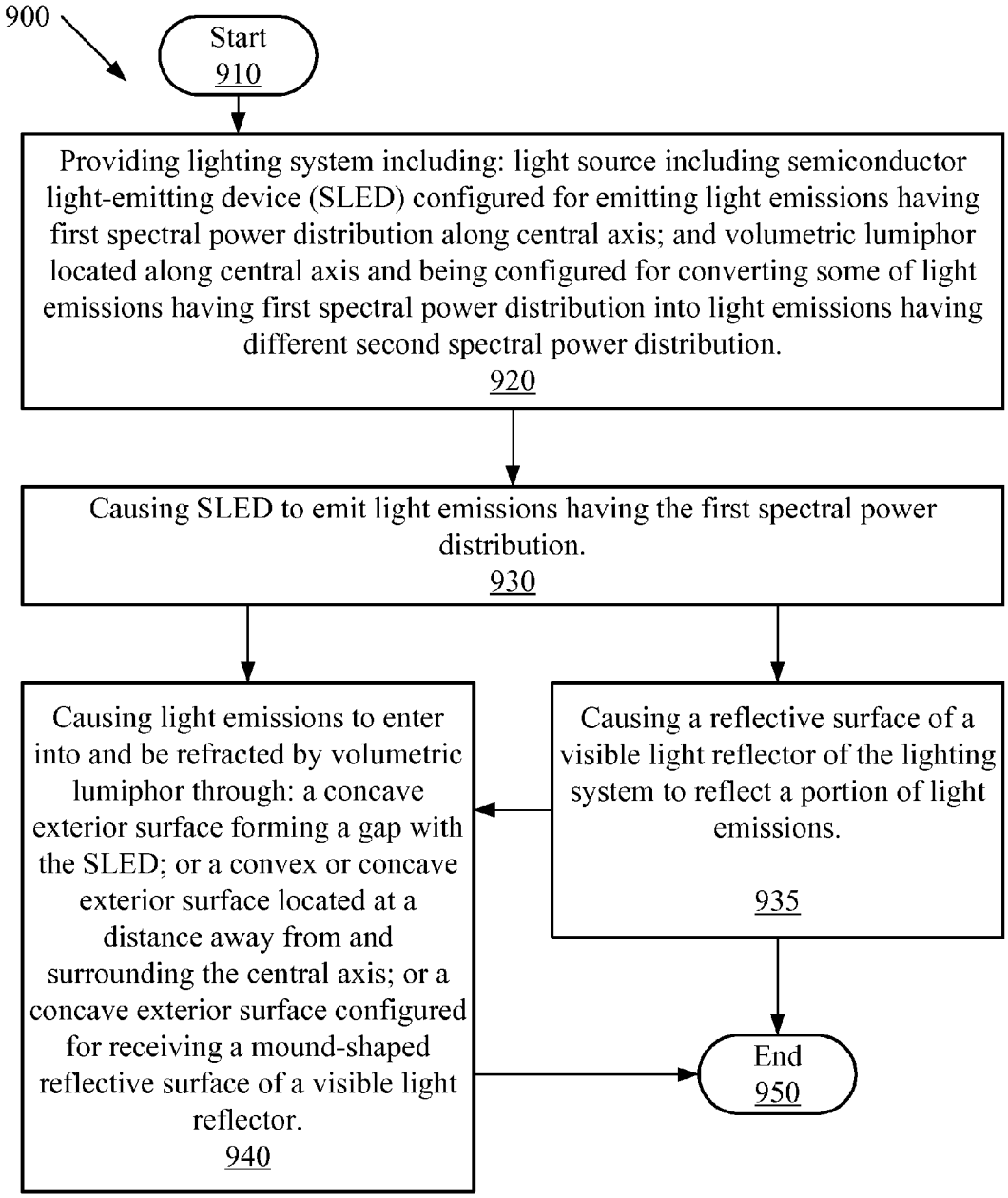
FIG. 9 is a flow chart showing an example of an implementation of a lighting process.

FIG. 9 is a flow chart showing an example [900] of an implementation of a lighting process. The example [900] of the lighting process starts at step [910]. Step [920] of the example [900] of the lighting process includes providing a lighting system [100], [300], [500], [700] including: a light source [102], [302], [502], [702] including a semiconductor light-emitting device [104], [304], [504], [704], the semiconductor light-emitting device [104], [304], [504], [704] being configured for emitting, along a central axis [202], [402], [602], [802], light emissions [204], [206], [404], [406], [604], [606], [804], [806] having a first spectral power distribution; and a volumetric lumiphor [108], [308], [508], [708], being located along the central axis [202], [402], [602], [802] and being configured for converting some of the light emissions [204], [206], [404], [406], [604], [606], [804], [806] having the first spectral power distribution into light emissions [210], [212], [410], [412], [610], [612], [810], [812] having a second spectral power distribution being different than the first spectral power distribution. Step [930] of the example [900] of the lighting process includes causing the semiconductor light-emitting device [104], [304], [504], [704] to emit the light emissions [204], [206], [404], [406], [604], [606], [804], [806] having the first spectral power distribution.

In some examples [900] of the lighting process, providing the lighting system [100], [300], [500], [700] at step [920] may further include providing the volumetric lumiphor [108], [308], [508], [708] as having an exterior surface [452], [652], [852] that includes a concave exterior surface [658] forming a gap between the semiconductor light-emitting device [104], [304], [504], [704] and the volumetric lumiphor [108], [308], [508], [708]. In those examples, step [940] of the example [900] of the lighting process may include causing some of the light emissions [204], [206], [404], [406], [604], [606], [804], [806] from the semiconductor light-emitting device [104], [304], [504], [704] having the first spectral power distribution to enter into the volumetric lumiphor [108], [308], [508], [708] through the concave exterior surface [658]; and causing some of the light emissions [204], [206], [404], [406], [604], [606], [804], [806] having the first spectral power distribution to be refracted by the volumetric lumiphor [108], [308], [508], [708]. In those examples, the example [900] of the lighting process may then end at step [950].

In additional examples [900] of the lighting process, providing the lighting system [100], [300], [500], [700] at step [920] may further include providing the volumetric lumiphor [108], [308], [508], [708] as having an exterior surface [452], [652], [852] that includes a convex exterior surface [664] being located at a distance away from and surrounding the central axis [202], [402], [602], [802]. In those examples, step [940] of the example [900] of the lighting process may include causing some of the light emissions [204], [206], [210], [212], [404], [406], [410], [412], [604], [606], [610], [612], [804], [806] [810], [812] having the first and second spectral power distributions to enter into and to be emitted from the volumetric lumiphor [108], [308], [508], [708] through the convex exterior surface [664]; and causing some of the light emissions having the first and second spectral power distributions to be refracted by the volumetric lumiphor [108], [308], [508], [708]. In those examples, the example [900] of the lighting process may then end at step [950].

In further examples [900] of the lighting process, providing the lighting system [100], [300], [500], [700] at step [920] may further include providing the volumetric lumiphor [108], [308], [508], [708] as having an exterior surface [452], [652], [852] that includes a concave exterior surface [864] being located at a distance away from and surrounding the central axis [202], [402], [602], [802]. In those examples, step [940] of the example [900] of the lighting process may include causing some of the light emissions [204], [206], [210], [212], [404], [406], [410], [412], [604], [606], [610], [612], [804], [806] [810], [812] having the first and second spectral power distributions to enter into and be emitted from the volumetric lumiphor [108], [308], [508], [708] through the concave exterior surface [864]; and causing some of the light emissions having the first and second spectral power distributions to be refracted by the volumetric lumiphor [108], [308], [508], [708]. In those examples, the example [900] of the lighting process may then end at step [950].

In other examples [900] of the lighting process, providing the lighting system [100], [300], [500], [700] at step [920] may further include providing a visible light reflector [106], [306], [506], [706] having a reflective surface [208], [408], [608], [808] and being spaced apart along the central axis [202], [402], [602], [802] at a distance away from the semiconductor light-emitting device [104], [304], [504], [704], with the volumetric lumiphor [108], [308], [508], [708] being located along the central axis [202], [402], [602], [802] between the semiconductor light-emitting device [104], [304], [504], [704] and the visible light reflector [106], [306], [506], [706]. In those examples of the example [900] of the lighting process, step [935] may include causing the reflective surface [208], [408], [608], [808] of the visible light reflector [106], [306], [506], [706] to reflect a portion of the light emissions [204], [206], [210], [212], [404], [406], [410], [412], [604], [606], [610], [612], [804], [806], [810], [812] having the first and second spectral power distributions. Further in those examples, step [935] of the lighting process [900] may additionally include permitting another portion of the light emissions [204], [206], [210], [212], [404], [406], [410], [412], [604], [606], [610], [612], [804], [806], [810], [812] having the first and second spectral power distributions to be transmitted through the visible light reflector [106], [306], [506], [706] along the central axis [202], [402], [602], [802]. In those examples, the process [900] may then end at step [950]. In these other examples of the example [900] of the lighting process, providing the lighting system [100], [300], [500], [700] at step [920] may further include providing the reflective surface [208], [408], [608], [808] of the visible light reflector [106], [306], [506], [706] as including a mound-shaped reflective surface [656]. Also in these other examples of the example [900] of the lighting process, providing the lighting system [100], [300], [500], [700] at step [920] may further include providing the exterior surface [452], [652],

[852] of the volumetric lumiphor [108], [308], [508], [708] as including a concave exterior surface [654] being configured for receiving the mound-shaped reflective surface [656] of the visible light reflector [106], [306], [506], [706].

It is understood that step [920] of the example [900] of the lighting process may include providing the lighting system [100], [300], [500], [700] as having any of the features or any combination of the features that are disclosed herein in connection with discussions of the examples [100], [300], [500], [700] of implementations of the lighting system. Accordingly, FIGS. 1-8 and the entireties of the earlier discussions of the examples [100], [300], [500], [700] of lighting systems are hereby incorporated into this discussion of the examples [900] of the lighting process.

The examples [100], [300], [500], [700] of lighting systems and the example [900] of the lighting process may generally be utilized in end-use applications where light is needed having a selected perceived color point and brightness. The examples [100], [300], [500], [700] of lighting systems and the example [900] of the lighting process provided herein may, for example produce light emissions wherein the directions of propagation of a portion of the light emissions constituting at least about 50% or at least about 80% of a total luminous flux of the semiconductor light-emitting device or devices are redirected by and therefore controlled by the lighting systems. The controlled light emissions from these lighting systems [100], [300], [500], [700] and the lighting process [900] may have, as examples: a perceived uniform color point; a perceived uniform brightness; a perceived uniform appearance; and a perceived aesthetically-pleasing appearance without perceived glare. The controlled light emissions from these lighting systems [100], [300], [500], [700] and the lighting process [900] may further, as examples, be utilized in generating specialty lighting effects being perceived as having a more uniform appearance in applications such as wall wash, corner wash, and floodlight. The lighting systems [100], [300], [500], [700] and the lighting process [900] provided herein may further, for example, protect the lumiphors of the lighting systems from heat-induced degradation that may be caused by heat generated during light emissions by the semiconductor light-emitting devices, resulting in, as examples: a stable color point; and a long-lasting stable brightness. The light emissions from these lighting systems may, for the foregoing reasons, accordingly be perceived as having, as examples: a uniform color point; a uniform brightness; a uniform appearance; an aesthetically-pleasing appearance without perceived glare; a stable color point; and a long-lasting stable brightness.

EXAMPLE

A simulated lighting system is provided that variably includes some of the features that are discussed herein in connection with the examples of the lighting systems [100], [300], [500], [700] and the example [900] of the lighting process, such features variably including: a semiconductor light-emitting device (SLED) being a source of Lambertian light emissions having a diameter at the source of 19 millimeters; a volumetric lumiphor having a concave exterior surface that is located at a distance away from and surrounding the central axis of the lighting system; a visible light reflector; and a primary visible light reflector that includes a truncated parabolic reflector. In a first part of the simulation, the volumetric lumiphor and the visible light reflector are omitted; and the primary visible light reflector defines an image plane of light emissions from the lighting system having a diameter of 167 millimeters at a distance of 145 millimeters away from the SLED, with a resulting beam angle of 15.77 degrees. In simulated operation of this lighting system with the SLED at a total source power of 1.4716 watts, a total power of 0.368345 watts of the light emissions directly reaches the image plane without being reflected by the primary visible light reflector, being about 25.034% of the light emissions from the SLED. In a second part of the simulation, the volumetric lumiphor and the visible light reflector are omitted; and the primary visible light reflector defines an image plane of light emissions from the lighting system having a diameter of 108 millimeters at a distance of 88 millimeters away from the SLED, with a resulting beam angle of 21.8 degrees. In simulated operation of this lighting system with the SLED at a total source power of 1.4716 watts, a total power of 0.403 watts of the light emissions directly reaches the image plane without being reflected by the primary visible light reflector, being about 27.4% of the light emissions from the SLED. In a third part of the simulation, the volumetric lumiphor and the visible light reflector are included; and the primary visible light reflector defines an image plane of light emissions from the lighting system having a diameter of 108 millimeters at a distance of 88 millimeters away from the SLED, with a resulting beam angle of 15.63 degrees. In simulated operation of this lighting system with the SLED at a total source power of 1.4716 watts, a total power of 0.0 watts of the light emissions directly reaches the image plane without being reflected by the primary visible light reflector.

While the present invention has been disclosed in a presently defined context, it will be recognized that the present teachings may be adapted to a variety of contexts consistent with this disclosure and the claims that follow. For example, the lighting systems and processes shown in the figures and discussed above can be adapted in the spirit of the many optional parameters described.

What is claimed is:

1. A lighting system, comprising:

a truncated parabolic visible light reflector having an internal light reflective surface defining a cavity, and having an end and another end being mutually spaced apart along a central axis, the end permitting light emissions from the lighting system;

a light source being located at the another end of the truncated parabolic light reflector and including a semiconductor light-emitting device, the semiconductor light-emitting device being configured for emitting, along the central axis in the cavity, light emissions having a first spectral power distribution;

another visible light reflector, the another light reflector being located in the cavity and having another light reflective surface facing toward the another end of the truncated parabolic light reflector, the another light reflector being spaced apart along the central axis at a distance away from the semiconductor light-emitting device;

a volumetric lumiphor being located in the cavity along the central axis between the semiconductor light-emitting device and the another light reflector, and being configured for converting some of the light emissions into additional light emissions having a second spectral power distribution being different than the first spectral power distribution;

wherein the another light reflector is configured for causing portions of the light emissions and of the additional light emissions to be reflected by the another light reflective surface;

wherein the truncated parabolic light reflector is configured for causing some of the portions of the light emissions and additional light emissions, after being reflected by the another light reflective surface, to then be further reflected by the light-reflective surface and to bypass the another light reflector to be emitted from the end of the truncated parabolic light reflector; and wherein the another light reflector is configured for permitting other portions of the light emissions and of the additional light emissions to pass through the another light reflector along the central axis and then be emitted from the end of the truncated parabolic light reflector.

2. The lighting system of claim 1, including a further visible light reflector being located at the another end of the truncated parabolic light reflector and having a further light-reflective surface facing toward the another light-reflective surface.

3. The lighting system of claim 2, wherein the further reflective surface of the further visible light reflector is configured for causing some of the light emissions and of the additional light emissions to be reflected by the further light reflector in a plurality of lateral directions away from the central axis.

4. The lighting system of claim 1, wherein the another light reflective surface is configured for causing the portions of the light emissions and of the additional light emissions that are reflected by the another light reflective surface to have reflectance values throughout the visible light spectrum being within a range of about 0.80 and about 0.95.

5. The lighting system of claim 1, wherein the another light reflector is configured for causing the other portions of the light emissions and of the additional light emissions that pass through the another light reflector to have transmittance values throughout the visible light spectrum being within a range of about 0.20 and about 0.05.

6. The lighting system of claim 1, wherein the another light reflective surface of the another light reflector is configured for causing some of the portions of the light emissions and of the additional light emissions that are reflected by the another light reflective surface to be redirected in a plurality of lateral directions away from the central axis.

7. The lighting system of claim 6, wherein the truncated parabolic light reflector is configured for causing some of the portions of the light emissions and of the additional light emissions to be redirected in a plurality of directions intersecting the central axis.

8. The lighting system of claim 7, wherein the semiconductor light-emitting device is configured for emitting the light emissions as having a luminous flux of a first magnitude, and wherein the lighting system is configured for causing the some of the portions of the light emissions and of the additional light emissions that are redirected in the plurality of directions intersecting the central axis to have a luminous flux of a second magnitude being at least about 50% as great as the first magnitude.

9. The lighting system of claim 7, wherein the semiconductor light-emitting device is configured for emitting the light emissions as having a luminous flux of a first magnitude, and wherein the lighting system is configured for causing the some of the portions of the light emissions and of the additional light emissions that are redirected in the plurality of directions intersecting the central axis to have a luminous flux of a second magnitude being at least about 80% as great as the first magnitude.

10. The lighting system of claim 1, wherein the lighting system is configured for forming combined light emissions by causing some of the light emissions to be combined together with some of the additional light emissions, and wherein the lighting system is configured for causing some of the combined light emissions to be emitted from the lighting system in a plurality of directions intersecting the central axis.

11. The lighting system of claim 10, wherein the lighting system is configured for causing some of the combined light emissions to be emitted from the lighting system in a plurality of directions diverging away from the central axis.

12. The lighting system of claim 10, wherein the lighting system is configured for causing some of the combined light emissions to be emitted from the lighting system in a plurality of directions along the central axis.

13. The lighting system of claim 1, wherein the another light reflector has a shape being centered on the central axis.

14. The lighting system of claim 1, wherein the another light reflector has a shape that extends away from the central axis in directions being transverse to the central axis.

15. The lighting system of claim 14, wherein the shape of the another light reflector has a maximum width in the directions transverse to the central axis, and wherein the volumetric lumiphor has a shape that extends away from the central axis in directions being transverse to the central axis, and wherein the shape of the volumetric lumiphor has a maximum width in the directions transverse to the central axis being smaller than the maximum width of the another light reflector.

16. The lighting system of claim 14, wherein the shape of the another light reflector has a maximum width in the directions transverse to the central axis, and wherein the volumetric lumiphor has a shape that extends away from the central axis in directions being transverse to the central axis, and wherein the shape of the volumetric lumiphor has a maximum width in the directions transverse to the central axis being equal to or larger than the maximum width of the another light reflector.

17. The lighting system of claim 14, wherein the another light reflective surface of the another light reflector has a distal portion being located at a greatest distance away from the central axis, and wherein the distal portion of the another light reflective surface has a beveled edge.

18. The lighting system of claim 14, wherein a portion of the another light reflective surface of the another light reflector is a planar light reflective surface.

19. The lighting system of claim 14, wherein a portion of the another light reflective surface of the another light reflector faces toward the semiconductor light-emitting device and extends away from the central axis in the directions transverse to the central axis.

20. The lighting system of claim 1, wherein a portion of the another light reflective surface of the another light reflector faces toward the semiconductor light-emitting device, and wherein the volumetric lumiphor has an exterior surface, and wherein a portion of the exterior surface of the volumetric lumiphor faces toward the portion of the another light reflective surface of the another light reflector.

21. The lighting system of claim 20, wherein the portion of the exterior surface of the volumetric lumiphor is configured for permitting entry into the volumetric lumiphor by the light emissions and the additional light emissions.

22. The lighting system of claim 1, wherein a portion of the another light reflective surface of the another light reflector is a convex light reflective surface facing toward the semiconductor light-emitting device.

23. The lighting system of claim 22, wherein a shortest distance between the semiconductor light-emitting device and the portion of the another light reflective surface of the another light reflector is located along the central axis.

24. The lighting system of claim 22, wherein the convex light reflective surface of the another light reflector is configured for causing some of the light emissions and of the additional light emissions that are reflected by the another light reflector to be redirected in a plurality of lateral directions away from the central axis.

25. The lighting system of claim 22, wherein a portion of the another light reflective surface of the another light reflector is a mound-shaped light reflective surface facing toward the semiconductor light-emitting device.

26. The lighting system of claim 25, wherein the volumetric lumiphor has an exterior surface, and wherein a portion of the exterior surface of the volumetric lumiphor is a concave exterior surface being configured for receiving the mound-shaped light reflective surface of the another light reflector.

27. The lighting system of claim 26, wherein the lighting system is configured for causing some of the light emissions and of the additional light emissions to be emitted from the volumetric lumiphor through the concave exterior surface, and wherein the another light reflector is configured for causing some of the light emissions and of the additional light emissions to be reflected by the another light reflective surface and to enter into the volumetric lumiphor through the concave exterior surface.

28. The lighting system of claim 1, wherein the volumetric lumiphor has an exterior surface, and wherein a portion of the exterior surface of the volumetric lumiphor is a concave exterior surface forming a gap between the semiconductor light-emitting device and the volumetric lumiphor.

29. The lighting system of claim 28, wherein the lighting system is configured for causing entry of some of the light emissions from the semiconductor light-emitting device into the volumetric lumiphor through the concave exterior surface, and wherein the volumetric lumiphor is configured for causing refraction of some of the light emissions.

30. The lighting system of claim 1, wherein the volumetric lumiphor has an exterior surface, and wherein a portion of the exterior surface of the volumetric lumiphor is a convex exterior surface surrounded by a concave exterior surface, and wherein the concave exterior surface forms a gap between the semiconductor light-emitting device and the volumetric lumiphor.

31. The lighting system of claim 1, wherein the volumetric lumiphor has an exterior surface, and wherein a portion of the exterior surface of the volumetric lumiphor is a convex exterior surface being located at a distance away from and surrounding the central axis.

32. The lighting system of claim 31, wherein the lighting system is configured for causing some of the light emissions and of the additional light emissions to be emitted from the volumetric lumiphor through the convex exterior surface, and wherein the convex exterior surface is configured for causing refraction of some of the light emissions and of the additional light emissions.

33. The lighting system of claim 1, wherein the volumetric lumiphor has an exterior surface, and wherein a portion of the exterior surface of the volumetric lumiphor is a concave exterior surface being located at a distance away from and surrounding the central axis.

34. The lighting system of claim 33, wherein the lighting system is configured for causing some of the light emissions and of the additional light emissions to be emitted from the volumetric lumiphor through the concave exterior surface, and wherein the concave exterior surface is configured for causing refraction of some of the light emissions and of the additional light emissions.

35. The lighting system of claim 1, wherein the volumetric lumiphor includes: a phosphor; a quantum dot; a quantum wire; a quantum well; a photonic nanocrystal; a semiconducting nanoparticle; a scintillator; a lumiphoric ink; a lumiphoric organic dye; or a day glow tape.

36. The lighting system of claim 1, wherein the volumetric lumiphor is configured for down-converting some of the light emissions of the semiconductor light-emitting device having wavelengths of the first spectral power distribution into the additional light emissions having wavelengths of the second spectral power distribution as being longer than wavelengths of the first spectral power distribution.

37. The lighting system of claim 1, wherein the semiconductor light-emitting device is configured for emitting light having a dominant- or peak-wavelength being within a range of between about 380 nanometers and about 530 nanometers.

38. The lighting system of claim 37, further including another semiconductor light-emitting device, wherein the another semiconductor light-emitting device is configured for emitting light having a dominant- or peak-wavelength being within a range of between about 380 nanometers and about 530 nanometers.

39. The lighting system of claim 37, wherein the volumetric lumiphor is configured for down-converting some of the light emissions of the semiconductor light-emitting device having wavelengths of the first spectral power distribution into the additional light emissions having wavelengths of the second spectral power distribution as being longer than wavelengths of the first spectral power distribution.

40. The lighting system of claim 37, wherein the lighting system is configured for causing the light emissions and the additional light emissions having the first and second spectral power distributions to be combined together forming combined light emissions having a color point with a color rendition index (CRI-Ra including $R_{1-8}$) being about equal to or greater than 50.

41. The lighting system of claim 37, wherein the lighting system is configured for causing the light emissions and the additional light emissions having the first and second spectral power distributions to be combined together forming combined light emissions having a color point with a color rendition index (CRI-Ra including $R_{1-8}$) being about equal to or greater than 75.

42. The lighting system of claim 37, wherein the lighting system is configured for causing the light emissions and the additional light emissions having the first and second spectral power distributions to be combined together forming combined light emissions having a color point with a color rendition index (CRI-Ra including $R_{1-8}$) being about equal to or greater than 95.

43. The lighting system of claim 37, wherein the lighting system is configured for causing the light emissions and the additional light emissions having the first and second spectral power distributions to be combined together forming combined light emissions having a color point with a color rendition index (CRI-$R_9$) being about equal to or greater than 50.

44. The lighting system of claim 37, wherein the lighting system is configured for causing the light emissions and the additional light emissions having the first and second spectral power distributions to be combined together forming combined light emissions having a color point with a color rendition index (CRI-$R_9$) being about equal to or greater than 75.

45. The lighting system of claim 37, wherein the lighting system is configured for causing the light emissions and the additional light emissions having the first and second spectral power distributions to be combined together forming combined light emissions having a color point with a color rendition index (CRI-$R_9$) being about equal to or greater than 90.

46. The lighting system of claim 37, wherein the lighting system is configured for forming combined light emissions by causing some of the light emissions having the first spectral power distribution to be combined together with some of the additional light emissions having the second spectral power distribution, and wherein the semiconductor light-emitting device and the volumetric lumiphor are configured for causing the combined light emissions to have a color point being within a distance of about equal to or less than +/−0.009 delta(uv) away from a Planckian—black-body locus throughout a spectrum of correlated color temperatures (CCTs) within a range of between about 1800K and about 6500K.

47. The lighting system of claim 37, wherein the lighting system is configured for forming combined light emissions by causing some of the light emissions having the first spectral power distribution to be combined together with some of the additional light emissions having the second spectral power distribution, and wherein the semiconductor light-emitting device and the volumetric lumiphor are configured for causing the combined light emissions to have a color point being below a Planckian—black-body locus by a distance of about equal to or less than 0.009 delta(uv) throughout a spectrum of correlated color temperatures (CCTs) within a range of between about 1800K and about 6500K.

48. The lighting system of claim 1, wherein the semiconductor light-emitting device is configured for emitting light having a color point being greenish-blue, blue, or purplish-blue.

49. The lighting system of claim 1, wherein the semiconductor light-emitting device is configured for emitting light having a dominant- or peak-wavelength being within a range of between about 420 nanometers and about 510 nanometers.

50. The lighting system of claim 1, wherein the semiconductor light-emitting device is configured for emitting light having a dominant- or peak-wavelength being within a range of between about 445 nanometers and about 490 nanometers.

51. The lighting system of claim 50, wherein the volumetric lumiphor is configured for down-converting some of the light emissions of the semiconductor light-emitting device having wavelengths of the first spectral power distribution into the additional light emissions having wavelengths of the second spectral power distribution, and wherein the second spectral power distribution has a perceived color point being within a range of between about 491 nanometers and about 575 nanometers.

52. The lighting system of claim 51, wherein the volumetric lumiphor includes a first lumiphor that generates the additional light emissions having a perceived color point being within a range of between about 491 nanometers and about 575 nanometers, wherein the first lumiphor includes: a phosphor; a quantum dot; a quantum wire; a quantum well; a photonic nanocrystal; a semiconducting nanoparticle; a scintillator; a lumiphoric ink; a lumiphoric organic dye; or a day glow tape.

53. The lighting system of claim 51, wherein the volumetric lumiphor is configured for down-converting some of the light emissions of the semiconductor light-emitting device having the first spectral power distribution into the additional light emissions having wavelengths of a third spectral power distribution being different than the first and second spectral power distributions; wherein the third spectral power distribution has a perceived color point being within a range of between about 610 nanometers and about 670 nanometers.

54. The lighting system of claim 53, wherein the volumetric lumiphor includes a second lumiphor that generates further light emissions having a perceived color point being within a range of between about 610 nanometers and about 670 nanometers, wherein the second lumiphor includes: a phosphor; a quantum dot; a quantum wire; a quantum well; a photonic nanocrystal; a semiconducting nanoparticle; a scintillator; a lumiphoric ink; a lumiphoric organic dye; or a day glow tape.

55. The lighting system of claim 53, wherein the lighting system is configured for causing the light emissions and the additional light emissions and the further light emissions having the first, second and third spectral power distributions to be combined together to form combined light emissions having a color point with a color rendition index (CRI-Ra including $R_{1-8}$) being about equal to or greater than 50.

56. The lighting system of claim 53, wherein the lighting system is configured for causing the light emissions and the additional light emissions and the further light emissions having the first, second and third spectral power distributions to be combined together to form combined light emissions having a color point with a color rendition index (CRI-Ra including $R_{1-8}$) being about equal to or greater than 75.

57. The lighting system of claim 53, wherein the lighting system is configured for causing the light emissions and the additional light emissions and the further light emissions having the first, second and third spectral power distributions to be combined together to form combined light emissions having a color point with a color rendition index (CRI-Ra including $R_{1-8}$) being about equal to or greater than 95.

58. The lighting system of claim 53, wherein the lighting system is configured for causing the light emissions and the additional light emissions and the further light emissions having the first, second and third spectral power distributions to be combined together to form combined light emissions having a color point with a color rendition index (CRI-$R_9$) being about equal to or greater than 50.

59. The lighting system of claim 53, wherein the lighting system is configured for causing the light emissions and the additional light emissions and the further light emissions having the first, second and third spectral power distributions to be combined together to form combined light emissions having a color point with a color rendition index (CRI-$R_9$) being about equal to or greater than 75.

60. The lighting system of claim 53, wherein the lighting system is configured for causing the light emissions and the additional light emissions and the further light emissions having the first, second and third spectral power distributions to be combined together to form combined light emissions having a color point with a color rendition index (CRI-$R_9$) being about equal to or greater than 90.

61. The lighting system of claim 53, wherein the volumetric lumiphor is configured for causing the light emissions and the additional light emissions and the further light emissions having the first, second and third spectral power distributions to be combined together to form combined light emissions having a color point being within a distance of about equal to or less than +/−0.009 delta(uv) away from a Planckian—black-body locus throughout a spectrum of correlated color temperatures (CCTs) within a range of between about 1800K and about 6500K.

62. The lighting system of claim 53, wherein the volumetric lumiphor is configured for causing the light emissions and the additional light emissions and the further light emissions having the first, second and third spectral power distributions to be combined together to form combined light emissions having a color point being below a Planckian—black-body locus by a distance of about equal to or less than 0.009 delta(uv) throughout a spectrum of correlated color temperatures (CCTs) within a range of between about 1800K and about 6500K.

63. The lighting system of claim 53, wherein the first lumiphor includes a first quantum material, and wherein the second lumiphor includes a different second quantum material, and wherein each one of the first and second quantum materials has a spectral power distribution for light absorption being separate from both of the second and third spectral power distributions.

64. A lighting system, comprising:

a truncated conical visible light reflector having an internal light reflective surface defining a cavity, and having an end and another end being mutually spaced apart along a central axis, the end permitting light emissions from the lighting system;

a light source being located at the another end of the truncated conical light reflector and including a semiconductor light-emitting device, the semiconductor light-emitting device being configured for emitting, along the central axis in the cavity, light emissions having a first spectral power distribution;

another visible light reflector, the another light reflector being located in the cavity and having another light reflective surface facing toward the another end of the truncated conical light reflector, the another light reflector being spaced apart along the central axis at a distance away from the semiconductor light-emitting device;

a volumetric lumiphor being located in the cavity along the central axis between the semiconductor light-emitting device and the another light reflector, and being configured for converting some of the light emissions into additional light emissions having a second spectral power distribution being different than the first spectral power distribution;

wherein the another light reflector is configured for causing portions of the light emissions and of the additional light emissions to be reflected by the another light reflective surface;

wherein the truncated conical light reflector is configured for causing some of the portions of the light emissions and additional light emissions, after being reflected by the another light reflective surface, to then be further reflected by the light-reflective surface and to bypass the another light reflector to be emitted from the end of the truncated conical light reflector; and wherein the another light reflector is configured for permitting other portions of the light emissions and of the additional light emissions to pass through the another light reflector along the central axis and then be emitted from the end of the truncated conical light reflector.

65. The lighting system of claim 64, including a further visible light reflector being located at the another end of the truncated conical light reflector and having a further light-reflective surface facing toward the another light-reflective surface.

66. The lighting system of claim 65, wherein the further reflective surface of the further visible light reflector is configured for causing some of the light emissions and of the additional light emissions to be reflected by the further light reflector in a plurality of lateral directions away from the central axis.

67. The lighting system of claim 64, wherein the another light reflective surface is configured for causing the portions of the light emissions and of the additional light emissions that are reflected by the another light reflective surface to have reflectance values throughout the visible light spectrum being within a range of about 0.80 and about 0.95.

68. The lighting system of claim 64, wherein the another light reflector is configured for causing the other portions of the light emissions and of the additional light emissions that pass through the another light reflector to have transmittance values throughout the light spectrum being within a range of about 0.20 and about 0.05.

69. The lighting system of claim 64, wherein the another light reflective surface of the another light reflector is configured for causing some of the portions of the light emissions and of the additional light emissions that are reflected by the another light reflective surface to be redirected in a plurality of lateral directions away from the central axis.

70. The lighting system of claim 69, wherein the truncated conical light reflector is configured for causing some of the portions of the light emissions and of the additional light emissions to be redirected in a plurality of directions intersecting the central axis.

71. The lighting system of claim 70, wherein the semiconductor light-emitting device is configured for emitting the light emissions as having a luminous flux of a first magnitude, and wherein the lighting system is configured for causing the some of the portions of the light emissions and of the additional light emissions that are redirected in the plurality of directions intersecting the central axis to have a luminous flux of a second magnitude being at least about 50% as great as the first magnitude.

72. The lighting system of claim 70, wherein the semiconductor light-emitting device is configured for emitting the light emissions as having a luminous flux of a first magnitude, and wherein the lighting system is configured for causing the some of the portions of the light emissions and of the additional light emissions that are redirected in the plurality of directions intersecting the central axis to have a luminous flux of a second magnitude being at least about 80% as great as the first magnitude.

73. The lighting system of claim 64, wherein the lighting system is configured for forming combined light emissions by causing some of the light emissions to be combined together with some of the additional light emissions, and wherein the lighting system is configured for causing some of the combined light emissions to be emitted from the lighting system in a plurality of directions intersecting the central axis.

74. The lighting system of claim 64, wherein the another light reflector has a shape that extends away from the central axis in directions being transverse to the central axis wherein the another light reflective surface of the another light reflector has a distal portion being located at a greatest distance away from the central axis, and wherein the distal portion of the another light reflective surface has a beveled edge.

75. A lighting system, comprising:

total internal reflection lens having an end and another end being mutually spaced apart along a central axis, the end permitting light emissions from the lighting system;

a light source being located at the another end of the total internal reflection lens and including a semiconductor light-emitting device, the semiconductor light-emitting device being configured for emitting, along the central axis in the cavity, light emissions having a first spectral power distribution;

another visible light reflector, the another light reflector having another light reflective surface facing toward the another end of the total internal reflection lens, the another light reflector being spaced apart along the central axis at a distance away from the semiconductor light-emitting device;

a volumetric lumiphor being located along the central axis between the semiconductor light-emitting device and the another light reflector, and being configured for converting some of the light emissions into additional light emissions having a second spectral power distribution being different than the first spectral power distribution;

wherein the another light reflector is configured for causing portions of the light emissions and of the additional light emissions to be reflected by the another light reflective surface;

wherein the total internal reflection lens is configured for causing some of the light emissions and of the additional light emissions to be redirected in a plurality of directions intersecting the central axis, and for causing some of the portions of the light emissions and additional light emissions, after being reflected by the another light reflective surface, to then be further reflected by the light-reflective surface and to bypass the another light reflector to be emitted from the end of the total internal reflection lens; and wherein the another light reflector is configured for permitting other portions of the light emissions and of the additional light emissions to pass through the another light reflector along the central axis and then be emitted from the end of the total internal reflection lens.

76. The lighting system of claim 75, wherein the semiconductor light-emitting device is configured for emitting the light emissions as having a luminous flux of a first magnitude, and wherein the lighting system is configured for causing the some of the portions of the light emissions and of the additional light emissions that are redirected in the plurality of directions intersecting the central axis to have a luminous flux of a second magnitude being at least about 50% as great as the first magnitude.

77. The lighting system of claim 75, wherein the semiconductor light-emitting device is configured for emitting the light emissions as having a luminous flux of a first magnitude, and wherein the lighting system is configured for causing the some of the portions of the light emissions and of the additional light emissions that are redirected in the plurality of directions intersecting the central axis to have a luminous flux of a second magnitude being at least about 80% as great as the first magnitude.

78. The lighting system of claim 75, including a further visible light reflector being located at the another end of the total internal reflection lens and having a further light-reflective surface facing toward the another light-reflective surface.

79. The lighting system of claim 78, wherein the further reflective surface of the further visible light reflector is configured for causing some of the light emissions and of the additional light emissions to be reflected by the further light reflector in a plurality of lateral directions away from the central axis.

80. The lighting system of claim 75, wherein the another light reflective surface is configured for causing the portions of the light emissions and of the additional light emissions that are reflected by the another light reflective surface to have reflectance values throughout the visible light spectrum being within a range of about 0.80 and about 0.95.

81. The lighting system of claim 75, wherein the another light reflector is configured for causing the other portions of the light emissions and of the additional light emissions that pass through the another light reflector to have transmittance values throughout the visible light spectrum being within a range of about 0.20 and about 0.05.

82. The lighting system of claim 75, wherein the another light reflective surface of the another light reflector is configured for causing some of the portions of the light emissions and of the additional light emissions that are reflected by the another light reflective surface to be redirected in a plurality of lateral directions away from the central axis.

83. The lighting system of claim 82, wherein the total internal reflection lens is configured for causing some of the portions of the light emissions and of the additional light emissions to be redirected in a plurality of directions intersecting the central axis.

84. The lighting system of claim 75, wherein the lighting system is configured for forming combined light emissions by causing some of the light emissions to be combined together with some of the additional light emissions, and wherein the lighting system is configured for causing some of the combined light emissions to be emitted from the lighting system in a plurality of directions intersecting the central axis.

85. The lighting system of claim 75, wherein the another light reflector has a shape that extends away from the central axis in directions being transverse to the central axis wherein the another light reflective surface of the another light reflector has a distal portion being located at a greatest distance away from the central axis, and wherein the distal portion of the another light reflective surface has a beveled edge.

86. A lighting process, comprising:

providing a lighting system including: a truncated parabolic visible light reflector having an internal light reflective surface defining a cavity, and having an end and another end being mutually spaced apart along a central axis, the end permitting light emissions from the lighting system; a light source being located at the another end of the truncated parabolic light reflector and including a semiconductor light-emitting device being configured for emitting, along the central axis, light emissions having a first spectral power distribution; a volumetric lumiphor being configured for converting some of the light emissions into additional light emissions having a second spectral power distribution being different than the first spectral power distribution; and another visible light reflector, being located in the cavity and having another light reflective surface facing toward the another end of the truncated parabolic light reflector, the another light reflector being spaced apart along the central axis at a distance away from the semiconductor light-emitting device, with the volumetric lumiphor being located in the cavity along the central axis between the semiconductor light-emitting device and the another light reflector;

causing the semiconductor light-emitting device to emit the light emissions having the first spectral power distribution;

causing conversions of some of the light emissions into the additional light emissions;

causing the another light reflective surface of the another light reflector to reflect portions of the light emissions and of the additional light emissions; and causing some of the portions of the light emissions and additional light emissions to then be further reflected by the light-reflective surface and to bypass the another light reflector to be emitted from the end of the truncated parabolic light reflector.

87. The lighting process of claim 86, wherein the lighting process further includes permitting other portions of the light emissions and of the additional light emissions to pass through the another light reflector along the central axis and to then be emitted from the end of the truncated parabolic light reflector.

88. A lighting process, comprising:

providing a lighting system including: a truncated conical visible light reflector having an internal light reflective surface defining a cavity, and having an end and another end being mutually spaced apart along a central axis, the end permitting light emissions from the lighting system; a light source being located at the another end of the truncated conical light reflector and including a semiconductor light-emitting device being configured for emitting, along the central axis, light emissions having a first spectral power distribution; a volumetric lumiphor being configured for converting some of the light emissions into additional light emissions having a second spectral power distribution being different than the first spectral power distribution; and another visible light reflector, being located in the cavity and having another light reflective surface facing toward the another end of the truncated conical light reflector, the another light reflector being spaced apart along the central axis at a distance away from the semiconductor light-emitting device, with the volumetric lumiphor being located in the cavity along the central axis between the semiconductor light-emitting device and the another light reflector;

causing the semiconductor light-emitting device to emit the light emissions having the first spectral power distribution;

causing conversions of some of the light emissions into the additional light emissions;

causing the another light reflective surface of the another light reflector to reflect portions of the light emissions and of the additional light emissions; and causing some of the portions of the light emissions and additional light emissions to then be further reflected by the light-reflective surface and to bypass the another light reflector to be emitted from the end of the truncated conical light reflector.

89. The lighting process of claim 88, wherein the lighting process further includes permitting other portions of the light emissions and of the additional light emissions to pass through the another light reflector along the central axis and to then be emitted from the end of the truncated conical light reflector.

* * * * *